US009234379B2

(12) United States Patent
Togiya

(10) Patent No.: US 9,234,379 B2
(45) Date of Patent: Jan. 12, 2016

(54) PAPER SHEET STORAGE CONTAINER AND PAPER SHEET HANDLING APPARATUS

(71) Applicant: Oki Electric Industry Co., Ltd., Tokyo (JP)

(72) Inventor: Hajime Togiya, Gumma (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/002,694

(22) PCT Filed: Mar. 7, 2013

(86) PCT No.: PCT/JP2013/056358

§ 371 (c)(1),
(2) Date: Aug. 30, 2013

(87) PCT Pub. No.: WO2013/146172

PCT Pub. Date: Oct. 3, 2013

(65) Prior Publication Data

US 2015/0047539 A1 Feb. 19, 2015

(30) Foreign Application Priority Data

Mar. 26, 2012 (JP) ..... 2012-069689

(51) Int. Cl.
*E05G 1/04* (2006.01)
*G09F 3/03* (2006.01)
(Continued)

(52) U.S. Cl.
CPC *E05G 1/04* (2013.01); *E05G 1/026* (2013.01); *G07D 11/0006* (2013.01); *G07D 11/0081* (2013.01); *G09F 3/03* (2013.01); *G09F 3/037* (2013.01)

(58) Field of Classification Search
CPC ..... G07D 11/0006; G07D 11/0009; G07D 11/0081; E05G 1/005; E05G 1/026; E05G 1/04; G07F 7/04; G07F 9/06; B65H 2701/1912; G09F 3/03; G09F 3/0305; G09F 3/037; G09F 3/0352
USPC ..... 232/1 D, 15, 16, 44, 43.2; 109/47, 59 R, 109/64, 66, 75; 194/350, 202, 206; 292/325, 307 A, 307 R; 70/63
See application file for complete search history.

(56) References Cited

U.S. PATENT DOCUMENTS 4,331,257 A * 5/1982 Taschner ..... 220/324
5,168,987 A * 12/1992 Warwicker ..... 206/0.81
(Continued)

FOREIGN PATENT DOCUMENTS

JP S48-51798 U 7/1973
JP S60-17784 A 1/1985
JP H11-203532 A 7/1999
(Continued)

OTHER PUBLICATIONS

Office Action with English translation issued by Japan Patent Office on Nov. 19, 2014 for corresponding Japanese application No. 2014-006345.
(Continued)

*Primary Examiner* — William Miller
(74) *Attorney, Agent, or Firm* — Rabin & Berdo, P.C.

(57) ABSTRACT

A paper sheet storage container and a paper handling apparatus that includes the container. The container includes an outer case, an open-closable door attached to the outer case, a lock that locks the door in a closed state with respect to the outer case, and a seal attachment portion that seals the door closed with respect to the outer case, so as to indicate that the door is closed with respect to the outer case, and to lock the door in the closed state with respect to the outer case. The paper sheet handling apparatus, includes a storage container mounting portion detachably mounted with the paper sheet storage container, which may function for storage of banknotes for handling within an outer case.

4 Claims, 63 Drawing Sheets

(51) Int. Cl.

| | |
|---|---|
| ***G07D 11/00*** | (2006.01) |
| ***E05G 1/026*** | (2006.01) |

(56) References Cited

U.S. PATENT DOCUMENTS

| | | | | | |
|---|---|---|---|---|---|
| 5,607,102 | A | * | 3/1997 | Walsh et al. | 232/1 D |
| 5,890,439 | A | * | 4/1999 | McGunn | 109/47 |
| 6,145,737 | A | * | 11/2000 | Imai et al. | 232/1 D |
| 6,880,869 | B2 | * | 4/2005 | Schainholz et al. | 292/307 A |

FOREIGN PATENT DOCUMENTS

| | | | |
|---|---|---|---|
| JP | 2001160169 | A | 6/2001 |
| JP | 2004-353259 | A | 12/2004 |
| JP | 2011-118699 | A | 6/2011 |

OTHER PUBLICATIONS

Office Action with English translation issued by Japan Patent Office on Nov. 25, 2014 for corresponding Japanese application No. 2014-006344.

* cited by examiner

PAPER SHEET STORAGE CONTAINER AND PAPER SHEET HANDLING APPARATUS

TECHNICAL FIELD

The present invention relates to a paper sheet storage container and a paper sheet handling apparatus, and is suitably applied, for example, to an automatic teller machine (ATM) that performs banknote deposit and withdrawal transactions and to a banknote storage container detachably mounted to the automatic teller machine.

BACKGROUND ART

A conventional automatic teller machine is detachably mounted with banknote storage containers that store or feed out banknotes. In such cases, a door is open-closable attached to the banknote storage container, such that the banknote storage container can be removed from the automatic teller machine and loaded inside with banknotes by a member of staff at a designated banknote loading location.

In the banknote storage container, a lock is attached to lock the door in a closed state to protect the banknotes inside, such as when the banknote storage container is mounted or demounted from the automatic teller machine or when in transport between the automatic teller machine and the banknote loading location.

However, since there are opportunities for people to handle the banknote storage container in a state loaded with banknotes inside, such as when being mounted or demounted and during transport, the possibility of the door that is locked by the lock being improperly opened cannot be discounted.

Accordingly, heretofore, as such types of banknote storage container, there are configurations such as those illustrated in FIG. 48 and FIG. 49 in which it is possible to confirm whether or not there is a possibility that the door has been improperly opened.

As illustrated in FIG. 48 and FIG. 49, in such a banknote storage container, a thus configured banknote storage container has a lock section 300 that restricts opening and closing of a door, not illustrated in the drawings, and is secured to a front face plate of the banknote storage container.

The lock section 300 includes a base 301. A lock 302 for locking the closed state of the door is attached to the base 301. Further, a cover 303 is open-closable attached to the base 301 so as to cover or expose a keyhole 302A of the lock 302.

Further, a lock plate 304 for locking the cover 303 is provided inside the base 301 so as to be capable of rotating. When the cover 303 is closed with respect to the base 301, the lock section 300 rotates the lock plate 304 under bias from a spring, not illustrated in the drawings, to lock the cover 303 in a closed state.

Moreover, in the base 301, a base elongated hole is provided facing a plate one end portion 304A of the lock plate 304. A long narrow keyhole 303A is formed in the cover 303 so as to face the base elongated hole in a closed state of the cover 303 with respect to the base 301.

Furthermore, in the lock section 300, in the locked state of the cover 303, the lock plate 304 is rotated when a lock release key 305 that is inserted from the keyhole 303A across the base elongated hole is moved along the keyhole 303A to press the plate one end portion 304A, thereby releasing locking of the cover 303.

Thus, in the lock section 300, the locking of the door can be released and the door opened by opening the cover 303 with respect to the base 301 to expose the keyhole 302A of the lock 302, and then inserting a door opening and closing key, not illustrated in the drawings, into the keyhole 302A of the lock 302 and rotation operating the key.

Note that, in the lock section 300, an identification label 306 can be disposed on the base 301 so as to cover the base elongated hole, and in a closed state of the cover 303 with respect to the base 301, the identification label 306 is interposed between the base elongated hole and the keyhole 303A.

Consequently, in the lock section 300, in the locked state of the cover 303, when the lock release key 305 is inserted into the keyhole 303A, the identification label 306 is pierced so as to be destroyed by the lock release key 305.

Thus, in the lock section 300, destruction of the identification label 306 can be caused even in cases in which an object other than the lock release key 305, such as a piece of wire, is inserted into the keyhole 303A in order to release locking of the cover 303 in an attempt to improperly open the door.

Accordingly, the configured banknote storage container enables confirmation of whether or not there is a possibility that the door has been improperly opened by whether or not the identification label 306 in the lock section 300 has been destroyed other than when banknotes are being loaded by the member of staff (see, for example, FIG. 8 and FIG. 9 on page 5 of Japanese Patent Application Laid-Open (JP-A) No. H11-203532.

SUMMARY OF INVENTION

Technical Problem

However, since there are opportunities for people to handle the banknote storage container that is demountable from the automatic teller machine, there is a general need to improve security.

However, in conventional banknote storage containers of such a configuration, locking of the door is only performed by the lock 302. Consequently, in a conventional banknote storage container, although by using the identification label 306 it is possible to confirm whether or not there is a possibility of the door having been improperly opened, there is still an issue that there is not a sufficient improvement in security.

In consideration of the above circumstances, the present invention proposes a paper sheet storage container and a paper sheet handling apparatus that obtain improved security compared to conventional art.

Solution to Problem

In order to address the above issue, the present invention is provided with: an outer case; a door, attached to the outer case, that is open-closable; a lock that locks the door in a closed state with respect to the outer case; and a seal attachment portion for attaching with a seal that seals the door closed with respect to the outer case, so as to indicate that the door is closed with respect to the outer case, and to lock the door in the closed state with respect to the outer case.

According to the present invention, it may be easily confirmed as to whether or not there is a possibility of the door having been improperly opened by whether or not the seal is still attached to the seal attachment portion up to the point when the seal is legitimately removed from the seal attachment portion, and locking of the door by the seal may be maintained even in cases in which locking of the door by the lock has been improperly released.

Advantageous Effects of Invention

According to the present invention, it may be easily confirmed as to whether or not there is a possibility of the door having been improperly opened by whether or not the seal is still attached to the seal attachment portion up to the point when the seal is legitimately removed from the seal attachment portion, and locking of the door by the seal may be maintained even in cases in which locking of the door by the lock has been improperly released. A paper sheet storage container and a paper sheet handling apparatus that have improved security compared to previously may accordingly be achieved.

DESCRIPTION OF EMBODIMENTS

Explanation follows regarding best modes for carrying out the invention (also referred to below as embodiments), with reference to the drawings. Note that explanation is given in the following sequence.

Figure 1:
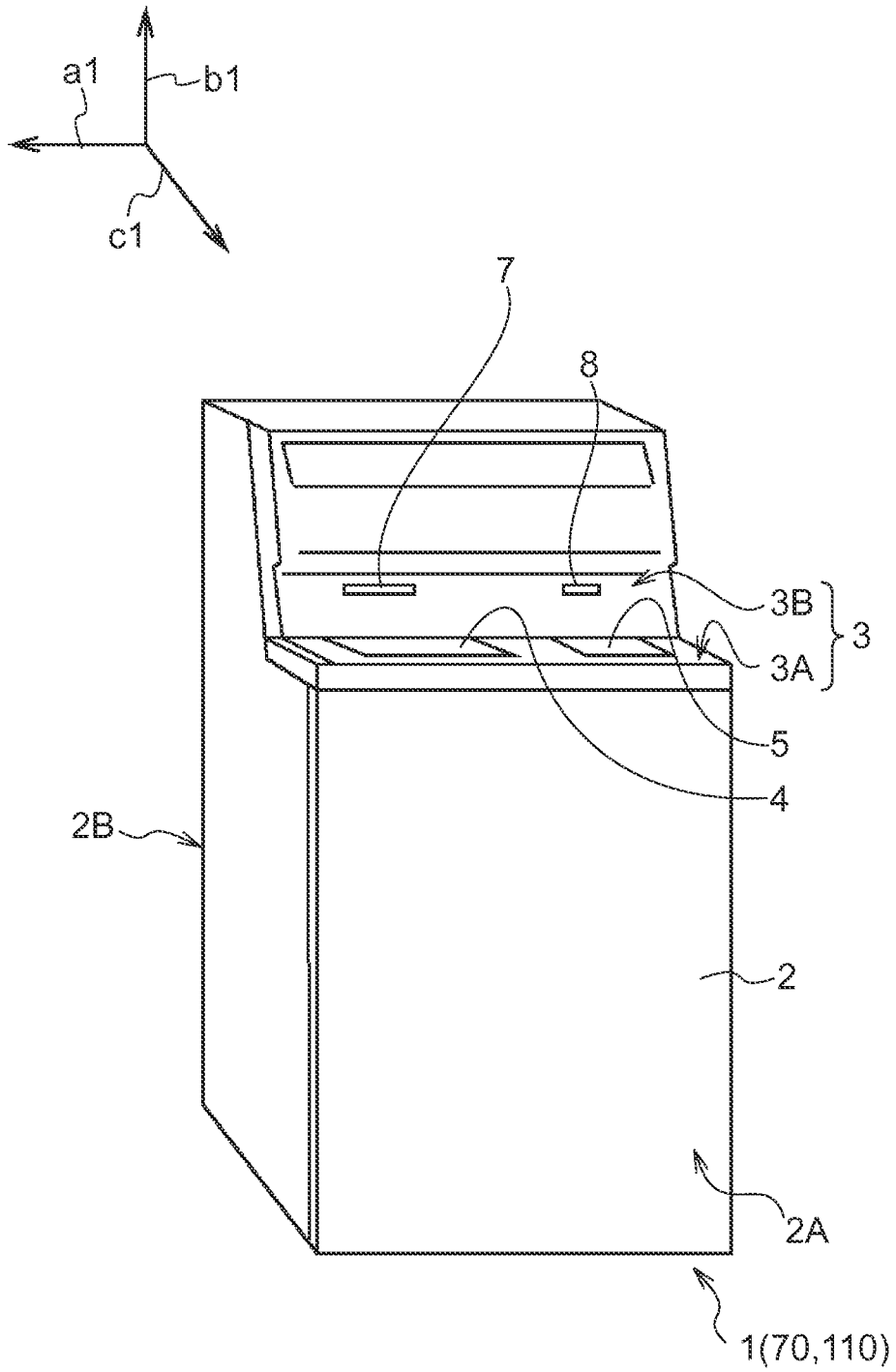
FIG. 1 is a schematic perspective view illustrating an external configuration of a first embodiment of an automatic teller machine according to the present invention.

1. First Embodiment
2. Second Embodiment
3. Third Embodiment
4. Other Embodiments (1) First Embodiment (1-1) External Configuration of Automatic Teller Machine FIG. 1 illustrates an overall external configuration of an automatic teller machine 1 applied with the present invention. The automatic teller machine 1 includes a substantially box shaped casing 2 (also referred to below as the teller machine housing).

Note that in the following explanation, in the drawings the direction of the arrow a1 that points to the left when the automatic teller machine 1 is viewed facing a front face 2A of the teller machine housing 2 is referred to as the teller machine left direction and also simply as left, and the direction opposite to the teller machine left direction is also referred to as the teller machine right direction and also simply as right.

Moreover in the following explanation, in the drawings the direction of the arrow b1 that points upwards when the automatic teller machine 1 is viewed facing the front face 2A of the teller machine housing 2 is referred to as the teller machine up direction and also simply as up, and the direction opposite to the teller machine up direction is referred to as the teller machine down direction and also simply as down.

Moreover in the following explanation, in the drawings the direction of the arrow c1 that points to the front when the automatic teller machine 1 viewed facing the front face 2A of the teller machine housing 2 is referred to as the teller machine front direction and also simply as the front, and the direction opposite to the teller machine front direction is referred to as the teller machine rear direction and also simply as the rear.

A front side upper end portion of the teller machine housing 2 is provided with a front panel 3 formed in a substantially L-shape so as to be recessed further to a rear face 2B side than the front face 2A.

A substantially horizontal upward facing panel 3A of the front panel 3 that faces in the teller machine up direction is provided for example towards the left hand side with a touchscreen 4 that is capable of displaying various operation images and that has a touch operable surface.

Further, the upward facing panel 3A of the front panel 3 is provided for example towards the right hand side with a banknote insertion/removal section 5 for paying in and paying out rectangular banknotes.

On the other hand, a substantially vertical front facing panel 3B of the front panel 3 that faces in the teller machine front direction is provided for example towards the left hand side with a passbook insertion/ejection port 7 for insertion of a passbook during a transaction, and for ejection of the passbook and an account statement.

Further, the front facing panel 3B of the front panel 3 is provided for example towards the right hand side with a card insertion/ejection port 8 for the insertion and ejection during a transaction of various types of card such as a cash card or a credit card.

The thus configured automatic teller machine 1 displays operation images on the touchscreen 4, and switches between operation screens as appropriate according to touch operation of the surface of the touchscreen 4 by a customer.

Accordingly, through the operation images, the automatic teller machine 1 guides the customer through the process of a desired transaction, for example a deposit transaction such as a cash deposit, or a withdrawal transaction such as a cash withdrawal.

The automatic teller machine 1 guides the customer so as to insert a passbook or card into the passbook insertion/ejection port 7 or the card insertion/ejection port 8, or to insert banknotes for a cash deposit into the banknote insertion/removal section 5.

The automatic teller machine 1 further guides the customer so as to remove their passbook or an account statement, or to retrieve their card, that have been ejected from the passbook insertion/ejection port 7 or the card insertion/ejection port 8, or to remove banknotes for a cash withdrawal from the banknote insertion/removal section 5. The automatic teller machine 1 accordingly enables a customer to perform desired transactions such as banknote cash deposits and cash withdrawals.

(1-2) Automatic Teller Machine Internal Configuration

Figure 2:
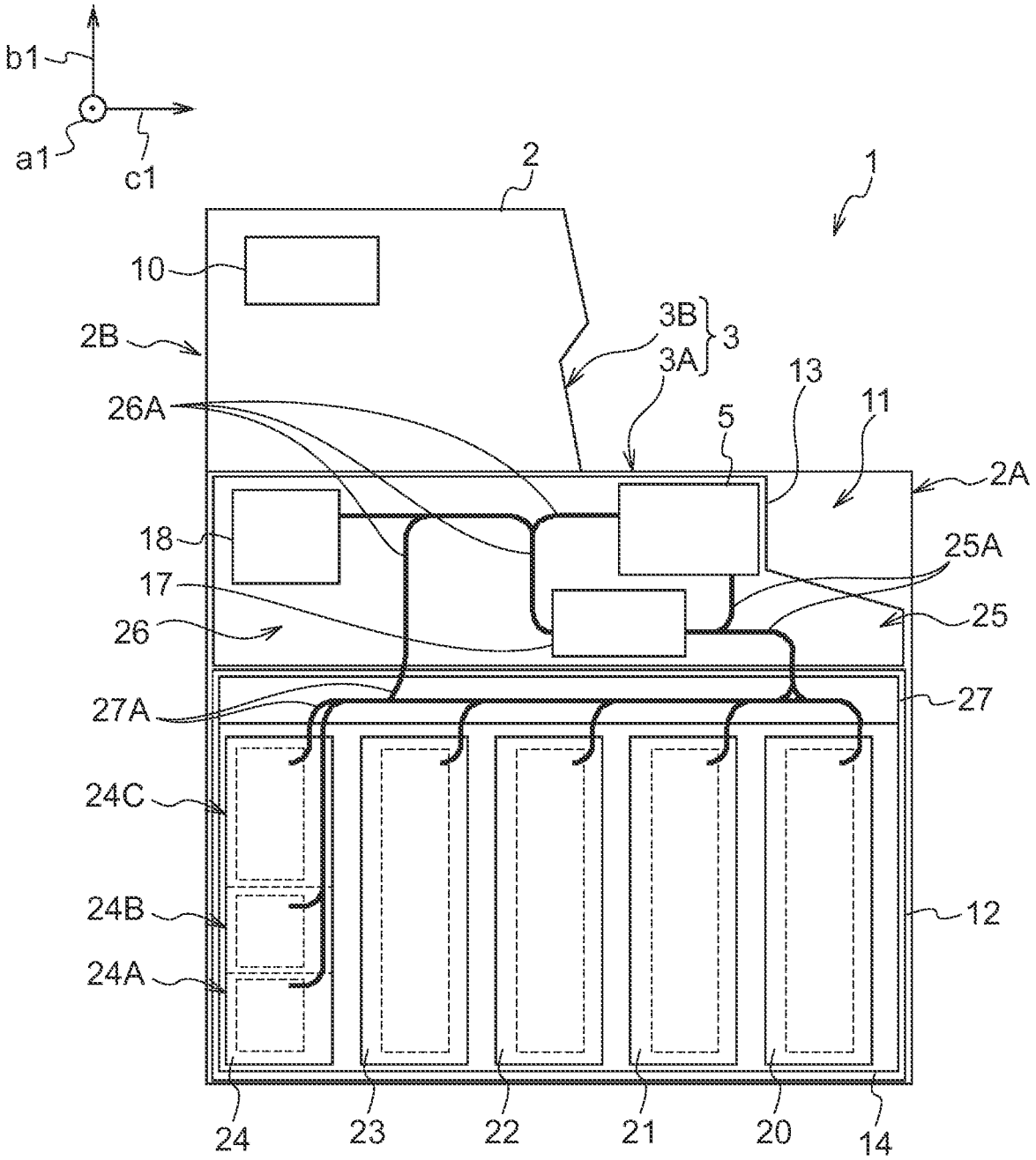
FIG. 2 is a schematic side view illustrating an internal configuration of an automatic teller machine according to the first embodiment.

Next, explanation is given regarding an internal configuration of the automatic teller machine 1. As illustrated in FIG. 2, housed inside the teller machine housing 2 of the automatic teller machine 1 are a control section 10 that performs overall control of the automatic teller machine 1 as a whole, and a banknote processing unit 11 that performs cash deposit processing and cash withdrawal processing of banknotes based on control of the control section 10.

The banknote processing unit 11 includes a substantially box shaped main frame 12. An upper portion unit 13 is mounted on the main frame 12, and a lower portion unit 14 is housed inside the main frame 12.

The banknote insertion/removal section 5 is disposed inside the upper portion unit 13 so as to face towards the upward facing panel 3A. A differentiating section 17 is disposed diagonally below and to the rear of the banknote insertion/removal section 5. A temporary holding section 18 is disposed at the rear side of the banknote insertion/removal section 5 and the differentiating section 17.

Plural (for example 4) banknote storage containers 20 to 23 that store banknotes for cash deposit and banknotes for cash withdrawal by denomination (namely, that each respectively store only a single specific denomination of banknote) are detachably mounted towards the bottom inside the lower portion unit 14 so as to be lined up in sequence from front to rear.

A banknote storage container 24 (also referred to below as the auxiliary storage container) that is used in an auxiliary role in banknote cash deposits and cash withdrawals is detachably mounted inside the lower portion unit 14 to the rear of the banknote storage container 23 that is positioned furthest to the out of the plural banknote storage containers 20 to 23.

Note that the auxiliary storage container 24 is integrally formed with a banknote storage container 24A that stores irregular banknotes such as torn banknotes or folded banknotes, a banknote storage container 24B that stores left behind banknotes that a customer has left behind to remove from the banknote insertion/removal section 5, and a banknote storage container 24C for supplementing or retrieving banknotes to or from the plural banknote storage containers 20 to 23, each of these banknote storage containers being formed integrated together one on top of another in sequence from the bottom.

Note that in the following explanation, irregular banknotes such as torn or folded banknotes are also referred to in particular as rejected banknotes, and the banknote storage container 24A for storing such rejected banknotes is also referred to in particular as the reject container 24A.

Moreover, in the following explanation, banknotes that a customer has left behind to remove from the banknote insertion/removal section 5 are also referred to in particular as left behind banknotes, and the banknote storage container 24B for storing such left behind banknotes is also referred to in particular as the left behind container 24B.

In the following explanation, the banknote storage container 24C for supplementing and retrieving banknotes to and from the plural banknote storage containers 20 to 23 is also referred to in particular as the supplementation/retrieval container 24C.

A conveyance section 25 (also referred to below as the processing unit front side conveyance section) is disposed inside the upper portion unit 13. The processing unit front side conveyance section 25 forms a conveyance path 25A (also referred to below as the front side conveyance path) for conveying banknotes between the banknote insertion/removal section 5 and the differentiating section 17, and for switching between conveyance destinations as appropriate. The front side conveyance path 25A connects together the banknote insertion/removal section 5 and the differentiating section 17.

A conveyance section 26 (also referred to below as the processing unit rear side conveyance section) is also disposed inside the upper portion unit 13. The processing unit rear side conveyance section 26 forms a conveyance path 26A (also referred to below as the rear side conveyance path) for conveying banknotes between the banknote insertion/removal section 5, the differentiating section 17, and the temporary holding section 18, and switching between conveyance destinations as appropriate. The rear side conveyance path 26A connects together the banknote insertion/removal section 5, the differentiating section 17, and the temporary holding section 18.

A conveyance section 27 (also referred to below as the processing unit lower side conveyance section) is disposed inside the lower portion unit 14. The processing unit lower side conveyance section 27 forms a conveyance path 27A (also referred to below as the lower side conveyance path) for conveying banknotes upwards, and switching between conveyance destinations as appropriate. The lower side conveyance path 27A connects together the plural banknote storage containers 20 to 23, the auxiliary storage container 24, the front side conveyance path 25A and the rear side conveyance path 26A.

In the banknote processing unit 11, rectangular shaped banknotes are conveyed for example by the front side conveyance path 25A, the rear side conveyance path 26A and the lower side conveyance path 27A at a conveyance orientation in which one short side is positioned on the left side, the other short side is positioned on the right side (namely with the long direction of the banknote substantially parallel to the teller machine left direction) and with one long side facing in the conveyance direction.

Note that in the following explanation, the long direction of the banknote is also referred to as the banknote length direction and the short direction of the banknote is also referred to as the banknote short direction.

In the banknote processing unit 11, the banknote insertion/removal section 5, the differentiating section 17, the temporary holding section 18, the plural banknote storage containers 20 to 23 and the auxiliary storage container 24 (the reject container 24A, the left behind container 24B and the supplementation/retrieval container 24C) respectively handle banknotes at an orientation positioned in which one short side is positioned on the left side and the other short side is positioned on the right side according to the conveyance orientation (namely, with the banknote length direction substantially parallel to the teller machine left direction).

During actual banknote cash deposit processing, when one or plural banknotes for a cash deposit are inserted to the banknote insertion/removal section 5 by a customer, the control section 10 feeds out the one or plural banknotes one note at a time from the banknote insertion/removal section 5, and conveys the banknotes with the front side conveyance path 25A to the differentiating section 17, and the denomination and state, for example, of the banknotes are differentiated in the differentiating section 17.

As a result, the control section 10 then conveys banknotes, that have been differentiated as regular banknotes and are fed out from the differentiating section 17, through the rear side conveyance path 26A to the temporary holding section 18, where the banknotes are temporarily held, thereby suspends the deposit of the banknote.

The control section 10 conveys banknotes that have been differentiated as irregular, such as torn or folded banknotes and fed out from the differentiating section 17 through the rear side conveyance path 26A to the banknote insertion/removal section 5, as rejected banknotes. The banknotes are thereby rendered returnable for the customer to remove from the banknote insertion/removal section 5.

When all of the cash deposit banknotes input to the banknote insertion/removal section 5 have been differentiated by the differentiating section 17, the control section 10 displays the total value of banknotes that have been differentiated as regular (namely, the cash deposit amount) to the customer through the touchscreen 4.

On receipt as a result of an instruction to make the deposit of banknote from the customer who has confirmed the cash deposit amount through the touchscreen 4, the control section 10 feeds out the temporarily held banknotes from the temporary holding section 18 one note at a time through the rear side conveyance path 26A to the differentiating section 17. In the differentiating section 17, the denomination and state of the banknotes are differentiated once again.

The control section 10 conveys banknotes that have been differentiated as regular and fed out from the differentiating section 17 in sequence, through the front side conveyance path 25A and the lower side conveyance path 27A to the banknote storage containers 20 to 23 according to denomination.

However, the control section 10 conveys banknotes, that have been differentiated as irregular and are fed out from the differentiating section 17 as rejected banknotes, in sequence through the front side conveyance path 25A and the lower side conveyance path 27A to the auxiliary storage container 24, and stores the rejected banknotes in the reject container 24A, such that these notes are not employed in subsequent cash withdrawal processing.

Note that, when this occurs due to the customer leaving without removing the rejected banknotes that have been returned to the banknote insertion/removal section 5, the control section 10 feeds out these rejected banknotes one note at a time from the banknote insertion/removal section 5 as left behind banknotes, and after conveying the banknotes through the front side conveyance path 25A to the differentiating section 17 where they are once again differentiated by for example denomination and state, the rejected banknotes are then conveyed in sequence through the rear side conveyance path 26A and the lower side conveyance path 27A to the auxiliary storage container 24 to be stored in the left behind container 24B.

Thus, the control section 10 is capable of performing banknote cash deposits as a desired customer transaction by performing such banknote cash deposit processing in the banknote processing unit 11.

In banknote cash withdrawal processing, for example, on receipt of a cash withdrawal amount instruction from a customer through the touchscreen 4, the control section 10 feeds out banknotes to the value specified by the customer one note at a time from the banknote storage containers 20 to 23, and conveys the banknotes in sequence through the lower side conveyance path 27A and the front side conveyance path 25A to the differentiating section 17, where the denomination and state of the banknotes is differentiated in the differentiating section 17.

As a result, the control section 10 conveys banknotes, that have been differentiated as regular and are fed out from the differentiating section 17, through the rear side conveyance path 26A to the banknote insertion/removal section 5.

However, in such cases, the control section 10 conveys banknotes from the differentiating section 17 that have been differentiated as irregular and fed out as rejected banknotes, in sequence through the rear side conveyance path 26A and the lower side conveyance path 27A to the auxiliary storage container 24 to be stored in the reject container 24A, such that they are not employed in subsequent cash withdrawal processing.

When the control section 10 has finished conveying the banknotes of the cash withdrawal amount specified for cash withdrawal to the banknote insertion/removal section 5, the banknotes of the cash withdrawal amount specified for cash withdrawal are passed across for the customer to remove from the banknote insertion/removal section 5.

Note that in such cases, when banknotes that the customer has left behind to remove are present in the banknote insertion/removal section 5, the control section 10 feeds out these banknotes one note at a time as left behind banknotes from the banknote insertion/removal section 5 and conveys the banknotes through the front side conveyance path 25A to the differentiating section 17. After the denomination and state have once more been determined, the banknotes are conveyed in sequence through the rear side conveyance path 26A and the lower side conveyance path 27A to the auxiliary storage container 24 and stored in the left behind container 24B.

Thus, the control section 10 is capable of performing banknote cash withdrawals as a transaction desired by a customer by performing such banknote cash withdrawal processing in the banknote processing unit 11.

During banknote supplementation processing, the control section 10 feeds out banknotes one note at a time from the supplementation/retrieval container 24C of the auxiliary storage container 24 and conveys the banknotes in sequence through the lower side conveyance path 27A and the rear side conveyance path 26A to the differentiating section 17. The denomination and state of the banknotes are differentiated in the differentiating section 17.

As a result, the control section 10 conveys banknotes that have been differentiated as regular and fed out from the differentiating section 17 in sequence through the front side conveyance path 25A and the lower side conveyance path 27A to the banknote storage containers 20 to 23 according to denomination and stores the banknotes therein.

However, in such cases, the control section 10 conveys banknotes that have been differentiated as irregular and fed out from the differentiating section 17 in sequence through the front side conveyance path 25A and the lower side conveyance path 27A as rejected banknotes so as to return the banknotes to the auxiliary storage container 24 and store them in the reject container 24A.

The control section 10 is thus capable of supplementing banknotes for use in cash withdrawal processing to the plural banknote storage containers 20 to 23 by performing such banknote supplementation processing in the banknote processing unit 11.

During banknote retrieval processing, the control section 10 feeds out banknotes one note at a time from banknote storage containers 20 to 23 and conveys the banknotes in sequence through the lower side conveyance path 27A and the front side conveyance path 25A to the differentiating section 17. The denomination and state of the banknotes are differentiated in the differentiating section 17.

As a result, the control section 10 conveys banknotes, that have been differentiated as regular banknotes and are fed out from the differentiating section 17, in sequence through the rear side conveyance path 26A and the lower side conveyance path 27A to the auxiliary storage container 24, and stores the banknotes in the supplementation/retrieval container 24C.

However, in such cases, the control section 10 conveys banknotes, that have been differentiated as irregular and are fed out from the differentiating section 17, in sequence, as rejected banknotes, through the rear side conveyance path 26A and the lower side conveyance path 27A to the auxiliary storage container 24, and stores the banknotes in the reject container 24A.

Thus, the control section 10 is capable of retrieving banknotes from the plural banknote storage containers 20 to 23 by performing such banknote retrieval processing in the banknote processing unit 11.

Note that the banknote processing unit 11 is front-rear slidably attached to the teller machine housing 2 through a rail guide and a slide rail, not shown in the drawings.

In the teller machine housing 2, the banknote processing unit 11 is accordingly capable of being pulled out from the teller machine housing 2 towards the front (namely to in front of the front face 2A) and being pushed into the teller machine housing 2 and housed.

Figure 3A:
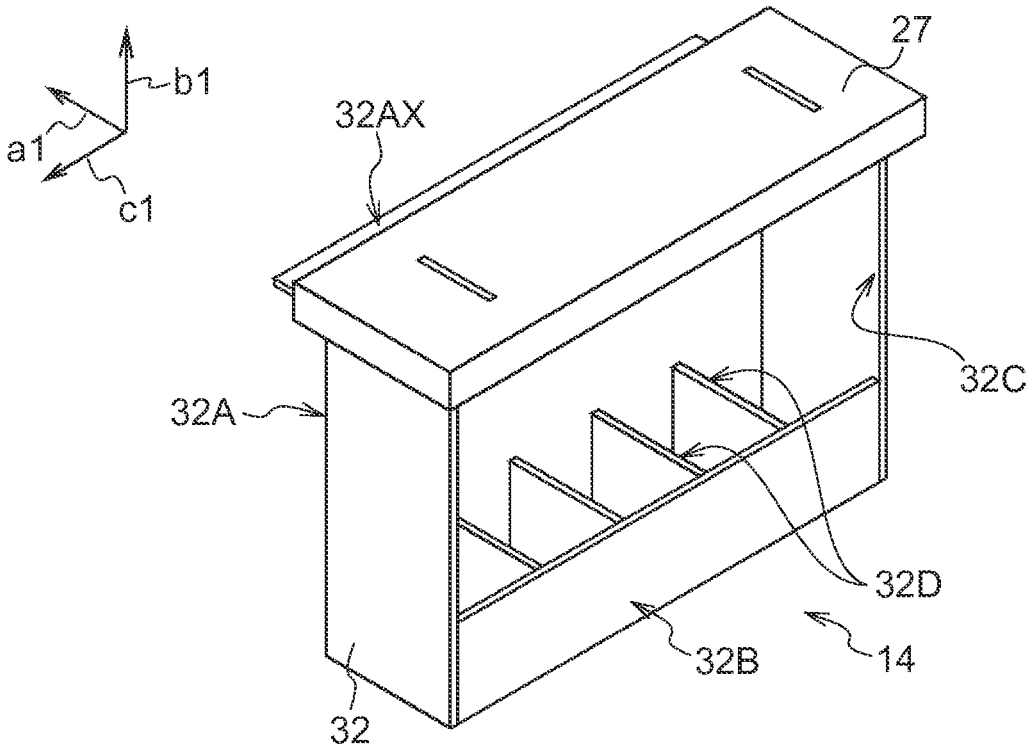
FIG. 3A is a schematic perspective view illustrating a configuration of a lower portion unit.
Figure 3B:
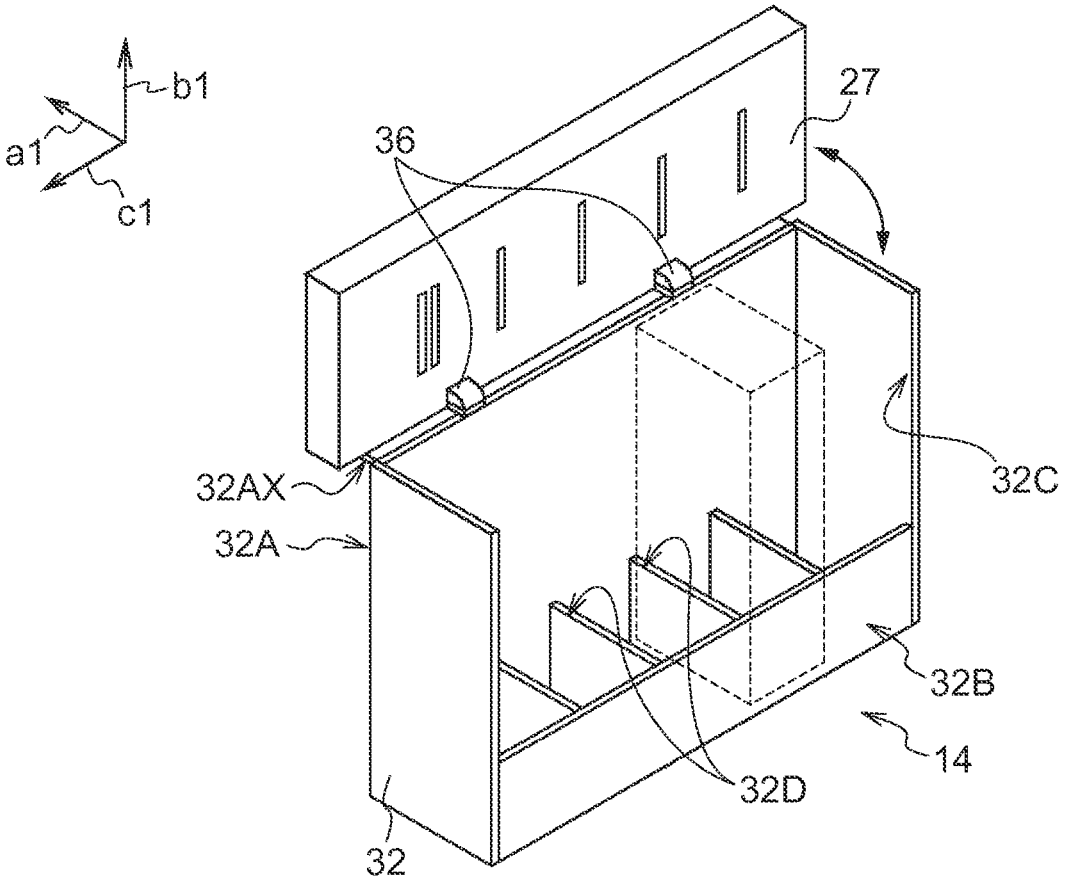
FIG. 3B is a schematic perspective view illustrating a configuration of a lower portion unit.

As illustrated in FIG. 3A and FIG. 3B, the lower portion unit 14 includes a unit housing 32 that is substantially box shaped and long in the front-rear direction.

The unit housing 32 is provided with a front-rear elongated rail placement plate 32AX that projects out in the teller machine left direction at an upper edge of a left side plate 32A (also referred to below as the unit housing left side plate).

The unit housing 32 is formed with a right side plate 32B (also referred to below as the unit housing right side plate) that has a lower height than the height of the unit housing left side plate 32A. An opening portion 32C is formed spanning from an upper edge of the unit housing left side plate 32A to an upper edge of the unit housing right side plate 32B.

Moreover, the unit housing 32 is provided at specific separations with plural upright partitioning plates 32D from front to rear that determine storage container placement positions of the banknote storage containers 20 to 23 and the auxiliary storage container 24.

Using the partitioning plates 32D, the lower portion unit 14 is accordingly able to position and place each of the banknote storage containers 20 to 23 and the auxiliary storage container 24 at plural storage container placement positions inside the unit housing 32, oriented such that doors thereof, described later, face the teller machine rear direction.

In the unit housing 32 the processing unit lower side conveyance section 27 is open-closable attached to the unit housing 32 through 2 front and rear hinge portions 36 that are provided to an upper face of the rail placement plate 32AX (namely, about hinge shafts, that are parallel to the teller machine front direction), such that the processing unit lower side conveyance section 27 can close off and open up an upper end portion of the unit housing 32 at the opening portion 32C.

In the lower portion unit 14, the lower side conveyance path 27A can accordingly be connected or disconnected from the respective banknote storage containers 20 to 23 and the auxiliary storage container 24, according to opening and closing of the processing unit lower side conveyance section 27 with respect to the unit housing 32.

Figure 4:
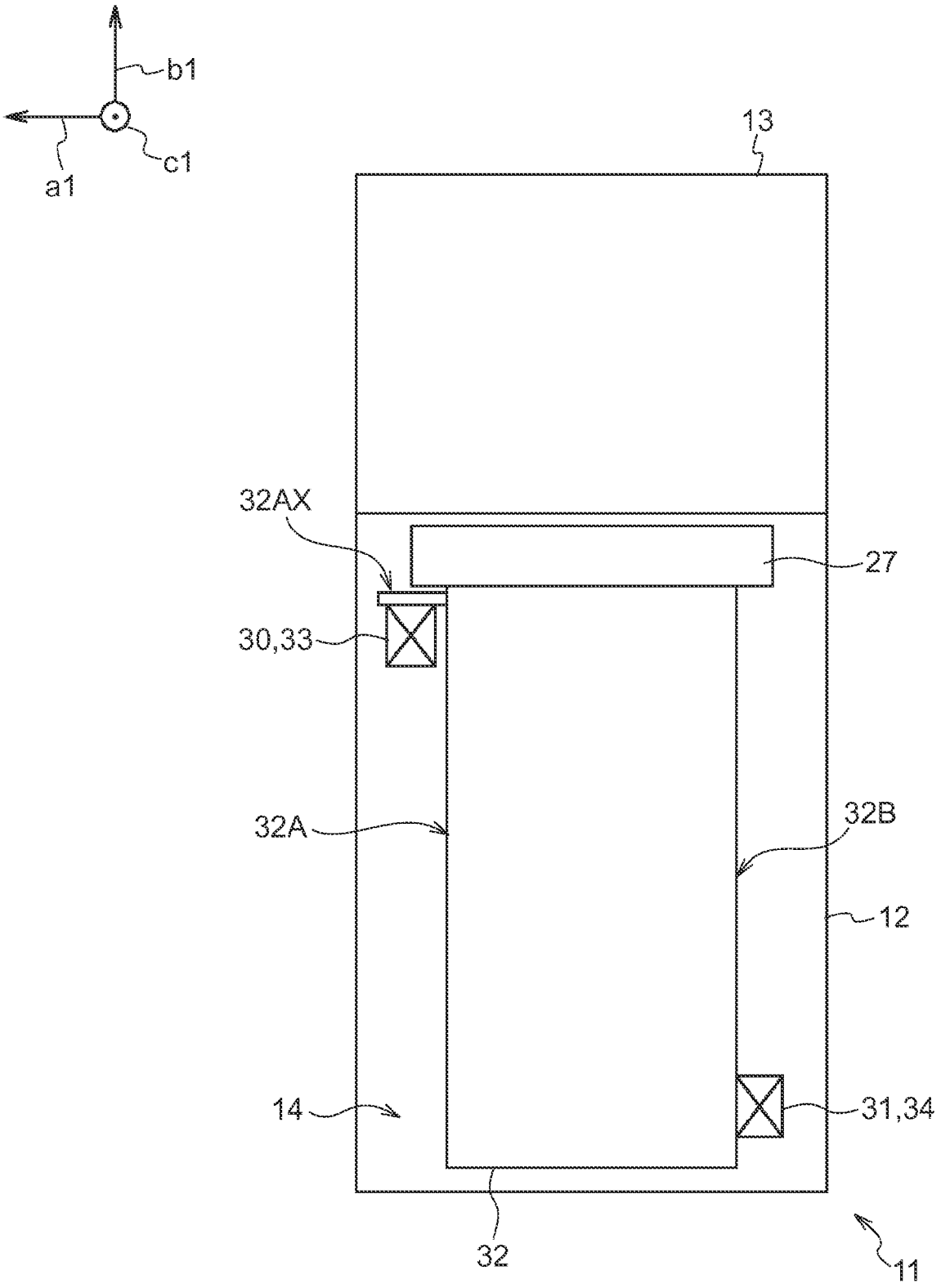
FIG. 4 is a schematic front view to accompany explanation of support of a lower portion unit by a main frame.

As illustrated in FIG. 4, in the main frame 12 of the banknote processing unit 11, a left rail guide 30 is disposed with length direction parallel to the front direction at a specific position towards the top of an inner face of a left side face, and a right rail guide 31 is disposed with length direction parallel to the front direction at a specific position towards the bottom of an outer face of a right side face.

In the lower portion unit 14, a left slide rail 33 is disposed with length direction parallel to the front direction at a lower face of the rail placement plate 32AX of the unit housing 32, and a right slide rail 34 is disposed with length direction parallel to the front direction towards the bottom of an outer face of the unit housing right side plate 32B.

Moreover, in the lower portion unit 14, the left slide rail 33 and the right slide rail 34 are engaged with the left rail guide 30 and the right rail guide 31 of the main frame 12.

Therefore, the main frame 12 supports the lower portion unit 14 through the left rail guide 30 and the right rail guide 31, and the left slide rail 33 and the right slide rail 34 such that the lower portion unit 14 is slidable in the front-rear direction.

Figure 5:
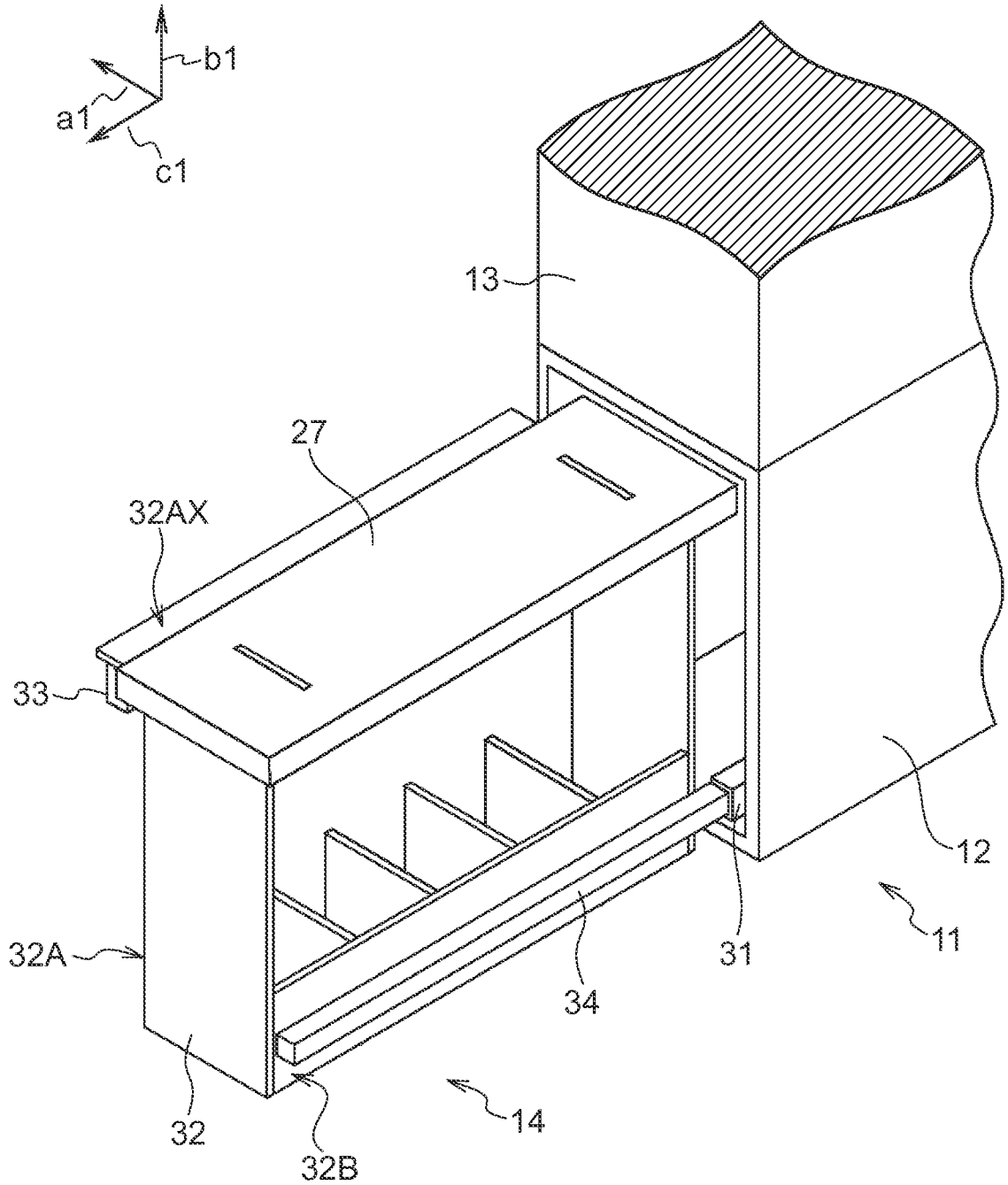
FIG. 5 is a schematic perspective view to accompany explanation of pulling out and housing of a lower portion unit in a banknote processing unit.

Accordingly, as illustrated in FIG. 5, in a state in which the banknote processing unit 11 has been pulled out to the front side from the teller machine housing 2 (or is in a housed state inside the teller machine housing 2), the lower portion unit 14 can be pulled out to the front side from the main frame 12 or can be pushed in to be housed in the main frame 12.

In practice, in the banknote processing unit 11, when the lower portion unit 14 mounted with the banknote storage containers 20 to 23 and the auxiliary storage container 24 (namely with the banknote storage containers 20 to 23 and the auxiliary storage container 24 placed inside the unit housing 32) are pulled out from the main frame 12, and the processing unit lower side conveyance section 27 is opened with respect to the unit housing 32, the banknote storage containers 20 to 23 and the auxiliary storage container 24 are disconnected from the lower side conveyance path 27A.

In the banknote processing unit 11, the banknote storage containers 20 to 23 and the auxiliary storage container 24 inside the unit housing 32 can be removed by being pulled out to the upper side and the right diagonal upper side from the plural storage container placement positions inside the unit housing 32.

Moreover, in the banknote processing unit 11, the banknote storage containers 20 to 23 and the auxiliary storage container 24 that have been thus removed from the lower portion unit 14 can be transported to a designated banknote loading location, and plural banknotes loaded into the banknote storage containers 20 to 23 and the auxiliary storage container 24, and rejected banknotes and left behind banknotes can be removed.

Moreover, in the banknote processing unit 11, in a state in which the banknote storage containers 20 to 23 and the auxiliary storage container 24 have been removed from the lower portion unit 14, the banknote storage containers 20 to 23 and the auxiliary storage container 24, that have been filled with plural banknotes and/or from which rejected banknotes and left behind banknotes have been removed at the banknote loading location, can be housed in the plural storage container placement positions inside the unit housing 32 by inserting the banknote storage containers 20 to 23 and the auxiliary storage container 24 from the upper side or the right diagonal upper side.

In the banknote processing unit 11, when the processing unit lower side conveyance section 27 has been closed with respect to the unit housing 32 of the lower portion unit 14, the lower side conveyance path 27A can be connected to the banknote storage containers 20 to 23 and the auxiliary storage container 24.

Accordingly, in the banknote processing unit 11, the banknote storage containers 20 to 23 and the auxiliary storage container 24 can be mounted to the lower portion unit 14, and in this mounted state the lower portion unit 14 can be housed by pushing into the main frame 12.

Note that, when the lower portion unit 14 is housed in the main frame 12, the lower side conveyance path 27A connects to the front side conveyance path 25A and the rear side conveyance path 26A. Moreover, when the lower portion unit 14 is pulled out from the main frame 12, the lower side conveyance path 27A is disconnected from the front side conveyance path 25A and the rear side conveyance path 26A.

(1-3) Banknote Storage Container Configuration

Next, explanation follows in sequence regarding configuration of the plural banknote storage containers 20 to 23 and the auxiliary storage container 24. However, since the plural banknote storage containers 20 to 23 are each of similar configuration, explanation is given only for configuration of the single banknote storage container 20, with explanation of the other banknote storage containers 21 to 23 omitted.

Figure 6A:
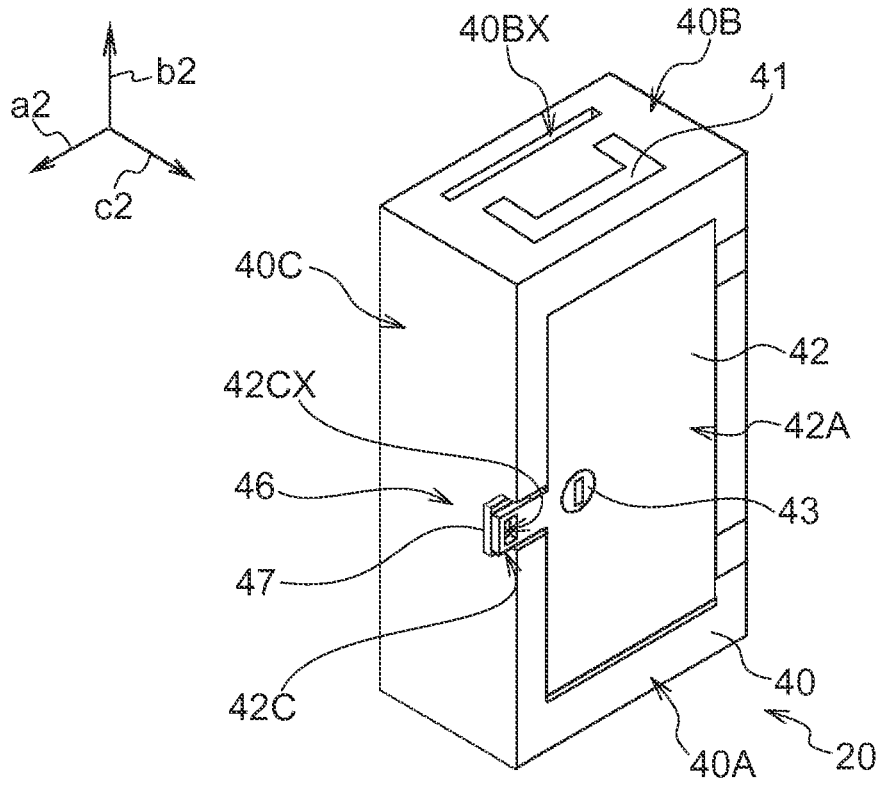
FIG. 6A is a schematic perspective view illustrating a configuration of a banknote storage container according to the first embodiment.
Figure 6B:
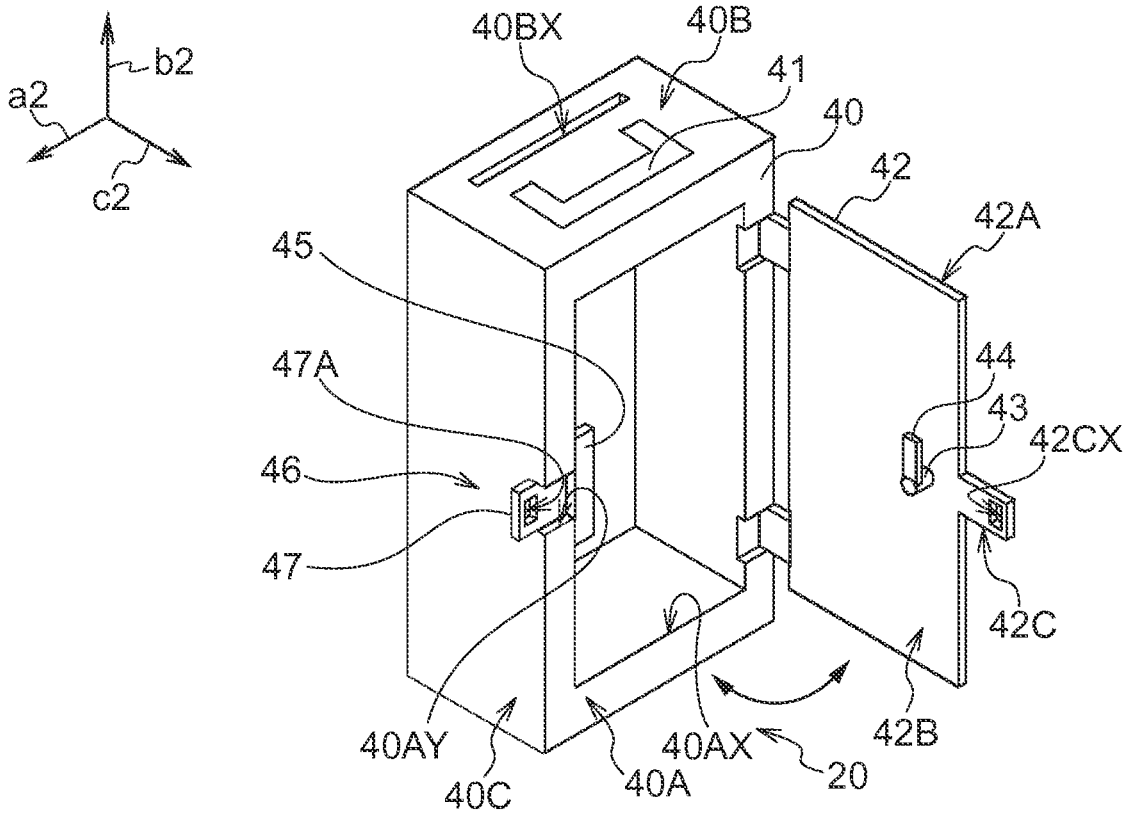
FIG. 6B is a schematic perspective view illustrating a configuration of a banknote storage container according to the first embodiment.

As illustrated in FIG. 6A and FIG. 6B, the banknote storage container 20 includes an outer case 40 formed from metal plates in a substantially rectangular box shape that is long in the up-down direction.

Note that in the following explanation, a front face 40A of the outer case 40 is also referred to as the case front face 40A. In the following explanation, in the drawings the direction of the arrow a2 that points to the left when the banknote storage container 20 is viewed facing the case front face 40A is referred to as the storage container left direction and also simply as left, and the direction opposite to the storage container left direction is also referred to as the storage container right direction and also simply as right.

Moreover in the following explanation, in the drawings the direction of the arrow b2 that points upwards when the banknote storage container 20 is viewed facing the case front face 40A is referred to as the storage container up direction and also simply as up, and the direction opposite to the storage container up direction is also referred to as the storage container down direction and also simply as down.

Moreover in the following explanation, in the drawings the direction of the arrow c2 that points to the front when the banknote storage container 20 is viewed facing the case front face 40A is referred to as the storage container front direction and also simply as the front, and the direction opposite to the storage container front direction is referred to as the storage container rear direction and also simply as the rear.

An upper face 40B of the outer case 40 of the banknote storage container 20 (also referred to below as the case upper face) is formed towards the rear with a slit shaped banknote take-in/feed-out opening 40BX parallel to the storage container left direction.

A central portion of the case upper face 40B of the outer case 40 is further formed with a substantially C-shaped groove portion. A substantially C-shaped handle 41 that can be employed when attaching, detaching or carrying the banknote storage container 20 is attached to the groove portion such that it can be housed therein or pulled up.

A central portion of the case front face 40A of the outer case 40 is further formed with a substantially rectangular shaped opening portion 40AX for loading banknotes inside (or removing banknotes from inside).

A substantially rectangular shaped door 42 formed from a metal plate is open-closable attached (namely, so as to be right-opening in the present example) to the case front face 40A of the outer case 40 through for example a pair of hinge portions, not illustrated in the drawings, provided to a right edge portion, such that an outer face 42A of the door 42 closes off the opening portion 40AX in the same plane as the case front face 40A, or opens up the opening portion 40AX.

A lock 43, such as a cylinder lock that corresponds to a key such as a dimple key (not illustrated in the drawings), is attached at a left end center portion of the door 42, such that one end face of the lock 43 formed with a keyhole is exposed from the door outer face 42A of the door 42. The other end of the lock 43 projects out from a door inner face 42B of the door 42.

Note that, in the following explanation, the outer face 42A of the door 42 is also referred to as the door outer face 42A, and the inner face 42B of the door 42 is also referred to as the door inner face 42B.

At the other end portion of the lock 43, a thin elongated lock lever 44 configured by a metal plate is attached parallel to the door inner face 42B.

Accordingly, when the key is inserted into the keyhole and the lock 43 is rotation operated about the lock 43 axial center in one rotation direction or the other rotation direction opposite to the one rotation direction, the lock lever 44 is rotated in the one rotation direction or the other rotation direction coupled to this rotation operation, with the lock lever 44 remaining parallel to the door inner face 42B.

Moreover, in the outer case 40, a lock plate 45 configured by a metal plate is attached at a back side of a left end portion of the case front face 40A such that a portion of the lock plate 45 projects inside the opening portion 40AX.

Note that, in the following explanation, the portion of the lock plate 45 that projects inside the opening portion 40AX is also referred to as the plate projection portion.

Moreover, in the following explanation, a portion on one face of the plate projection portion of the lock plate 45 facing the storage container front direction is also referred to as the plate projection portion front face, and a portion on the other face of the plate projection portion of the lock plate 45 facing the storage container rear direction is also referred to as the plate projection portion rear face.

Accordingly, in the banknote storage container 20, when the door 42 is closed with respect to the outer case 40, a left end central portion of the door inner face 42B of the door 42 (a portion to the left side of the other end portion of the lock 43) is for example pushed against the plate projection portion front face of the lock plate 45, placing the door outer face 42A in the same plane as the case front face 40A.

In this state of the banknote storage container 20, when the key is inserted into the keyhole of the lock 43 and for example rotation operated in the other rotation direction, the lock lever 44 is rotated in the other rotation direction, and a leading end portion of the lock lever 44 is made to approach the plate projection portion rear face of the lock plate 45.

Namely, in the banknote storage container 20, when the key has been inserted into the keyhole of the lock 43 and for example rotation operated in the other rotation direction, the plate projection portion of the lock plate 45 is interposed between the door 42 and the leading end portion of the lock lever 44.

Moreover, in the banknote storage container 20, when the key is taken out of the keyhole of the lock 43 with the plate projection portion of the lock plate 45, thus interposed between the door 42 and the leading end portion of the lock lever 44, the door 42 can be locked (namely, rendered such that the door 42 cannot be opened) in a closed state with respect to the outer case 40 (namely a fully sealed state of the opening portion 40AX).

Moreover, in the banknote storage container 20, when the key is inserted into the keyhole of the lock 43 in a locked state of the door 42 with respect to the outer case 40, and for example rotation operated in the one rotation direction, the lock lever 44 is rotated in the one rotation direction, and the leading end portion of the lock lever 44 is retracted to the right side from the position facing the plate projection portion rear face of the lock plate 45.

In the banknote storage container 20, locking of the door 42 with respect to the outer case 40 is accordingly released, the door 42 can be opened with respect to the outer case 40 to open up the opening portion 40AX, and plural banknotes can be loaded inside, or banknotes can be removed from the inside.

The thus configured banknote storage container 20 is for example provided with a seal attachment portion 46 to which a seal such as a zip tie is attached, so as to indicate that the door 42 has been closed with respect to the outer case 40, and to lock the closed state of the door 42 with respect to the outer case 40.

In the present example, the seal attachment portion 46 includes a substantially rectangular tab shaped door side attachment plate 42C provided to the door 42. The door side attachment plate 42C is integrally formed to the door 42 at a left side face central portion of the door 42 so as to project out in the facing direction of the left side face (for example in the storage container left direction).

The seal attachment portion 46 moreover includes a substantially rectangular tab shaped case side attachment plate 47 configured by a metal plate provided to the outer case 40.

The outer case 40 is moreover formed with a groove portion 40AY (also referred to below as the case groove portion) as the seal attachment portion 46 at a left edge central portion of the case front face 40A, corresponding to the door side attachment plate 42C.

A base portion of the case side attachment plate 47 is joined to the bottom of the case groove portion 40AY, and a leading end portion of the case side attachment plate 47 projects further to the storage container left direction than a left side face 40C (also referred to below as the case left side face) of the outer case 40.

A depth from the case front face 40A of the outer case 40 to a face of the case side attachment plate 47 inside the case groove portion 40AY (namely a face that faces in the storage container front direction) is selected so as to be the same as the thickness of the door side attachment plate 42C, or slightly deeper than this thickness.

Accordingly, when the door 42 is closed with respect to the outer case 40, the door side attachment plate 42C enters the case groove portion 40AY, and an inner face (namely a portion of the door side attachment plate 42C of the door inner face 42B) is made to contact, or made to approach, a face of the case side attachment plate 47.

Namely, when the door 42 is closed with respect to the outer case 40, due to the door side attachment plate 42C entering the case groove portion 40AY, the door outer face 42A is in the same plane as the case front face 40A, such that locking of the door 42 with the lock 43 described above is not impeded.

The length of the door side attachment plate 42C is selected such that a leading end portion thereof projects out by a specific length in the storage container left direction from the case left side face. A band insertion hole portion 42CX is provided to the leading end portion.

The length of the case side attachment plate 47 is selected so as to be substantially the same as the length of the door side attachment plate 42C. A leading end portion of the case side attachment plate 47 that projects out from the case left side face in the storage container left direction is provided with a band insertion hole portion 47A. The band insertion hole portion 47A is provided such that the band insertion hole portion 47A faces the band insertion hole portion 42CX of the door side attachment plate 42C when the door 42 is closed with respect to the outer case 40.

Accordingly, in the seal attachment portion 46, the case side attachment plate 47 and the door side attachment plate 42C are made to contact or approach each other when the door 42 is closed with respect to the outer case 40, with the band insertion hole portion 47A of the case side attachment plate 47 and the band insertion hole portion 42CX of the door side attachment plate 42C contacting or approaching each other so as to make a single hole portion.

Figure 7A:
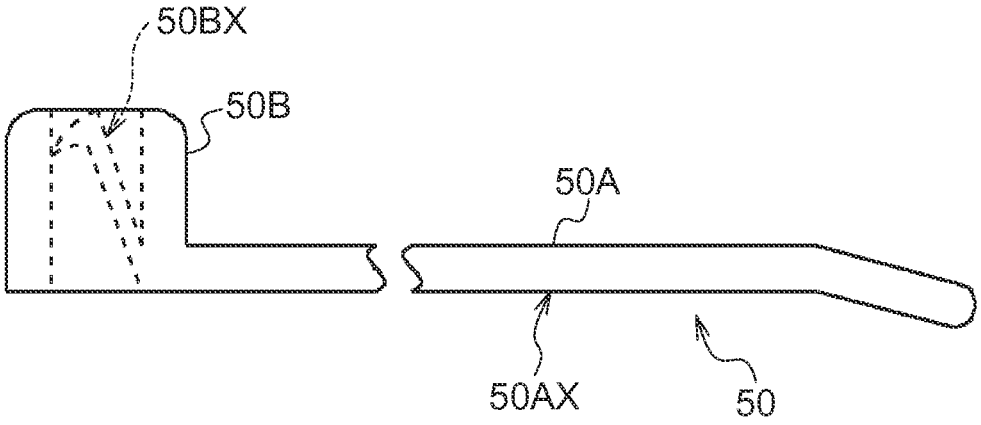
FIG. 7A is a schematic side view illustrating a configuration of a seal.
Figure 7B:
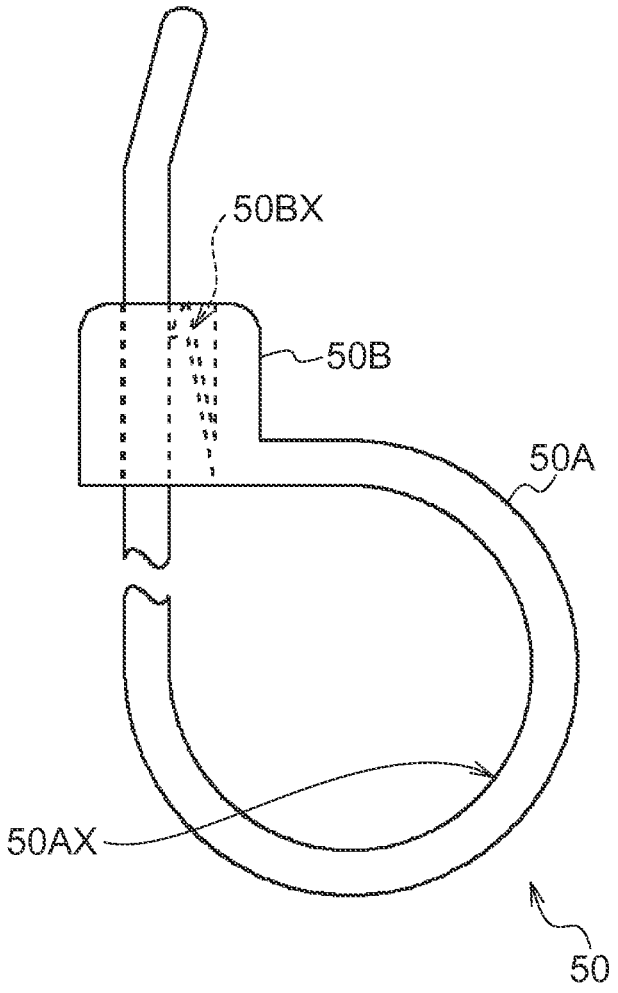
FIG. 7B is a schematic side view illustrating a configuration of a seal.

As illustrated in FIG. 7A and FIG. 7B, a seal 50 is for example provided with a substantially square tube shaped head portion 50B joined to one end of a band portion 50A that is of a certain length, the band portion 50A joined towards one opening portion of a hole of the head portion 50B, with the band portion 50A and the head portion 50B integrally formed from a specific resin material.

Note that, in the following explanation, the side of the head portion 50B of the seal 50 to which one end of the band portion 50A is joined is also referred to as the band join side.

A back face 50AX of the band portion 50A of the seal 50 is moreover formed with plural saw-teeth-like steps at a specific pitch along the band portion 50A length direction.

The head portion 50B of the seal 50 is provided with a substantially rectangular tab shaped claw-formed plate 50BX inside the hole in the head portion 50B. A base portion of the claw-formed plate 50BX is joined to the band join side of the one opening portion of the hole, with a claw formed at the leading end of the claw-formed plate 50BX facing towards the opposite side to the band join side in the vicinity of the other opening portion of the hole.

The band portion 50A of the seal 50 is bent into a ring shape with the back face 50AX on the inside and inserted into the hole of the head portion 50B from the one opening portion side, thereby engaging the claw of the claw-formed plate 50BX with the steps on the back face 50AX of the band portion 50A.

When this occurs, in the seal 50 when the band portion 50A, that has been inserted into the hole of the head portion 50B, is pushed in the insertion direction, the leading end portion of the claw-formed plate 50BX is displaced by the band portion 50A so as to be pushed towards the band join side, thereby widening the separation between an inner wall of the hole and the claw-formed plate 50BX.

Accordingly, the band portion 50A of the seal 50 can be inserted by a desired length into the hole of the head portion 50B.

However, in the seal 50, when the band portion 50A that has been inserted into the hole of the head portion 50B is pulled in the opposite direction to the insertion direction, the steps on the band portion 50A catch on the claw of the claw-formed plate 50BX, and the leading end portion of the claw-formed plate 50BX is displaced towards the opposite side to the band join side, reducing the separation between the inner wall of the hole and the claw-formed plate 50BX.

Accordingly, the band portion 50A of the seal 50 is gripped more firmly between the inner wall of the hole and the claw-formed plate 50BX in the caught state of the claw of the claw-formed plate 50BX on the steps of the band portion 50A, such that the band portion 50A cannot be pulled out from the hole of the head portion 50B.

Figure 8:
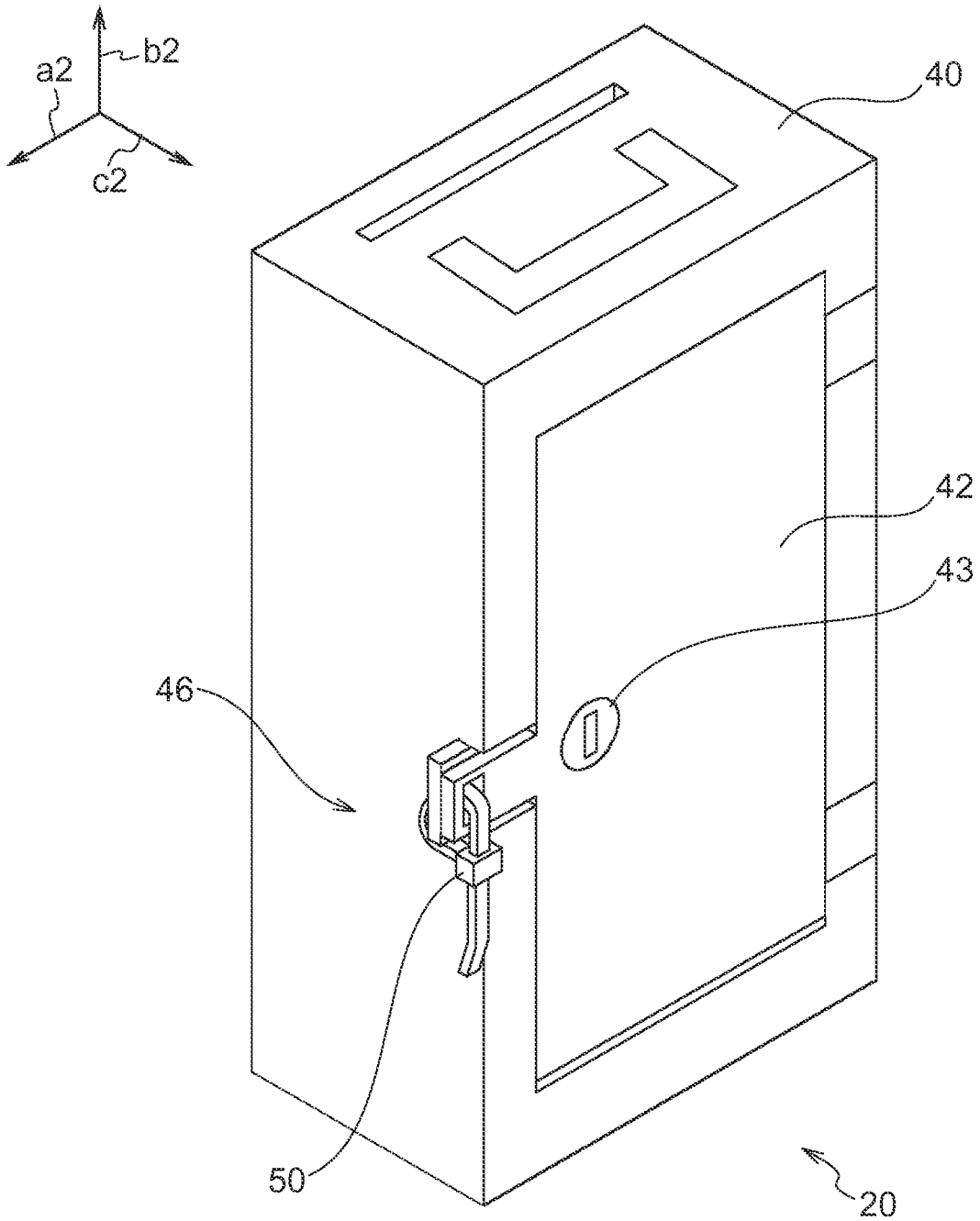
FIG. 8 is a schematic perspective view to accompany explanation of attachment of a seal to a seal attachment portion of a banknote storage container.

Accordingly, as illustrated in FIG. 8, in the closed state of the door 42 with respect to the outer case 40 of the banknote storage container 20, the band portion 50A of the seal 50 is passed in sequence through the band insertion hole portion 47A of the case side attachment plate 47 and the band insertion hole portion 42CX of the door side attachment plate 42C, and then inserted into the hole of the head portion 50B.

Accordingly, in the banknote storage container 20, by attaching the seal 50 to the seal attachment portion 46, the door side attachment plate 42C is tied to the case side attachment plate 47 such that the seal 50 is attached to the seal attachment portion 46 by binding through the band insertion hole portions 47A, 42CX.

Accordingly, in the banknote storage container 20, in the closed state of the door 42 with respect to the outer case 40, the seal 50 is attached to the seal attachment portion 46 is a state visible from the periphery of the outer case 40. The door 42 can accordingly be sealed by the seal 50 with respect to the outer case 40.

Note that the seal 50 is formed such that once the band portion 50A has been inserted into the hole of the head portion 50B, the band portion 50A cannot be pulled out from the hole of the head portion 50B with the level of force that a human is capable of imparting, whether such force is imparted by pulling directly, or imparted by pulling indirectly using a tool.

In the banknote storage container 20, once the seal 50 has been attached to the seal attachment portion 46, the seal 50 cannot be removed from the seal attachment portion 46 without deliberately destroying the band portion 50A by using a tool with a cutting function, such as a pair of nippers or pliers, to sever the band portion 50A.

Note that in the following explanation, a tool with a cutting function that is capable of severing the band portion 50A of the seal 50, such as a pair of nippers or pliers, is also referred to as a cutting tool.

Accordingly, in the banknote storage container 20, when the door 42 is opened for banknote loading at the banknote loading location, a member of staff removes the seal 50 attached to the seal attachment portion 46 from the seal attachment portion 46, by destroying (severing) the band portion 50A with a cutting tool.

Moreover, in the banknote storage container 20, the lock of the door 42 with respect to the outer case 40 is released by the member of staff inserting the key into the keyhole and rotation operating the lock 43, the door 42 is opened, and plural banknotes are loaded inside the outer case 40.

Then in the banknote storage container 20, the member of staff closes the door 42 and locks the door 42 in a closed state with respect to the outer case 40 by rotation operating the key that is inserted into the keyhole of the lock 43, and attaches the seal 50 to the seal attachment portion 46, thereby sealing the door 42 with respect to the outer case 40 using the seal 50.

Accordingly, each time the banknote storage container 20 is loaded with banknotes at the banknote loading location, the member of staff destroys the seal 50 in order to open the door 42, and after closing the door 42 the member of staff reattaches a seal 50.

Since the seal 50 is visible from the periphery of the outer case 40 whilst the seal 50 is attached to the seal attachment portion 46 of the banknote storage container 20, it may be ascertained at a glance that the door 42 is closed with respect to the outer case 40.

Accordingly, as long as the seal 50 has not been destroyed prior to being destroyed by a member of staff at the appropriate time during banknote loading of the banknote storage container 20 at the banknote loading location, the member of staff may determine that the door 42 has not been opened with respect to the outer case 40.

However, if the seal 50 has already been destroyed, prior to the appropriate time for a member of staff to destroy the seal 50 during banknote loading of the banknote storage container 20 at the banknote loading location, the member of staff may determine that there is a possibility of the door 42 having been improperly opened with respect to the outer case 40.

It is accordingly possible for a member of staff to easily confirm whether or not there is a possibility of the door 42 having been improperly opened, depending on whether or not the seal 50 has already been destroyed, prior to being destroyed by the member of staff at the appropriate time during banknote loading of the banknote storage container 20 at the banknote loading location.

Note that once the seal 50 has been attached in this manner to the seal attachment portion 46, the seal 50 may not be removed from the seal attachment portion 46 without being destroyed using a cutting tool.

Accordingly, when the seal 50 has been attached to the seal attachment portion 46 in the closed state of the door 42 with respect to the outer case 40, the seal 50 may lock the closed state of the door 42 with respect to the outer case 40.

Namely, with the banknote storage container 20, since there are a number of cutting tools capable of cutting the band portion 50A of the seal 50 amongst the various types of tools in general use, the door 42 may be locked by the seal 50 more easily than when locking and releasing the lock of the door 42 with the lock 43 using a specific individual key.

However, in the banknote storage container 20, a metal reinforcement plate is attached to the door inner face 42B of the door 42, so as to be provided to the door inner face 42B as a whole and an end portion (in the present example, a portion spanning from an upper face to a lower face of the left end portion of the door inner face 42B) on the side where the lock 43 is provided, at least to the portions where the other end portion of the lock 43 is positioned and over the movable range of the lock lever 44 or greater.

The banknote storage container 20 also has the lock plate 45 of a thickness selected so as not to be deformed easily, and has the lock plate 45 strongly attached to the outer case 40 using comparatively large diameter metal bolts or the like such that the lock plate 45 is not easily detached.

Namely, similarly to ordinary banknote storage containers, the banknote storage container 20 has the outer case 40 and the door 42 formed comparatively more robustly in the vicinity of the lock lever 44.

In the banknote storage container 20, the seal attachment portion 46 is provided at the portions of the outer case 40 and the door 42 that are formed comparatively more robustly, namely in the vicinity of the lock lever 44.

As described above the seal 50 is also formed such that the band portion 50A may not be pulled out from the hole of the head portion 50B with the level of force that a human is capable of imparting.

With the banknote storage container 20, even though it might be said that locking of the door 42 with the seal 50 is easier than with the lock 43, robust locking of the door 42 with the seal 50 may be maintained as long as the seal 50 is not cut.

For example, with the banknote storage container 20, even if the lock of the door 42 by the lock 43 was to be improperly released by for example lock picking, the locking of the door 42 by the seal 50 can be maintained unless the seal 50 is cut, even an attempt is made to force open the door 42 by for example inserting the leading end of a crowbar into a gap between the outer case 40 and the door 42.

Figure 9:
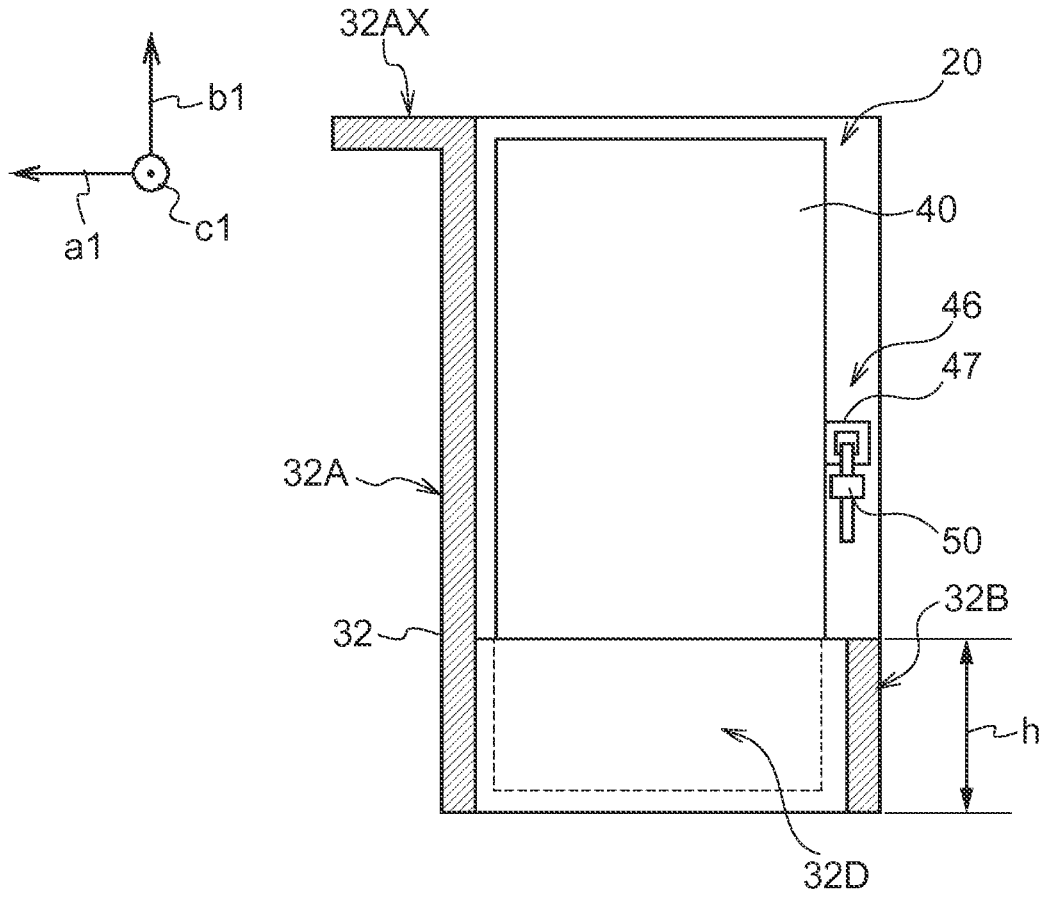
FIG. 9 is a schematic front view illustrating a relationship between the height of a unit housing right side plate of a unit housing and an attachment position of a seal with respect to a banknote storage container.

Note that, as illustrated in FIG. 9, in this embodiment, the lower portion unit 14 is for example configured such that the banknote storage container 20 is installed to the unit housing 32 such that the door 42 is housed facing towards the rear (similar applies to the banknote storage containers 21 to 23 and the auxiliary storage container 24).

Thus when the banknote storage container 20 (and the other banknote storage containers 21 to 23) are housed in the unit housing 32, the seal attachment portion 46 and the seal 50 that is attached thereto are positioned at the unit housing right side plate 32B side.

Thus, in the lower portion unit 14, in the unit housing 32 the height of the unit housing right side plate 32B (the height illustrated by h in the drawing) is selected so as to be lower than the height position of the seal attachment portion 46 of the banknote storage container 20 (namely a height from the bottom face of the outer case 40 to the seal attachment portion 46).

Thus, in the lower portion unit 14, when the banknote storage container 20 (and the other banknote storage containers 21 to 23) is housed in the unit housing 32, the seal attachment portion 46 and the seal 50 attached thereto are positioned to the upper side of the upper edge of the unit housing right side plate 32B, so as not to impede housing of the banknote storage container 20 (and the other banknote storage containers 21 to 23).

Explanation next follows regarding configuration of the auxiliary storage container 24. Note that the configuration of the auxiliary storage container 24 is explained employing the directions defined in the explanation of the configuration of the banknote storage container 20 (namely the storage container left direction, storage container front direction and the like), with reference to FIGS. 6A and 6B.

Figure 10:
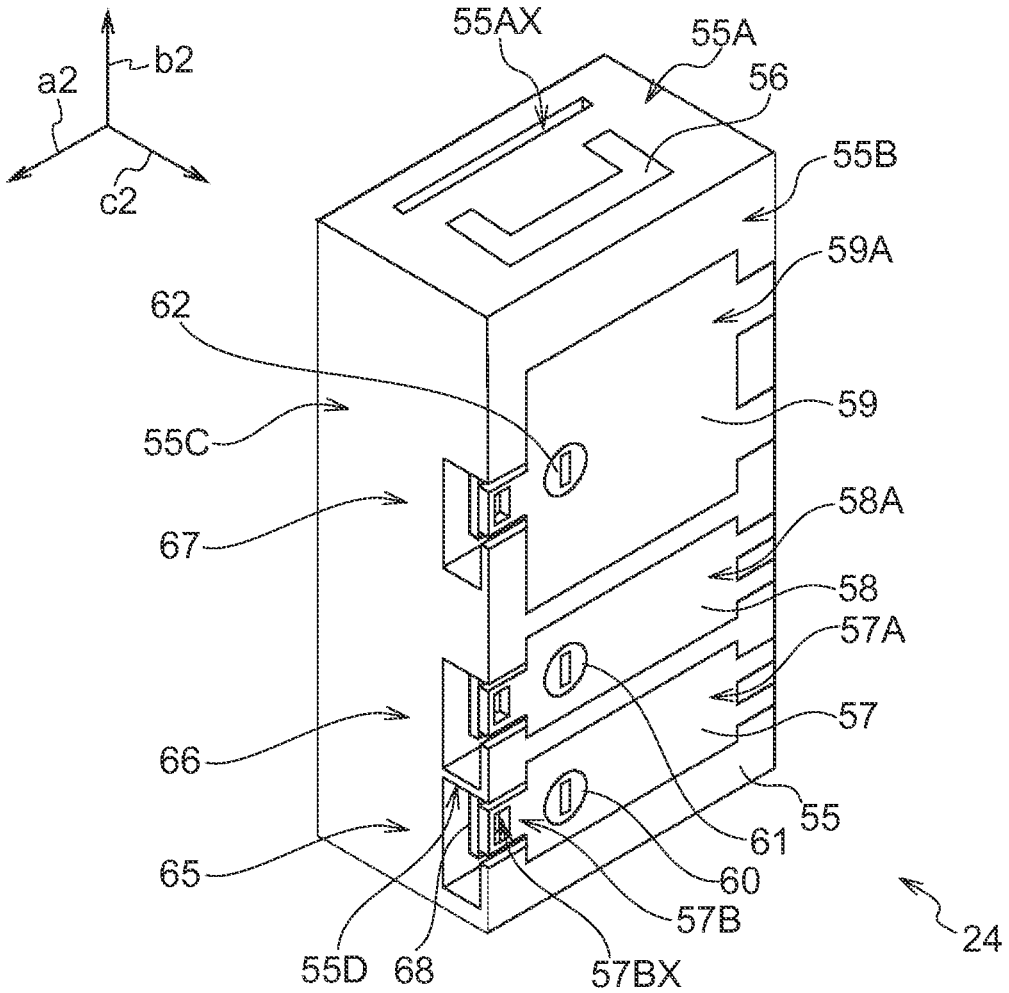
FIG. 10 is a schematic perspective view illustrating a configuration of an auxiliary storage container according to the first embodiment.

As illustrated in FIG. 10, the auxiliary storage container 24 has an external case 55 formed from metal plates in a substantially rectangular box shape that is long in the up-down direction, with a height equivalent to that of the outer case 40 of the banknote storage container 20 described above.

A case upper face 55A of the outer case 55 of the auxiliary storage container 24 is, similarly to the banknote storage container 20 described above, formed with a slit shaped banknote take-in/feed-out opening 55AX, and a substantially C-shaped handle 56 is attached so as to be housed inside or pulled from a substantially C-shaped groove portion.

The case front face 55B of the outer case 55 is for example further formed with a substantially rectangular shaped opening portion for individual removing rejected banknotes from inside, aligned with the portion corresponding to the reject container 24A at the lower end portion.

A substantially rectangular shaped door 57 formed from a metal plate is open-closable attached (namely, so as to be right-opening in this case) to the case front face 55B of the outer case 55 through a pair of hinge portions, not illustrated in the drawings, provided to a right edge portion aligned with the portion corresponding to the reject container 24A, such that a door outer face 57A of the door 57 closes off the opening portion in the same plane as the case front face 55B, or opens up the opening portion.

A substantially rectangular shaped opening portion for individually removing left behind banknotes from inside is also formed for example to the case front face 55B of the outer case 55, aligned with the portion corresponding to the left behind container 24B at a central portion.

A substantially rectangular shaped door 58 formed from a metal plate is open-closable attached (namely, so as to be right-opening in this case) to the case front face 55B of the outer case 55 through a pair of hinge portions, not illustrated in the drawings, provided to a right edge portion aligned with the portion corresponding to the left behind container 24B, such that a door outer face 58A of the door 58 closes off the opening portion in the same plane as the case front face 55B, or opens up the opening portion.

A substantially rectangular shaped opening portion for loading individual banknotes inside or for individually removing banknotes from inside is also formed, for example, to the case front face 55B of the outer case 55, aligned with the portion corresponding to the supplementation/retrieval container 24C at the upper end portion.

A substantially rectangular shaped door 59 formed from a metal plate is open-closable attached (namely, so as to be right-opening in this case) to the case front face 55B of the outer case 55 through a pair of hinge portions, not illustrated in the drawings, provided to a right edge portion aligned with the portion corresponding to the supplementation/retrieval container 24C, such that a door outer face 59A of the door 59 closes off the opening portion in the same plane as the case front face 55B, or opens up the opening portion.

Locks 60 to 62, that are, for example cylinder, locks that correspond to a key such as a dimple key (not illustrated in the drawings), are attached to left end center portions of the doors 57 to 59 such that one end portions formed with keyholes are exposed from the door outer faces 57A to 59A. The respective other end portions of the locks 60 to 62 project from the door inner faces.

In the auxiliary storage container 24, structural portions related to opening and closing and locking and releasing locking of the individual doors 57 to 59 with respect to the outer case 55 have a similar configuration to that of the banknote storage container 20 described above.

Explanation is accordingly omitted regarding the structural portions of the auxiliary storage container 24 related to opening and closing and locking, and to releasing locking of the individual doors 57 to 59 with respect to the outer case 55.

In the auxiliary storage container 24, seal attachment portions 65 to 67 are respectively provided aligned with the doors 57 to 59 to portions corresponding to the reject container 24A, the left behind container 24B and the supplementation/retrieval container 24C.

Explanation follows regarding the seal attachment portions 65 to 67 provided to the auxiliary storage container 24. Note that the 3 seal attachment portions 65 to 67 provided to portions corresponding to the reject container 24A, the left behind container 24B and the supplementation/retrieval container 24C of the auxiliary storage container 24 are of similar configuration to each other.

Explanation accordingly follows regarding only the configuration of 1 of these, the seal attachment portion 65, and explanation regarding the other 2 seal attachment portions 66, 67 is omitted.

The seal attachment portion 65 includes a substantially rectangular tab shaped door side attachment plate 57B provided to the door 57. The door side attachment plate 57B is integrally formed to the door 57 at a left side face central portion of the door 57 so as to project out in the facing direction of the left side face (for example in the storage container left direction).

The seal attachment portion 65 moreover includes a substantially rectangular tab shaped case side attachment plate 68 configured by a metal plate provided to the outer case 55.

The outer case 55 is moreover formed with a substantially L-shaped seal housing groove portion 55D of a specific depth spanning from a left edge lower portion of the case front face 55B to a front edge lower portion of a case left side face 55C, corresponding to the door side attachment plate 57B, as the seal attachment portion 65.

A base portion of the case side attachment plate 68 is joined to the bottom of the seal housing groove portion 55D further to the rear side than the case front face 55B by a distance equivalent to a thickness of a door side attachment plate 57B, or a distance slightly longer than this thickness, with one face of the case side attachment plate 68 facing towards the storage container front direction.

Accordingly, when the door 57 is closed with respect to the outer case 55, the door side attachment plate 57B enters the seal housing groove portion 55D, such that a portion of the door side attachment plate 57B on the door inner face is made to contact, or made to approach, a face of the case side attachment plate 68.

Namely, when the door 57 is closed with respect to the outer case 55, due to the door side attachment plate 57B entering the seal housing groove portion 55D, the door outer face 57A is in the same plane as the case front face 55B, such that locking of the door 57 with the lock 60 is not impeded.

The length of the door side attachment plate 57B is for example selected such that a leading end thereof is in the same plane as the case left side face 55C (namely such that the leading end does not project out further to the storage container left direction than the case left side face 55C), and a band insertion hole portion 57BX is provided to the leading end portion.

The length of the case side attachment plate 68 is for example selected so as to be substantially the same as the length of the door side attachment plate 57B so that the leading end is in the same plane as the case left side face 55C (namely so that the leading end does not project out further than the case left side face 55C towards the storage container left direction).

A leading end portion of the case side attachment plate 68 is provided with a band insertion hole portion. The band insertion hole portion is provided such that when the door 57 is closed with respect to the outer case 55, the band insertion hole portion faces the band insertion hole portion 57BX of the door side attachment plate 57B.

Accordingly, in the seal attachment portion 65, when the door 57 is closed with respect to the outer case 55, the case side attachment plate 68 and the door side attachment plate 57B are made to contact or approach each other, with the band insertion hole portion of the case side attachment plate 68 and the band insertion hole portion 57BX of the door side attachment plate 57B contacting or approaching each other so as to make a single hole portion.

The width of the door side attachment plate 57B and the case side attachment plate 68 are selected so as to be substantially the same as each other. Moreover, the width of a portion on the case front face 55B side of the seal housing groove portion 55D is selected so as to be wider than the widths of both the door side attachment plate 57B and the case side attachment plate 68.

Thus, when the door 57 is closed with respect to the outer case 55, the seal attachment portion 65 is formed so as to have a wider gap (referred to below as the band gap) between, the lower edges of the case side attachment plate 68 and the door side attachment plate 57B and the portion of the seal housing groove portion 55D on the case front face 55B side, than the thickness of the band portion 50A of the seal 50.

Figure 11A:
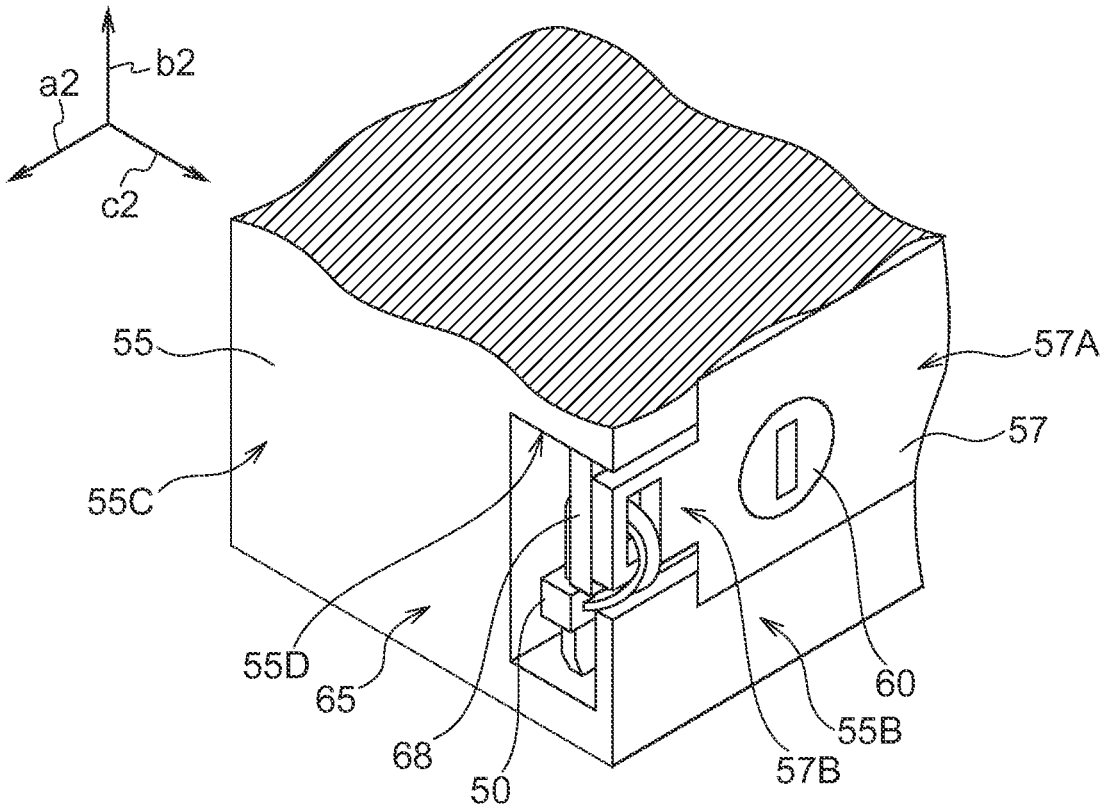
FIG. 11A is a schematic perspective view to accompany explanation of attachment of a seal to a seal attachment portion of an auxiliary storage container.
Figure 11B:
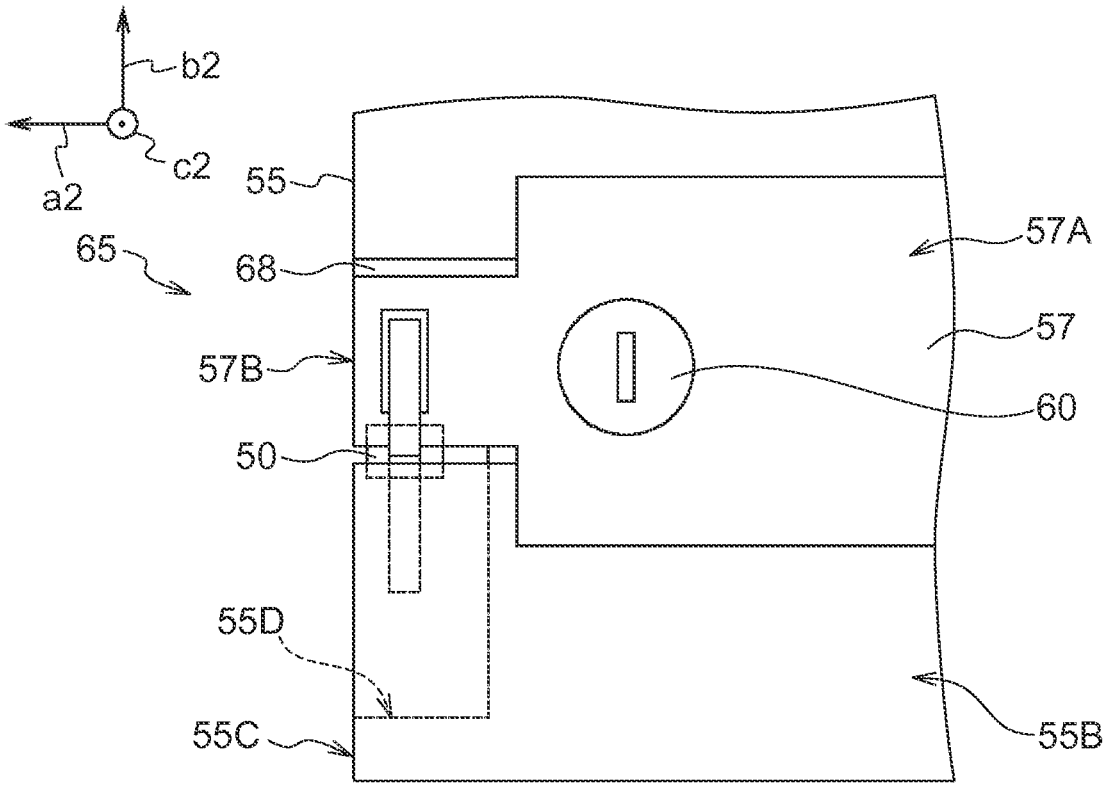
FIG. 11B is a schematic front face view to accompany explanation of attachment of a seal to a seal attachment portion of an auxiliary storage container.

Accordingly, as illustrated in FIG. 11A and FIG. 11B, in the closed state of the door 57 with respect to the outer case 55 of the auxiliary storage container 24, the band portion 50A of the seal 50 is passed in sequence through the band insertion hole portion 57BX of the door side attachment plate 57B and the band insertion hole portion of the case side attachment plate 68, and is then inserted into the hole of the head portion 50B.

Accordingly, in the auxiliary storage container 24, the door side attachment plate 57B is attached to the case side attachment plate 68 by the seal 50 at the seal attachment portion 65 by tying the seal 50 to the seal attachment portion 65 through the band insertion hole portion 57BX.

Accordingly, in the auxiliary storage container 24, in the closed state of the door 57 with respect to the outer case 55, the seal 50 is attached to the seal attachment portion 65 in a state visible from the periphery of the outer case 55. The door 57 can accordingly be sealed with respect to the outer case 55 by the seal 50.

Note that in the auxiliary storage container 24, during such operation for example the base portion of the band portion 50A of the seal 50 can be pushed into the band gap formed at the seal housing groove portion 55D, and the head portion 50B can be pushed to the rear side of the case side attachment plate 68 inside the seal housing groove portion 55D.

Namely the auxiliary storage container 24 enables a configuration to be achieved in which nearly all of the portions of the seal 50 attached to the seal attachment portion 65 are housed in the seal housing groove portion 55D of the seal attachment portion 65, such that they do not project out towards the storage container left direction of the case left side face 55C.

Figure 12:
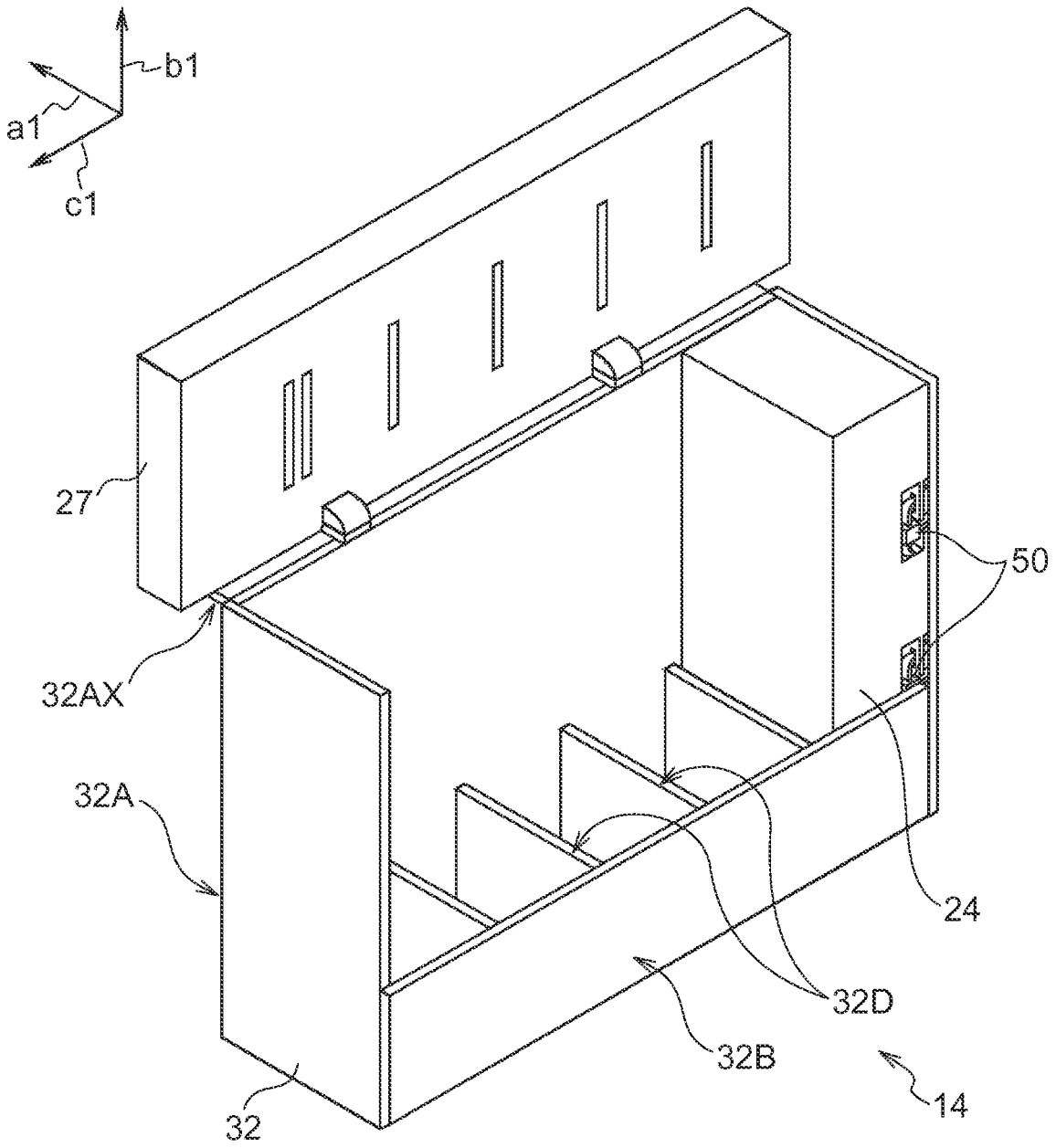
FIG. 12 is a schematic perspective view to accompany explanation of a seal when an auxiliary storage container is housed in a unit housing.

Accordingly, as illustrated in FIG. 12, during installation of the auxiliary storage container 24 to the lower portion unit 14, the auxiliary storage container 24 can be housed in the unit housing 32 without the seals 50 attached to the individual seal attachment portions 65 to 67 (and in particular the seals 50 attached to the seal attachment portions 65 and 66 on the lower side) catching on the unit housing right side plate 32B.

In the auxiliary storage container 24, when the door 57 is opened for removing rejected banknotes at the banknote loading location, a member of staff removes the seal 50 attached to the seal attachment portion 65 from the seal attachment portion 65, by destroying (severing) the band portion 50A with a cutting tool.

Moreover, in the auxiliary storage container 24, the lock of the door 57 with respect to the outer case 55 is released by a member of staff rotation operating a key that is inserted into the keyhole of the lock 60, the door 57 is opened, and all rejected banknotes are removed from inside the outer case 55.

Then in the auxiliary storage container 24, the member of staff closes the door 57 and locks the door 57 in a closed state with respect to the outer case 55 by rotation operating the key that is inserted into the keyhole of the lock 60, and attaches another seal 50 to the seal attachment portion 65, thereby sealing the door 57 with respect to the outer case 55 using the seal 50.

In the auxiliary storage container 24, when the door 58 is opened for removing left behind banknotes at the banknote loading location, a member of staff removes the seal 50 attached to the seal attachment portion 66 from the seal attachment portion 66, by destroying (severing) the band portion 50A with a cutting tool.

Moreover, in the auxiliary storage container 24, the lock of the door 58 with respect to the outer case 55 is released by the member of staff rotation operating a key that is inserted into the keyhole of the lock 61, the door 58 is opened, and all left behind banknotes are removed from inside the outer case 55.

Then in the auxiliary storage container 24, the member of staff closes the door 58 and locks the door 58 in a closed state with respect to the outer case 55 by rotation operating the key that is inserted into the keyhole of the lock 61, and attaches the seal 50 to the seal attachment portion 66, thereby sealing the door 58 with respect to the outer case 55 using the seal 50.

In the auxiliary storage container 24, when the door 59 is opened for banknote loading at the banknote loading location, a member of staff removes the seal 50 attached to the seal attachment portion 67 from the seal attachment portion 67, by destroying (severing) the band portion 50A with a cutting tool.

Moreover, in the auxiliary storage container 24, the lock of the door 59 with respect to the outer case 55 is released by the member of staff inserting the key into the keyhole and rotation operating the lock 62, the door 59 is opened, and plural supplementary banknotes are loaded inside the outer case 55.

Then in the auxiliary storage container 24, the member of staff closes the door 59 and locks the door 59 in a closed state with respect to the outer case 55 by rotation operating the key that is inserted into the keyhole of the lock 62, and attaches the seal 50 to the seal attachment portion 67, thereby sealing the door 59 with respect to the outer case 55 using the seal 50.

Accordingly, each time the auxiliary storage container 24 has rejected banknotes or left behind banknotes removed or is loaded with supplementary banknotes at the banknote loading location, the member of staff destroys the seals 50 in order to open the doors 57 to 59, and after closing the door 57 to 59 the member of staff re-attaches other seals 50.

Thus, in the auxiliary storage container 24, similarly to in the banknote storage container 20 described above, it is possible for a member of staff to easily confirm whether or not there is a possibility of the doors 57 to 59 having been improperly opened, depending on whether or not the seals 50 have already been destroyed, prior to being destroyed by the member of staff at the appropriate time during removing rejected banknotes or left behind banknotes from or loading supplementary banknotes at the banknote loading location.

Note that also in the auxiliary storage container 24, once the seals 50 have been respectively attached to the seal attachment portions 65 to 67, similarly to in the banknote storage container 20 described above, locking of the doors 57 to 59 with respect to the outer case 55 can be performed by the seals 50.

(1-4) Operation and Advantageous Effects of the First Embodiment

In the configuration described above, in the automatic teller machine 1, the locks 43, 60 to 62 for locking, or releasing locking of the doors 42, 57 to 59 in the closed state are provided to the banknote storage containers 20 to 23 and the auxiliary storage container 24 with the outer cases 40, 55 to which the openable and closable doors 42, 57 to 59 are provided.

In the automatic teller machine 1 the banknote storage containers 20 to 23 and the auxiliary storage container 24 are provided with the seals 50 that can be destroyed for removal and indicate that the doors 42, 57 to 59 have been closed, and the seal attachment portions 46, 65 to 67 to which the seals 50 are attached to lock the doors 42, 57 to 59 in the closed state.

In the automatic teller machine 1, when doors are closed after a member of staff has opened the doors 42, 57 to 59 when loading banknotes into, or removing banknotes from, the banknote storage containers 20 to 23 and the auxiliary storage container 24, the doors 42, 57 to 59 are locked by the locks 43, 60 to 62 and the seals 50 are attached to the seal attachment portions 46, 65 to 67.

Consequently, with the automatic teller machine 1, for the banknote storage containers 20 to 23 and the auxiliary storage container 24, it is accordingly possible for a member of staff to confirm individually for each of the doors 42, 57 to 59 whether or not there is a possibility of any of the doors 42, 57 to 59 having been improperly opened, depending on whether or not the seals 50 of each of the doors 42, 47 to 59 have already been destroyed, prior to being legitimately destroyed by the member of staff.

Moreover, in the automatic teller machine 1, even were there to be improper release of the locking of the doors 42, 57 to 59 using the locks 43, 60 to 62, for example during mounting or demounting the banknote storage containers 20 to 23 and the auxiliary storage container 24 to the lower portion unit 14 or during transport, the locking of the doors 42, 57 to 59 by the seals 50 is maintained as long as the seals 50 are not improperly destroyed.

According to the above configuration, in the automatic teller machine 1, the locks 43, 60 to 62 for locking or releasing locking of the closed state of the doors 42, 57 to 59 are provided to the banknote storage containers 20 to 23 and the auxiliary storage container 24 with the outer cases 40, 55 provided with the openable and closable doors 42, 57 to 59, and the seal attachment portions 46, 65 to 67 are also provided for attachment of the seals 50 that can be destroyed for removal, that indicate that the doors 42, 57 to 59 have been closed, and that lock the doors 42, 57 to 59 in the closed state.

Hence in the automatic teller machine 1, it is possible for a member of staff to easily confirm for the banknote storage containers 20 to 23 and the auxiliary storage container 24 whether or not there is a possibility that the doors 42, 57 to 59 have been improperly opened by whether or not the seals 50 have been destroyed prior to legitimate destruction by the member of staff. It is also possible to maintain locking of the doors 42, 57 to 59 with the seals 50 even were there to be improper release of the locking of the doors 42, 57 to 59 using the locks 43, 60 to 62, for example during mounting or demounting the banknote storage containers 20 to 23 and the auxiliary storage container 24 or during transport, as long as the seals 50 are not improperly destroyed.

Accordingly, the automatic teller machine 1 may make a significant improvement in the security of the banknote storage containers 20 to 23 and the auxiliary storage container 24 compared to previously by using the seal 50.

Moreover, in the automatic teller machine 1 the seal attachment portions 46, 65 to 67 are provided in the vicinity of the lock lever 44 in the banknote storage containers 20 to 23 and the auxiliary storage container 24.

In the banknote storage containers 20 to 23 and the auxiliary storage container 24 of the automatic teller machine 1, robust locking of the doors 42, 57 to 59 with the seals 50 may accordingly be maintained even supposing the locking of the doors 42, 57 to 59 in the banknote storage containers 20 to 23 and the auxiliary storage container 24 by the locks 43, 60 to 62 were to be improperly released.

Moreover, in the automatic teller machine 1, the seal housing groove portion 55D is formed to the outer case 55 as the seal attachment portions 65 to 67 in the auxiliary storage container 24, such that each of the seals 50 attached to the seal attachment portions 65 to 67 is inserted into the seal housing groove portion 55D.

Hence, in the automatic teller machine 1, the seals 50 may be prevented from getting in the way for example during mounting or demounting the auxiliary storage container 24 to the lower portion unit 14 or during transporting.

(2) Second Embodiment (2-1) Automatic Teller Machine External Configuration

Explanation next follows regarding an automatic teller machine according to a second embodiment. The automatic teller machine of the second embodiment has a similar external configuration to that of the automatic teller machine 1 according to the first embodiment (FIG. 1). Reference should accordingly be made to FIG. 1 regarding the external configuration of the automatic teller machine according to the second embodiment, and further explanation is omitted.

(2-2) Automatic Teller Machine Internal Configuration

Figure 13:
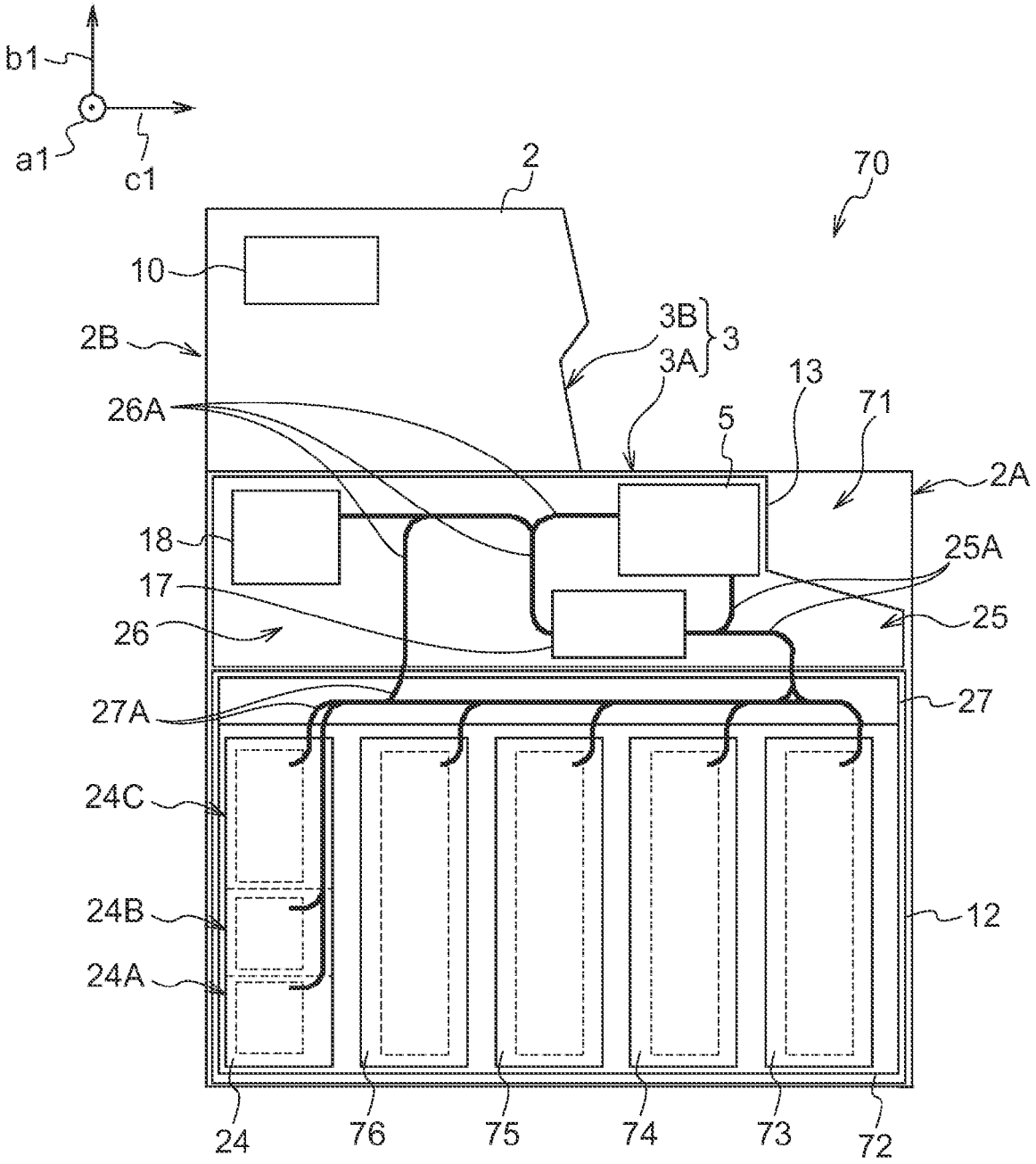
FIG. 13 is a schematic side view illustrating an internal configuration of an automatic teller machine according to a second embodiment.

Explanation next follows regarding the internal configuration of an automatic teller machine according to the second embodiment. As illustrated in FIG. 13, that has corresponding portions to FIG. 2 appended with the same reference numerals, an automatic teller machine 70 is configured similarly to the automatic teller machine 1 of the first embodiment as described above, except in terms of the configuration of a lower portion unit 72 of a banknote processing unit 71, and the configuration of plural banknote storage containers 73 to 76 that are detachably mounted to the lower portion unit 72.

Figure 14A:
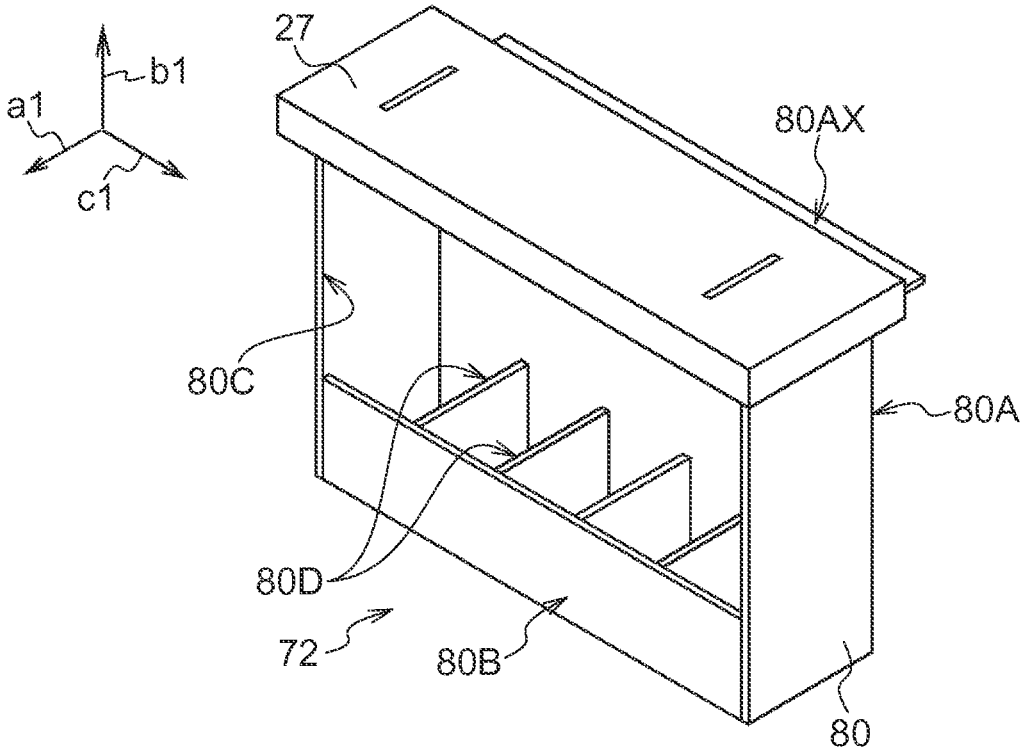
FIG. 14A is a schematic perspective view illustrating a configuration of a lower portion unit.
Figure 14B:
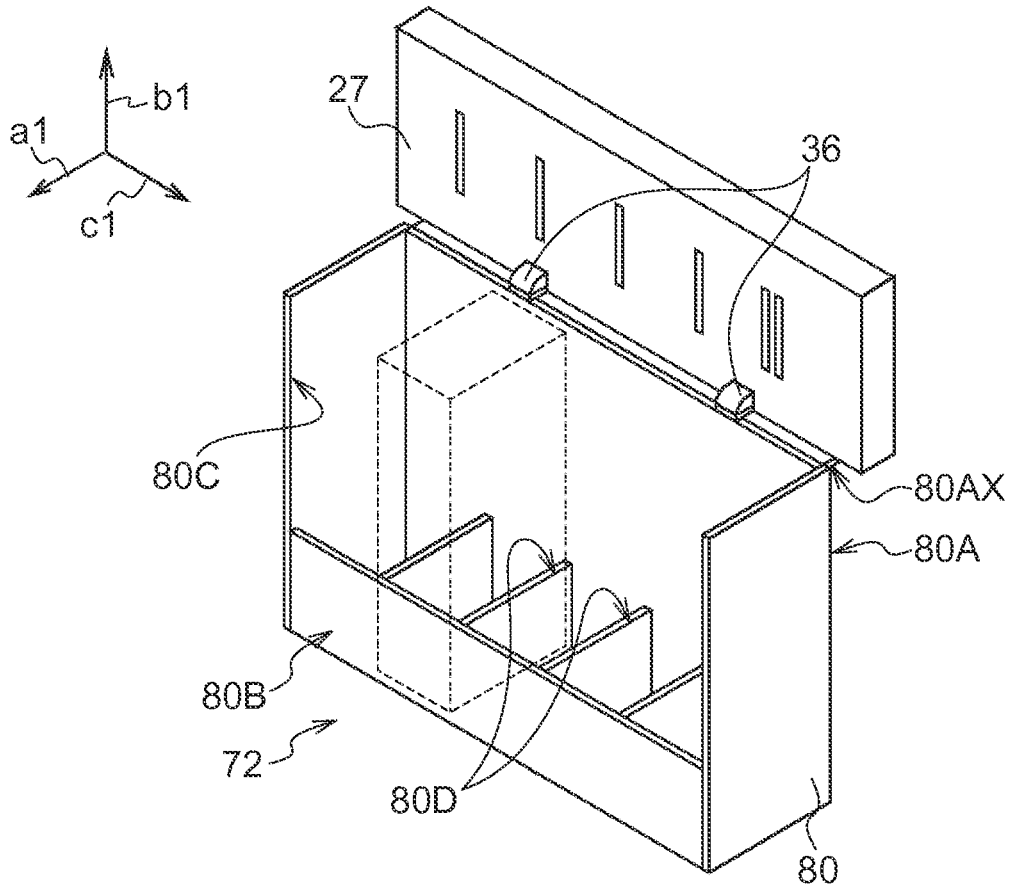
FIG. 14B is a schematic perspective view illustrating a configuration of a lower portion unit.

In the present example, as illustrated in FIG. 14A and FIG. 14B, in which the same reference numerals are appended to portions corresponding to FIG. 3A and FIG. 3B, the lower portion unit 72 includes a substantially box shaped unit housing 80 that is long in the front-rear direction.

The unit housing 80 is configured such that an upper end of a unit housing right side plate 80A is provided with a front-rear elongated rail placement plate 80AX that projects out in the teller machine right direction at an upper edge.

The unit housing 80 is formed with a unit housing left side plate 80B that has a lower height than the height of the unit housing right side plate 80A. An opening portion 80C is formed spanning from an upper edge of the unit housing right side plate 80A to an upper edge of the unit housing left side plate 80B.

Moreover, a bottom face of the unit housing 80 is provided at specific separations with plural upright partitioning plates 80D from front to rear that determine storage container placement positions of the banknote storage containers 73 to 76 and the auxiliary storage container 24.

Accordingly, using the plural partitioning plates 80D, the lower portion unit 72 is able to position and place each of the banknote storage containers 73 to 76 and the auxiliary storage container 24 at the plural storage container placement positions inside the unit housing 80, oriented such that the doors 57 to 59 face the teller machine rear direction.

In the unit housing 80 the processing unit lower side conveyance section 27 is open-closable attached to the unit housing 80 such that the processing unit lower side conveyance section 27 can close off and open up an upper end portion of the unit housing 80 at the opening portion 80C through 2 front and rear hinge portions 36 that are provided to an upper face of the rail placement plate 80AX (namely, about the hinge shafts, that are parallel to the front direction).

Accordingly, in the lower portion unit 72, the lower side conveyance path 27A can be connected or disconnected from the respective banknote storage containers 73 to 76 and the auxiliary storage container 24 according to opening and closing of the processing unit lower side conveyance section 27 with respect to the unit housing 80.

Figure 15:
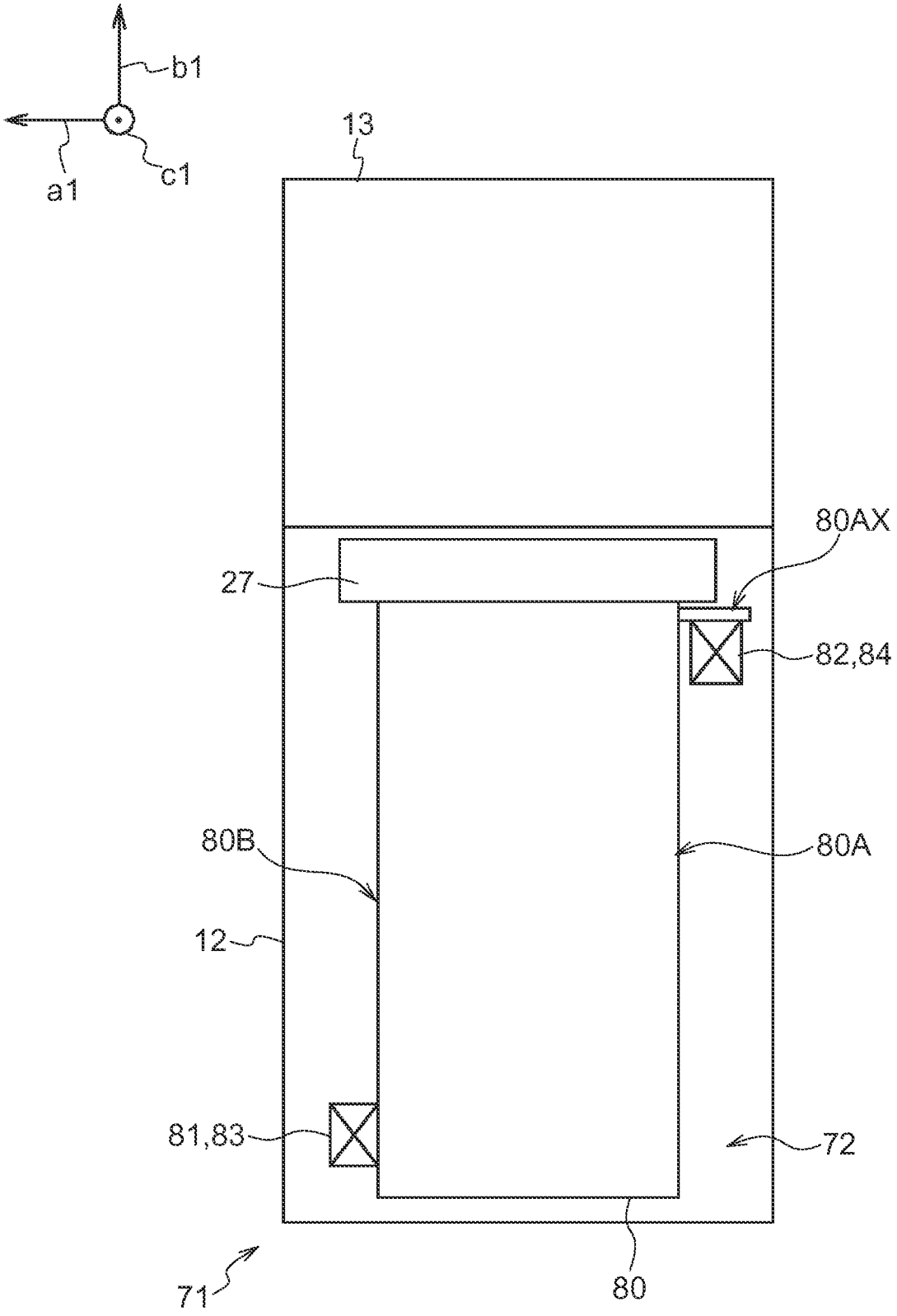
FIG. 15 is a schematic front face view to accompany explanation of support of a lower portion unit by a main frame.

As illustrated FIG. 15, in which the same reference numerals are appended to portions corresponding to FIG. 4, in the main frame 12 of the banknote processing unit 71 a left rail guide 81 is disposed with length direction parallel to the front direction at a specific position towards the bottom of an inner face of a left side face, and a right rail guide 82 is disposed with length direction parallel to the front direction at a specific position towards the top of an inner face of a right side face.

In the unit housing 80 of the lower portion unit 72, a left slide rail 83 is disposed with length direction parallel to the front direction towards the bottom of an outer face of the unit housing left side face 80B, and a right slide rail 84 is disposed with length direction parallel to the front direction at a lower face of the rail placement plate 80AX.

Moreover in the lower portion unit 72, the left slide rail 83 and the right slide rail 84 are engaged with the left rail guide 81 and the right rail guide 82 of the main frame 12.

The main frame 12 therefore supports the lower portion unit 72 through the left rail guide 81 and the right rail guide 82, and the left slide rail 83 and the right slide rail 84 such that the lower portion unit 72 is slidable in the front-rear direction.

Figure 16:
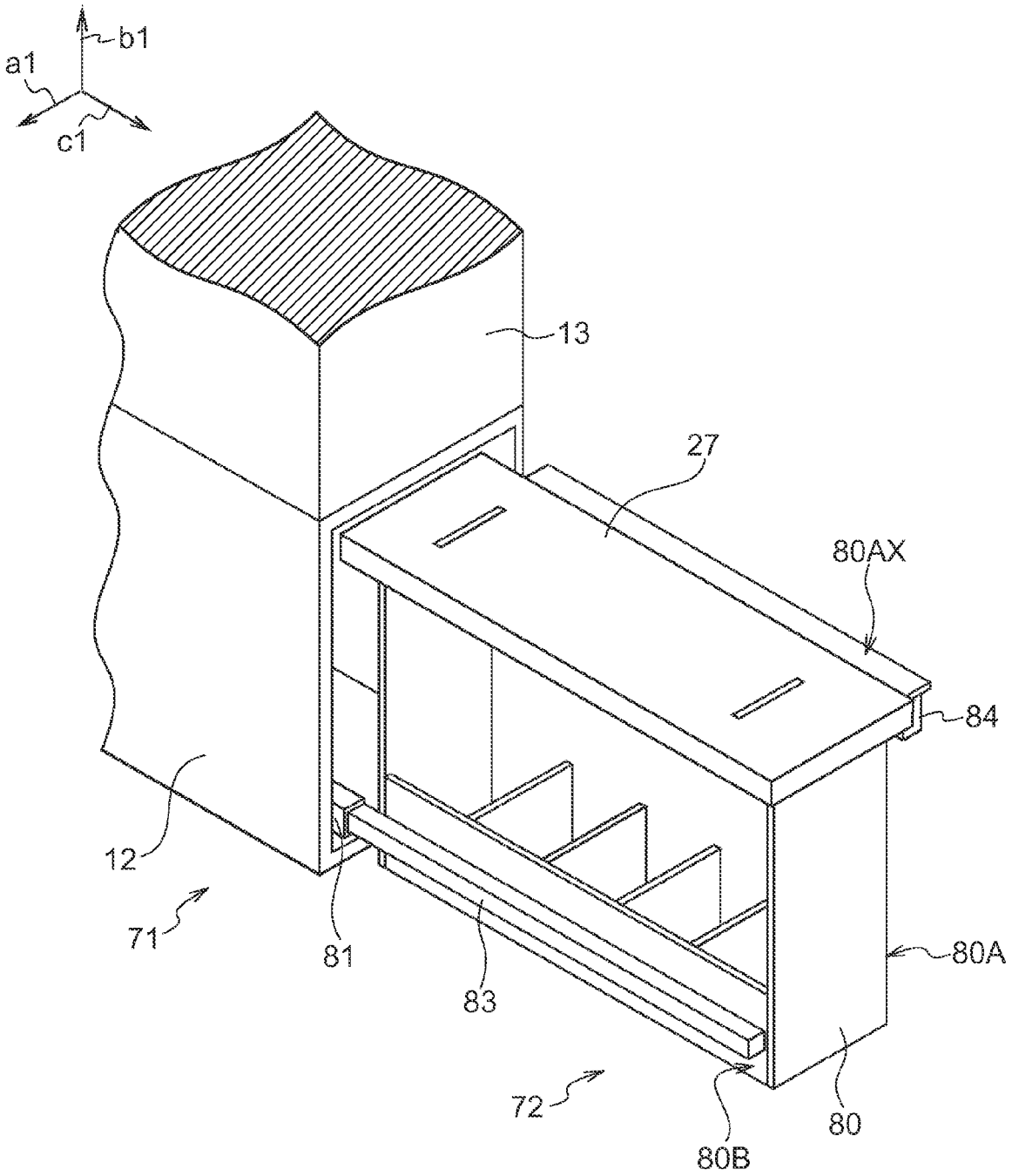
FIG. 16 is a schematic perspective view to accompany explanation of pulling out and housing of a lower portion unit in a banknote processing unit.

Accordingly, as illustrated in FIG. 16, in which the same reference numerals are appended to portions corresponding to FIG. 5, in a state in which the banknote processing unit 71 has been pulled out to the front side from the teller machine housing 2 (or is in a housed state inside the teller machine housing 2), the lower portion unit 72 can be pulled out to the front side from the main frame 12 and pushed in to be housed in the main frame 12.

Similarly to the lower portion unit 14 of the banknote processing unit 11 according to the first embodiment described above, when the lower portion unit 72 is pulled out from the main frame 12 in a state mounted with the banknote storage containers 73 to 76 and the auxiliary storage container 24 (namely with the banknote storage containers 73 to 76 and the auxiliary storage container 24 placed inside the unit housing 80), and the processing unit lower side conveyance section 27 is opened with respect to the unit housing 80, the banknote storage containers 73 to 76 and the auxiliary storage container 24 are disconnected from the lower side conveyance path 27A.

Accordingly, in the banknote processing unit 71, the banknote storage containers 73 to 76 and the auxiliary storage container 24 inside the unit housing 80 can be removed by being pulled out to the upper side and the left diagonal upper side from the plural storage container placement positions inside the unit housing 80.

Moreover, in the banknote processing unit 71, the banknote storage containers 73 to 76 and the auxiliary storage container 24 that have been thus removed from the lower portion unit 72 can be transported to a designated banknote loading location and plural banknotes loaded into the banknote storage containers 73 to 76 and the auxiliary storage container 24, and rejected banknotes and left behind banknotes can be removed.

Moreover, in the banknote processing unit 71, in a state in which the banknote storage containers 73 to 76 and the auxiliary storage container 24 have been removed from the lower portion unit 72, the banknote storage containers 73 to 76 and the auxiliary storage container 24, that have been filled with plural banknotes and/or from which rejected banknotes and left behind banknotes have been removed at the banknote loading location, can be housed in the plural storage container placement positions inside the unit housing 80, by inserting the banknote storage containers 73 to 76 and the auxiliary storage container 24 from the upper side or the left diagonal upper side.

In the banknote processing unit 71, when the processing unit lower side conveyance section 27 has been closed with respect to the unit housing 80 of the lower portion unit 72, the lower side conveyance path 27A can be connected to the banknote storage containers 73 to 76 and the auxiliary storage container 24.

Accordingly, in the banknote processing unit 71, the banknote storage containers 73 to 76 and the auxiliary storage container 24 can be mounted to the lower portion unit 72, and in this mounted state the lower portion unit 72 can be housed by pushing into the main frame 12.

Note that when the lower portion unit 72 is housed in the main frame 12, the lower side conveyance path 27A connects to the front side conveyance path 25A and the rear side conveyance path 26A. Moreover, when the lower portion unit 72 is pulled out from the main frame 12, the lower side conveyance path 27A is disconnected from the front side conveyance path 25A and the rear side conveyance path 26A.

(2-3) Banknote Storage Container Configuration

Next, explanation follows in sequence regarding configuration of the plural banknote storage containers 73 to 76. Note that since each of the plural banknote storage containers 73 to 76 are of similar configuration, explanation is given only for configuration of the single banknote storage container 73, with explanation of the configuration of the other banknote storage containers 74 to 76 omitted.

In the following explanation of the configuration of the banknote storage container 73 will be given using the directions as defined in the explanation of the configuration of the banknote storage container 20 according to the first embodiment with reference to FIG. 6A and FIG. 6B (namely the storage container left direction and the storage container front direction and so on).

Figure 17A:
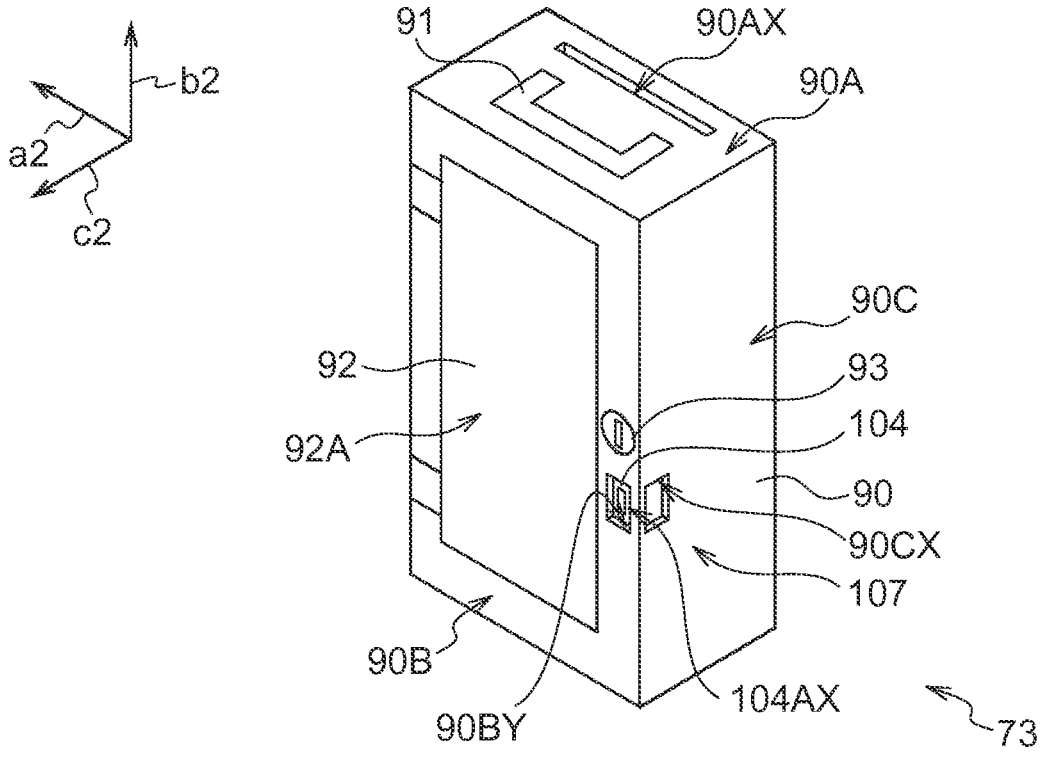
FIG. 17A is a schematic perspective view illustrating a configuration of a banknote storage container according to the second embodiment.
Figure 17B:
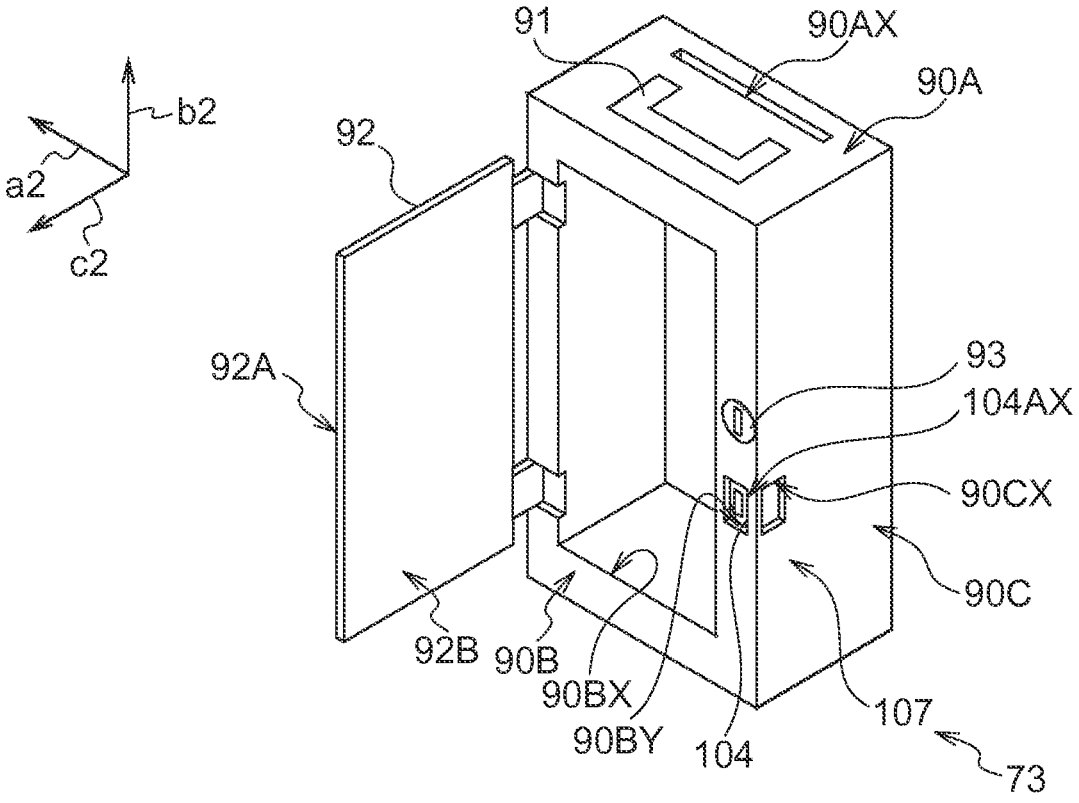
FIG. 17B is a schematic perspective view illustrating a configuration of a banknote storage container according to the second embodiment.

As illustrated in FIG. 17A and FIG. 17B, the banknote storage container 73, similarly to in the banknote storage container 20 according to the first embodiment described above, includes an outer case 90 formed from metal plates in a substantially rectangular box shape that is long in the up-down direction.

Note that the height of the thus configured outer case 90 is set equivalent to the height of the outer case 40 of the banknote storage container 20 according to the first embodiment.

A case upper face 90A of the outer case 90 is, similarly to the banknote storage container 20 according to the first embodiment described above, formed with a slit shaped banknote take-in/feed-out opening 90AX and a substantially C-shaped handle 91 is attached so as to be capable of being housed inside or pulled up from a substantially C-shaped groove portion.

A central portion of a case front face 90B of the outer case 90 is further formed with a substantially rectangular shaped opening portion 90BX for loading banknotes inside (or removing banknotes from the inside).

A substantially rectangular shaped door 92 formed from a metal plate is open-closable attached (namely, so as to be left-opening in the present example) to the case front face 90B of the outer case 90 through for example a pair of hinge portions, not illustrated in the drawings, provided to a left edge portion, such that a door outer face 92A of the door 92 closes off the opening portion 90BX in the same plane as the case front face 90B, or opens up the opening portion 90BX.

A lock 93, such as a cylinder lock that corresponds to a key such as a dimple key, is attached at a right end center portion of the case front face 90B, such that one end face of the lock 93 formed with a keyhole is exposed from the case front face 90B. The other end portion of the lock 93 projects out to the inside of the outer case 90.

Figure 18:
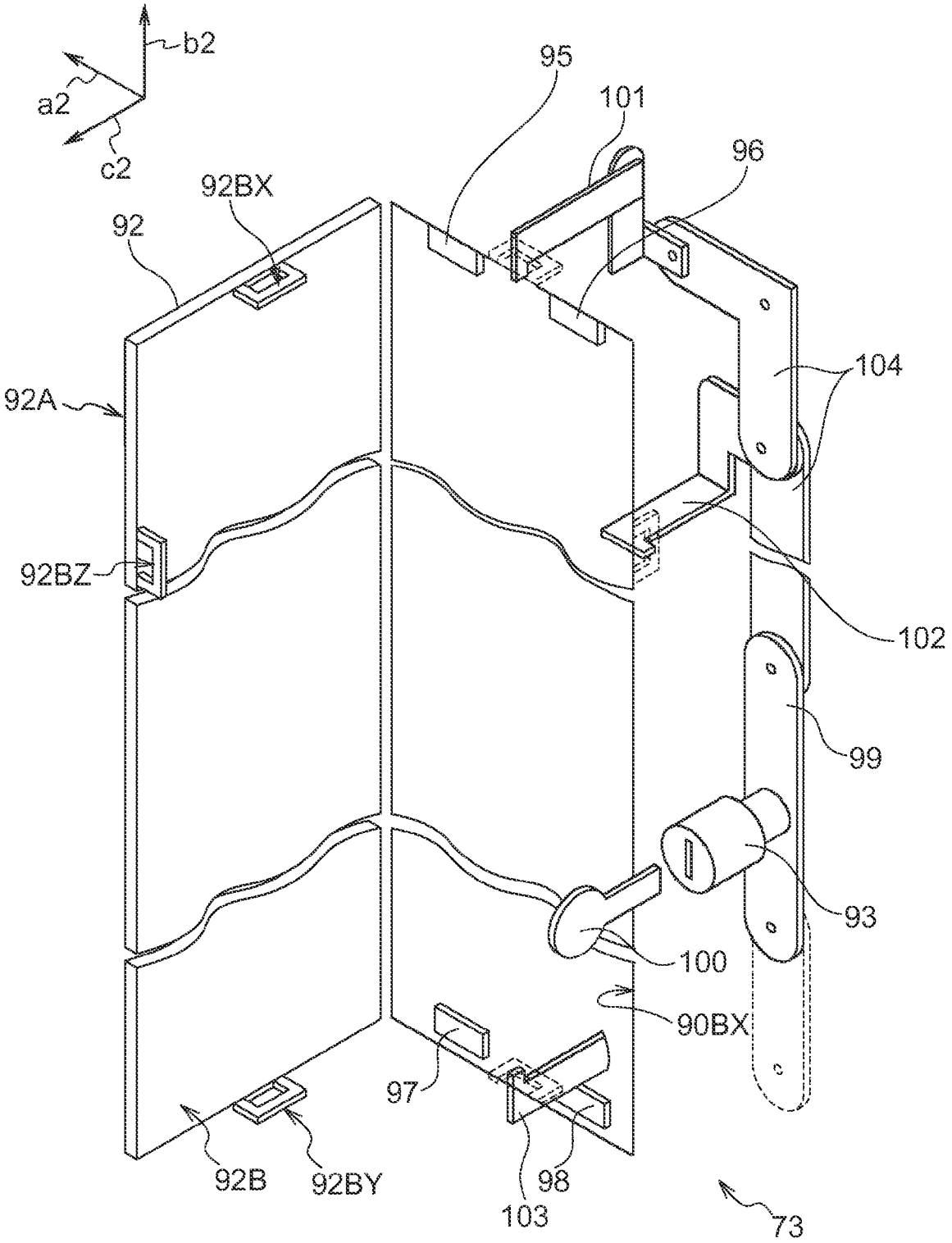
FIG. 18 is a schematic perspective view to accompany explanation of a lock mechanism of a banknote storage container.

Explanation follows regarding a configuration of a lock mechanism of the door 92 provided to the banknote storage container 73, with reference to FIG. 18. As illustrated in FIG. 18, door contact plates 95 to 98 are disposed at specific positions that are the thickness of the door 92 towards the inside of the outer case 90 from the respective upper edge and lower edge of the opening portion 90BX. One face of the respective door contact plates 95 to 98 faces towards the storage container front direction.

Substantially C-shaped anchor portions 92BX to 92BZ are respectively provided at specific positions on the upper edge, lower edge and right edge of a door inner face 92B of the door 92, with hole portions formed between the anchor portions 92BX to 92BZ and the door inner face 92B (referred to below as anchor hole portions).

Accordingly, in the outer case 90, when the door 92 is closed, the upper edge portion and the lower edge portion of the door inner face 92B make contact with the door contact plates 95 to 98, enabling the door outer face 92A to be placed in the same plane as the case front face 90B, and enabling the anchor portions 92BX to 92BZ of the door 92 to be inserted inside.

A rotating plate 99 is attached to the other end portion of the lock 93 so as to rotate in one rotation direction or the other rotation direction about a central axis of the lock 93 according to rotation operation in the one rotation direction or the other rotation direction of a key 100 inserted into the keyhole.

Moreover, the outer case 90 has lock levers 101 to 103 provided with hook portions at the leading ends thereof disposed inside an upper edge portion, a right edge portion and a lower edge portion of the case front face 90B, aligned with the anchor portions 92BX to 92BZ of the door 92.

In the outer case 90, inside the upper edge portion, the right edge portion and the lower edge portion of the case front face 90B, the plural lock levers 101 to 103 are coupled in sequence through plural coupling plates 104 of respectively flat plate shapes and substantially L-shaped plates to the rotating plate 99 of the lock 93.

In the thus configured banknote storage container 73, when the key 100 is inserted into the keyhole of the lock 93 with the door 92 in a closed state with respect to the outer case 90, and for example rotation operated in the other rotation direction, the rotating plate 99 is swung in the other rotation direction according to this rotation operation.

Accordingly in the banknote storage container 73, the plural coupling plates 104 and the plural lock levers 101 to 103 are coupled with the rotation of the rotating plate 99, and the hook portions of the plural lock levers 101 to 103 are anchored in the anchor portions 92BX to 92BZ by entering into the corresponding anchor hole portions.

In the banknote storage container 73, when the key 100 is extracted from the keyhole of the lock 93 with the hook portions of the plural lock levers 101 to 103 still anchored to the corresponding anchor portions 92BX to 92BZ, the door 92 can be locked (namely rendered inoperable) in a closed state with respect to the outer case 90 (namely in a completely closed off state of the opening portion 90BX).

In the banknote storage container 73, when the key 100 is inserted into the keyhole of the lock 93 in the locked state of the door 92 with respect to the outer case 90 and, for example, rotation operated in the one rotation direction, the rotating plate 99 is rotated in the one rotation direction according to this rotation operation.

Accordingly, in the banknote storage container 73, the plural coupling plates 104 and the plural lock levers 101 to 103 are coupled to the rotation of the rotating plate 99, and the hook portions of the plural lock levers 101 to 103 are pulled out of the corresponding anchor hole portions, releasing locking of the door 92 with respect to the outer case 90.

Thus, in the banknote storage container 73 the door 92 can be opened with respect to the outer case 90 and the opening portion 90BX can be opened, enabling plural banknotes to be loaded inside, or banknotes that are inside to be taken out.

In the banknote storage container 73 (see FIG. 17A and FIG. 17B), in addition to the above configuration a seal attachment portion 107 is for example provided to the outer case 90 below the lock 93.

In the present example, a coupling plate exposure hole portion 90BY is provided as the seal attachment portion 107 at a right end portion of the case front face 90B of the outer case 90, to a lower side of the lock 93 so as to expose a portion of one face of one of the coupling plates 104 of the plural coupling plates 104 on the inside of the outer case 90.

At a front end portion of a right side face (also referred to below as the case right side face) 90C, a band extraction hole portion 90CX is provided as the seal attachment portion 107 in the vicinity of the coupling plate exposure hole portion 90BY at the same height position as the coupling plate exposure hole portion 90BY.

The seal attachment portion 107 includes 1 coupling plate (also referred to below as the seal attachment coupling plate) 104A that has a portion of one face exposed through the coupling plate exposure hole portion 90BY. A band insertion hole portion 104AX is provided to the portion on one face of the seal attachment coupling plate 104A that is exposed through the coupling plate exposure hole portion 90BY.

Figure 19:
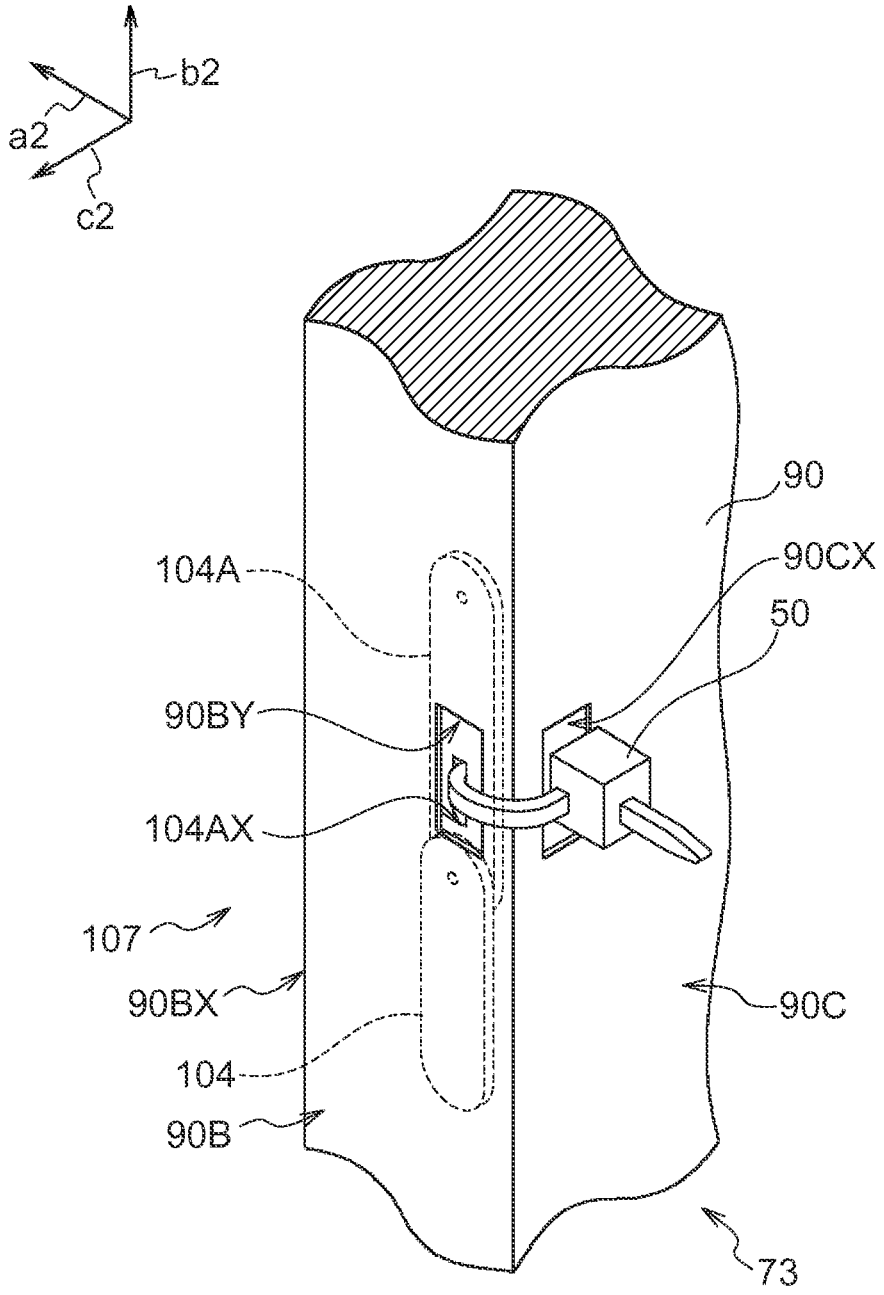
FIG. 19 is a schematic perspective view to accompany explanation of attachment of a seal to a seal attachment portion of a banknote storage container.

As illustrated in FIG. 19, in the banknote storage container 73, in the closed state of the door 92 with respect to the outer case 90, the band portion 50A of the seal 50 is inserted through the coupling plate exposure hole portion 90BY, into the band insertion hole portion 104AX of the seal attachment coupling plate 104A, and then after pulling out through the band extraction hole portion 90CX, the band portion 50A is inserted into the hole in the head portion 50B.

Accordingly, at the seal attachment portion 107 in the banknote storage container 73, the seal 50 is attached to the seal attachment portion 107 with the seal 50 tying the seal attachment coupling plate 104A at central portion of the right front corner of the outer case 90 (namely at a portion between the coupling plate exposure hole portion 90BY and the band extraction hole portion 90CX) through coupling plate exposure hole portion 90BY, the band insertion hole portion 104AX and the band extraction hole portion 90CX.

In the thus configured banknote storage container 73, the seal 50 is attached to the seal attachment portion 107 in a state visible from the periphery of the outer case 90 with the door 92 in the closed state with respect to the outer case 90.

When the seal 50 has been attached to the seal attachment portion 107, the seal attachment coupling plate 104A can be fixed so as not to move with respect to the outer case 90 due to the seal 50 binding the seal attachment coupling plate 104A to the central portion of the right front corner of the outer case 90.

Thus when the seal 50 has been attached to the seal attachment portion 107, the seal 50 is able to suppress rotation of the rotating plate 99 by fixing the seal attachment coupling plate 104A, even were an attempt to be made to improperly release the locking of the door 92 by the lock 93, for example using the key 100 or picking the lock in an attempt to rotate the rotating plate 99 in the one rotation direction.

Namely with the seal 50, even if an attempt were made to rotate the rotating plate 99 in the one rotation direction, since the seal attachment coupling plate 104A is fixed such that the rotating plate 99 cannot be moved at all, the other plural coupling plates 104 and the lock levers 101 to 103 may be prevented from moving at all.

Thus, when attached to the seal attachment portion 107 the seal 50 prevents release of locking even if improper release of the locking of the door 92 by the lock 93 is attempted, enabling locking of the door 92 to be maintained.

Thus, in the banknote storage container 73, by attaching the seal 50 to the seal attachment portion 107 the door 92 may be sealed with respect to the outer case 90 by the seal 50.

In practice, in the banknote storage container 73, when the door 92 is opened for loading with plural banknotes at the banknote loading location, a member of staff removes the seal 50 attached to the seal attachment portion 107 from the seal attachment portion 107, by destroying (severing) the band portion 50A with a cutting tool.

Moreover, in the banknote storage container 73, the locking of the door 92 with respect to the outer case 90 is released by the member of staff inserting the key 100 into the keyhole of the lock 93 and rotation operating the lock 93, the door 92 is opened, and plural banknotes are loaded inside the outer case 90.

Then in the banknote storage container 73, the member of staff closes the door 92 and locks the door 92 in a closed state with respect to the outer case 90 by rotation operating the key that is inserted into the keyhole of the lock 93, and attaches another seal 50 to the seal attachment portion 107, thereby sealing the door 92 with respect to the outer case 90 using the seal 50.

Accordingly in the banknote storage container 73, similarly to with the banknote storage container 20 according to the first embodiment described above, the member of staff may easily confirm whether or not there is a possibility of the door 92 having been improperly opened depending on whether or not the seal 50 has already been destroyed prior to being legitimately destroyed by the member of staff during banknote loading at the banknote loading location.

Moreover, with the banknote storage container 73, when the seal 50 has been attached to the seal attachment portion 107, similarly to with the banknote storage container 20 according to the first embodiment described above, the seal 50 can lock the door 92 in the closed state with respect to the outer case 90.

Note that in the lower portion unit 72 described above, in the unit housing 80 the height of the unit housing left side plate 80B is selected so as to be lower than the height position of the seal attachment portion 107 of the banknote storage container 73 (namely a height from the bottom face of the outer case 90 to the seal attachment portion 107).

Thus, in the lower portion unit 72, when the banknote storage container 73 (and the other banknote storage containers 74 to 76) are housed in the unit housing 80, the seal 50 attached to the seal attachment portion 107 is positioned to the upper side of the upper edge of the unit housing left side plate 80B, so as not to impede housing of the banknote storage container 73 (and the other banknote storage containers 74 to 76).

(2-4) Operation and Advantageous Effects of the Second Embodiment

In the configuration described above, the automatic teller machine 70 is provided with the locks 93 to the banknote storage containers 73 to 76 with the outer cases 90, each respectively provided with the openable and closable door 92, the plural lock levers 101 to 103, the rotating plate 99 attached to the lock 93, and the plural coupling plates 104 that couple the rotating plate 99 to these plural lock levers 101 to 103.

In the automatic teller machine 70, when the key 100 is inserted into the keyhole of the lock 93 in the banknote storage containers 73 to 76 and rotation operated, the rotating plate 99 is rotated corresponding to this rotation operation, the plural coupling plates 104 and the plural coupling plates 104 and the plural lock levers 101 to 103 are coupled to the rotation of the rotating plate 99, and the door 92 is locked in the closed state, or locking is released.

In the automatic teller machine 70, each of the banknote storage containers 73 to 76 are provided with the seal attachment portion 107 to which the seal 50 that can be removed by destruction is attached.

In the banknote storage containers 73 to 76 of the automatic teller machine 70, after locking the closed state of the door 92 with the lock 93, the seal 50 is attached to the seal attachment portion 107 so as to tie 1 seal attachment coupling plate 104A of the plural coupling plates 104 to the outer case 90.

Consequently, with the automatic teller machine 70, for each of the banknote storage containers 73 to 76, a member of staff may confirm whether or not there is a possibility of the doors 92 having been improperly opened, depending on whether or not the seal 50 has already been destroyed prior to being legitimately destroyed by the member of staff.

Moreover, in the automatic teller machine 70, even when an attempt is made to improperly release the locking of the doors 92 by the locks 93, such as during mounting or demounting the banknote storage containers 73 to 76 to the lower portion unit 14 or during transport, release may be prevented of the locking by the seal 50 that stops movement of the seal attachment coupling plate 104A, the other plural coupling plates 104, and the plural lock levers 101 to 103.

According to the above configuration, in the automatic teller machine 70, the plural lock levers 101 to 103, the rotating plate 99 attached to the lock 93, and the plural coupling plates 104 that couple the plural lock levers 101 to 103 to the rotating plate 99 are provided to the banknote storage containers 73 to 76, and the seal attachment portion 107 is provided for attaching the seal 50 that is removable by destruction. When the key 100 is inserted into the keyhole of the lock 93 and the rotating plate 99 is rotated according to rotation operation of the key 100, the plural coupling plates 104 and the plural lock levers 101 to 103 are coupled to the rotation of the rotating plate 99 and lock or release the locking of the door 92 in the closed state. The seal 50 is also attached to the seal attachment portion 107 in the locked state of the door 92 by the lock 93 so as to tie the 1 seal attachment coupling plate 104A to the outer case 90.

Hence, in the automatic teller machine 70, even were improper release of the locking of the door 92 by the lock 93 to be attempted in the banknote storage containers 73 to 76, locking release may be prevented by the seal 50 stopping the plural lock levers 101 to 103 from moving.

Thus the automatic teller machine 70 may obtain similar advantageous effects to those obtained by the first embodiment described above, and in addition, locking of the door 92 by the lock 93 may be strengthened by the seal 50, enabling a significant improvement to be made in the security of the banknote storage containers 73 to 76.

(3) Third Embodiment (3-1) Automatic Teller Machine External Configuration

Explanation next follows regarding an automatic teller machine according to a third embodiment. The automatic teller machine of the third embodiment has a similar external configuration to that of the automatic teller machine 1 according to the first embodiment (FIG. 1). Reference should accordingly be made to FIG. 1 regarding the external configuration of the automatic teller machine according to the third embodiment, and further explanation is omitted.

(3-2) Automatic Teller Machine Internal Configuration

Figure 20:
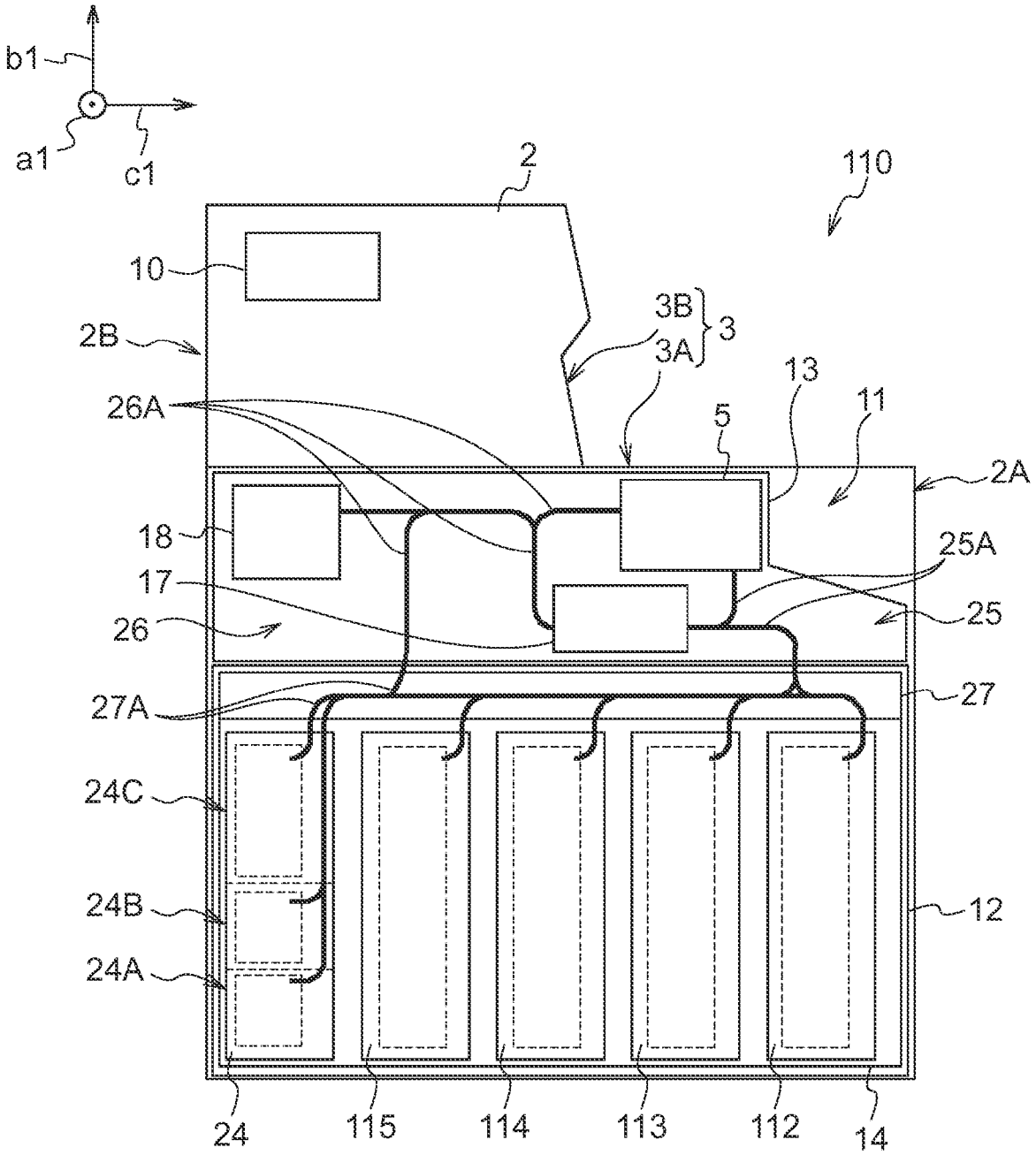
FIG. 20 is a schematic side view illustrating an internal configuration of an automatic teller machine according to a third embodiment.

Explanation next follows regarding the internal configuration of an automatic teller machine according to the third embodiment. As illustrated in FIG. 20, in which portions corresponding to FIG. 2 are appended with the same reference numerals, an automatic teller machine 110 of the third embodiment is configured similarly to the automatic teller machine 1 of the first embodiment as described above, except in terms of the configuration of plural banknote storage containers 112 to 115 that are detachably mounted to a lower portion unit 14.

Hence explanation next follows regarding configuration of the plural banknote storage containers 112 to 115 detachably mounted to the lower portion unit 14 of the automatic teller machine 110 according to the third embodiment.

(3-3) Banknote Storage Container Configuration

The plural banknote storage containers 112 to 115 according to the third embodiment are configured similarly to each other. Hence, the following explanation will only be given with respect to the configuration of the 1 banknote storage container 112, and explanation regarding the configuration of the other banknote storage containers 113 to 115 will be omitted.

Moreover, the following explanation of the configuration of the banknote storage container 112 will be given using the directions as defined during explanation of the configuration of the banknote storage container 20 according to the first embodiment using FIG. 6A and FIG. 6B (namely, the storage container left direction and the storage container front direction and so on).

Figure 21A:
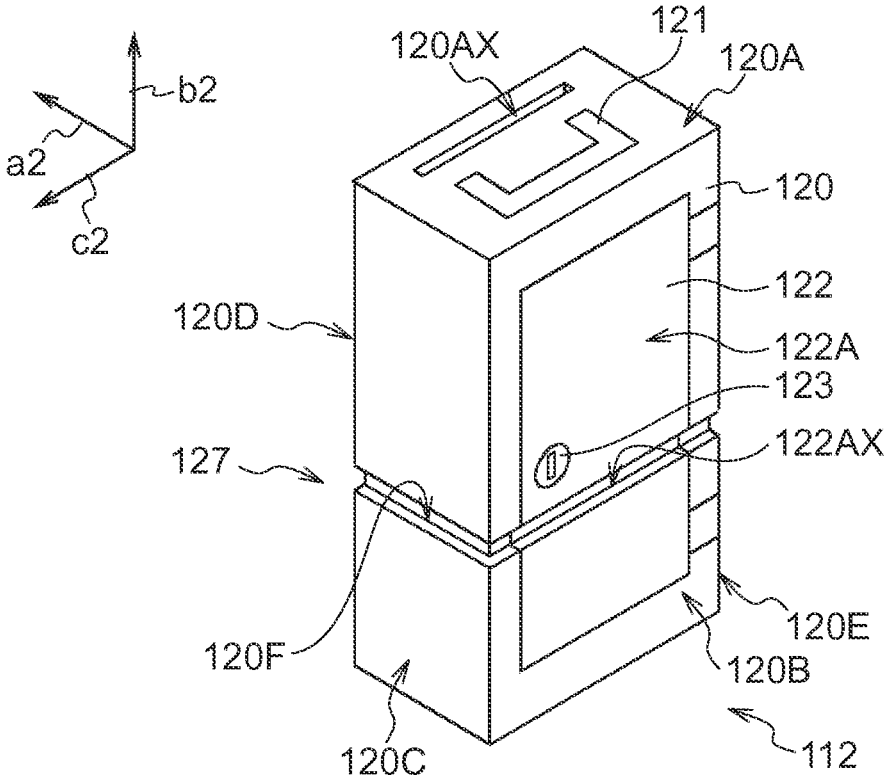
FIG. 21A is a schematic perspective view illustrating a configuration of a banknote storage container according to the third embodiment.
Figure 21B:
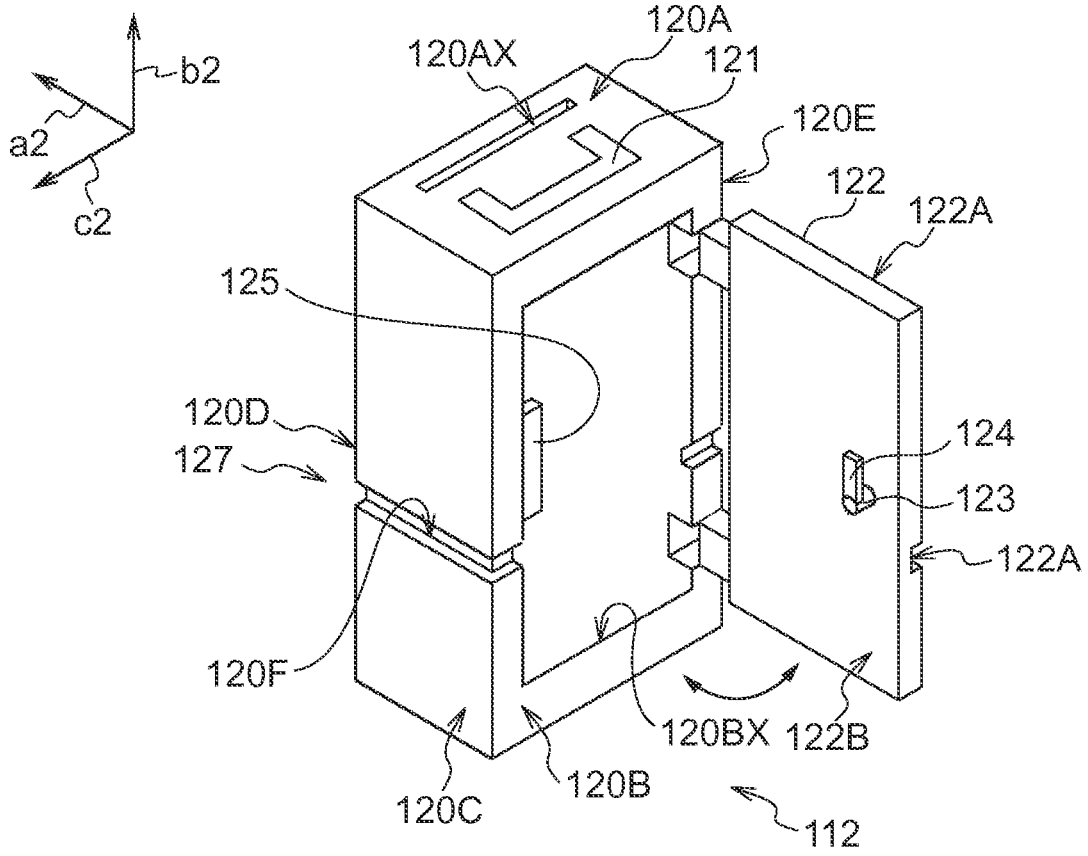
FIG. 21B is a schematic perspective view illustrating a configuration of a banknote storage container according to the third embodiment.

As illustrated in FIG. 21A and FIG. 21B, the banknote storage container 112, similarly to in the banknote storage container 20 according to the first embodiment described above, includes an outer case 120 formed from metal plates in a substantially rectangular box shape that is long in the up-down direction.

Note that the height of the thus configured outer case 120 is set equivalent to the height of the outer case 40 of the banknote storage container 20 according to the first embodiment.

A case upper face 120A of the outer case 120 is, similarly to with the banknote storage container 20 according to the first embodiment described above, formed with a slit shaped banknote take-in/feed-out opening 120AX and a substantially C-shaped handle 121 is attached utilizing a substantially C-shaped groove portion that the handle 121 can be housed inside or pulled up from.

A central portion of the case front face 120B of the outer case 120 is further formed with a substantially rectangular shaped opening portion 120BX for loading banknotes inside (or removing banknotes from inside).

A substantially rectangular shaped door 122 formed from a metal plate is open-closable attached (namely, so as to be right-opening in the present example) to the case front face 120B of the outer case 120 through, for example, a pair of hinge portions, not illustrated in the drawings, provided to a right edge portion, such that a door outer face 122A of the door 122 closes off the opening portion 120BX in the same plane as the case front face 120B, or opens up the opening portion 120BX.

A lock 123, such as a cylinder lock that corresponds to a key such as a dimple key (not illustrated in the drawings) is attached at a left end center portion of the door 122, such that one end face of the lock 123 formed with a keyhole is exposed from the outer face 122A of the door 122. The other end portion of the lock 123 projects out from an inner face 122B of the door 122.

At the other end portion of the lock 123, a thin elongated lock lever 124 configured by a metal plate is attached parallel to the door inner face 122B.

Accordingly, when the key is inserted into the keyhole and the lock 123 is rotation operated about the lock 123 axial center in one rotation direction or the other rotation direction opposite to the one rotation direction, the lock lever 124 coupled to this rotation operation is rotated in the one rotation direction or the other rotation direction, with the lock lever 124 remaining parallel to the door inner face 122B.

Moreover, in the outer case 120, a lock plate 125 configured by a metal plate is attached at a back side of a left end portion of the case front face 120B such that a portion of the lock plate 125 configures a plate projection portion that projects inside the opening portion 120BX.

Accordingly, in the banknote storage container 112, similarly to with the banknote storage container 20 according to the first embodiment described above, when the door 122 is closed with respect to the outer case 120, a left end central portion of the door inner face 122B is pushed against the plate projection portion front face of the lock plate 125, placing the door outer face 122A in the same plane as the case front face 120B.

In this state of the banknote storage container 112, the lock lever 124 is rotated in the other rotation direction when the key is inserted into the keyhole of the lock 123, and for example rotation operated in the other rotation direction, and the plate projection portion of the lock plate 125 is interposed between the door 122 and the leading end portion of the lock lever 124.

In the banknote storage container 112, when the key is extracted from the keyhole of the lock 123 with the plate projection portion of the lock plate 125 still interposed between the door 122 and the leading end portion of the lock lever 124, the door 122 can be locked in the closed state with respect to the outer case 120.

In the banknote storage container 112, in the locked state of the door 122 with respect to the outer case 120, the locking of the door 122 with respect to the outer case 120 is released for example by inserting the key into the keyhole of the lock 123 and rotation operating towards the one rotation direction, rotating the lock lever 124 in the one rotation direction.

In the banknote storage container 112, the door 122 can accordingly be opened with respect to the outer case 120 to open up the opening portion 120BX, and plural banknotes can be loaded inside, or banknotes can be removed from the inside.

In addition to the above configuration, the banknote storage container 112 has a seal attachment portion 127 provided to the outer case 120 and the door 122, for example to the lower side of the lock 123.

In the present example, as the seal attachment portion 127, a door side attachment groove portion 122AX is for example provided in the door outer face 122A of the door 122 below the lock 123, and is formed in a straight line shape with a specific width and depth corresponding to the width and height of the head portion 50B of the seal 50, and is formed parallel to the storage container left direction spanning from the right edge to the left edge of the door 122.

A case side attachment groove portion 120F with a width and depth equivalent to the door side attachment groove portion 122AX is formed in the outer case 120 so as to extend at the same height position as the door side attachment groove portion 122AX and to span from a left end portion of the case front face 120B across a case left side face 120C, a back face (also referred to below as case back face) 120D, a case right side face 120E, and as far as a right end portion of the case front face 120B.

Namely, the case side attachment groove portion 120F and the door side attachment groove portion 122AX are formed spanning around the outer case 120 and the door 122 as the seal attachment portion 127, such that the left-right width and the front-rear thicknesses of the banknote storage container 112 are narrowed at a specific height position from the bottom face of the outer case 120.

Figure 22:
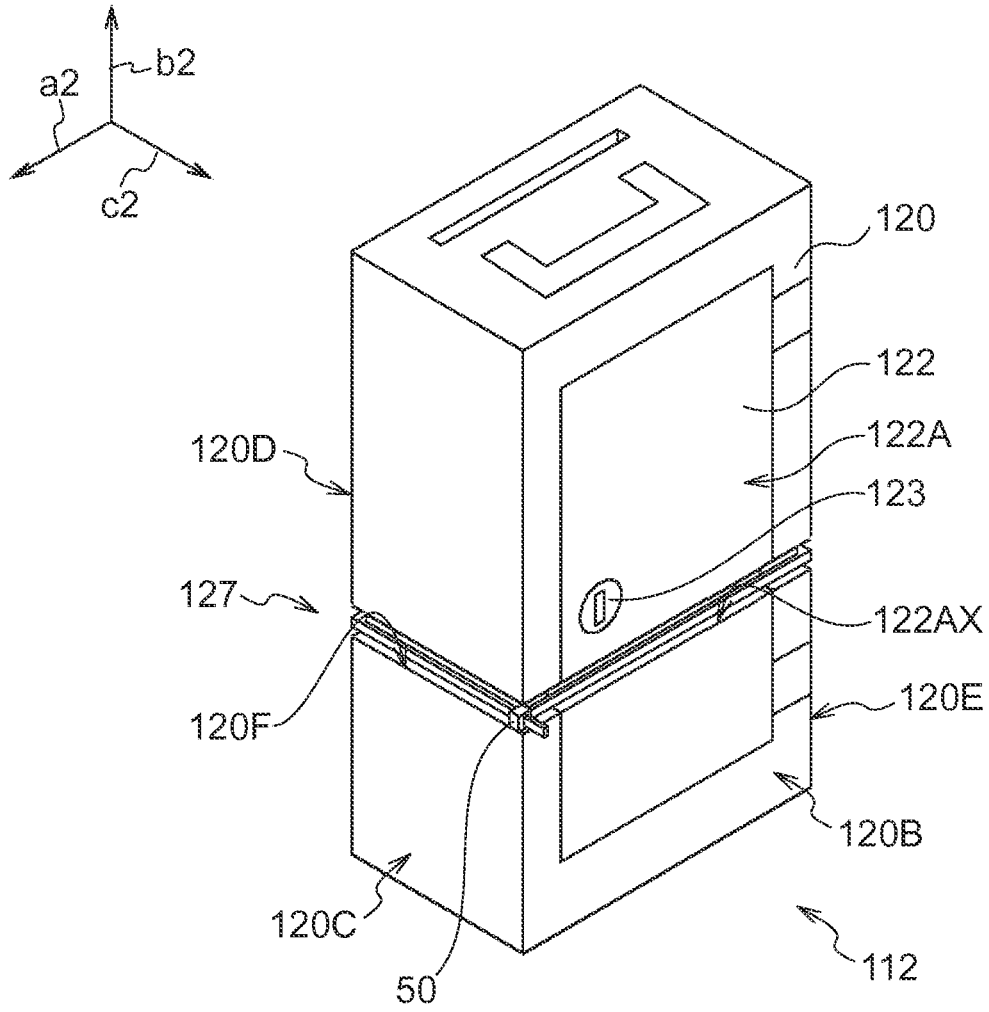
FIG. 22 is a schematic perspective view to accompany explanation of attachment of a seal to a seal attachment portion of a banknote storage container.

Then, as illustrated in FIG. 22, in the closed state of the door 122 with respect to the outer case 120, the band portion 50A of the seal 50 is inserted into the hole in the head portion 50B so as to fit into the case side attachment groove portion 120F and the door side attachment groove portion 122AX substantially all the way around the banknote storage container 112.

The banknote storage container 112 accordingly has the seal 50 attached to the seal attachment portion 127 such that the seal 50 ties the door 122 to the outer case 120 through the case side attachment groove portion 120F and the door side attachment groove portion 122AX at the seal attachment portion 127.

Thus, in the configured banknote storage container 112, with the door 122 in a closed state with respect to the outer case 120, the seal 50 is attached to the seal attachment portion 127 so as to be visible from the periphery of the outer case 120, enabling the door 122 to be sealed with respect to the outer case 120 by the seal 50.

In practice, with the banknote storage container 112, when the door 122 is opened for loading with plural banknotes at the banknote loading location, a member of staff removes the seal 50 attached to the seal attachment portion 127 from the seal attachment portion 127, by destroying (severing) the band portion 50A with a cutting tool.

Moreover, in the banknote storage container 112, the locking of the door 122 with respect to the outer case 120 is released by the member of staff inserting the key into the keyhole and rotation operating the lock 123, the door 122 is opened, and plural banknotes are loaded inside the outer case 120.

Then in the banknote storage container 112, the member of staff closes the door 122 and locks the door 122 in the closed state with respect to the outer case 120 by rotation operating the key that is inserted into the keyhole of the lock 123, and attaches the seal 50 to the seal attachment portion 127, thereby sealing the door 122 with respect to the outer case 120 using the seal 50.

Accordingly with the banknote storage container 112, similarly to with the banknote storage container 20 according to the first embodiment described above, during banknote loading at the banknote loading location, the member of staff may easily confirm whether or not there is a possibility of the door 122 having been improperly opened depending on whether or not the seal 50 has already been destroyed prior to being legitimately destroyed by the member of staff.

Moreover, with the banknote storage container 112, when the seal 50 has been attached to the seal attachment portion 127, similarly to with the banknote storage container 20 according to the first embodiment described above, the seal 50 may lock the closed state by tying the door 122 to the outer case 120.

Note that in the banknote storage container 112, the seal attachment portion 127 is provided to the outer case 120 and the door 122 above the upper edge of the unit housing right side plate 32B of the unit housing 32.

Accordingly, the banknote storage container 112 may avoid the seal 50 attached to the seal attachment portion 127 from impeding the mounting or demounting operation when mounting or demounting to the lower portion unit 72.

(3-4) Operation and Advantageous Effects of Third Embodiment

In the above configuration, in the automatic teller machine 110 the lock 123 for locking the door 122 in a closed state, or for releasing this locking, is provided to each of the banknote storage containers 112 to 115 that each respectively include the outer case 120 with the door 122 open-closable provided thereto.

In the automatic teller machine 110, the case side attachment groove portion 120F and the door side attachment groove portion 122AX are provided to the banknote storage containers 112 to 115 around one circuit of the surface of the outer case 120 and the door 122 as the seal attachment portion 127 for attaching the seal 50 that is removable by destruction.

Thus, in the automatic teller machine 110, the seal 50 is attached to the seal attachment portion 127 in each of the banknote storage containers 112 to 115 so as to tie the door 122 to the outer case 120 in the closed state of the door 122 with respect to the outer case 120.

With the automatic teller machine 110, a member of staff may individually ascertain whether there is a possibility of the door 122 having been improperly opened for each of the banknote storage containers 112 to 115 by whether or not the seal 50 has been destroyed prior to the member of staff legitimately destroying the seal 50.

The automatic teller machine 110 also may lock the door 122 with the seal 50 to be maintained even were there to be improper release of the locking of the door 122 using the lock 123, such as during mounting or demounting the banknote storage containers 112 to 115 with respect to the lower portion unit 14, or during transport, as long as the seal 50 is not improperly destroyed.

According to the above configuration, the automatic teller machine 110 is provided with the lock 123 on each of the banknote storage containers 112 to 115 for locking the door 122 in the closed state, and for releasing this locking, and is provided with the seal attachment portion 127 configured by the case side attachment groove portion 120F and the door side attachment groove portion 122AX that span around one circuit of the surface of the outer case 120 and the door 122, with the seal 50 attached to the seal attachment portion 127 so as to tie the door 122 to the outer case 120 in the closed state of the door 122 with respect to the outer case 120.

Thus, in the automatic teller machine 110, similar advantageous effects may be obtained to the advantageous effects obtained by the first embodiment described above, and in addition the configuration of the seal attachment portion 127 may be simplified greatly compared to the first embodiment described above.

(4) Other Embodiments (4-1) Other Embodiment 1

Note that in the first embodiment described above, explanation has been given of a case in which the substantially rectangular shaped door side attachment plate 42C and the substantially rectangular shaped case side attachment plate 47 are provided to the banknote storage containers 20 to 23 as the seal attachment portion 46, and the seal 50 is attached with the door side attachment plate 42C and the case side attachment plate 47 in a state of contact with or approaching each other.

Figure 23A:
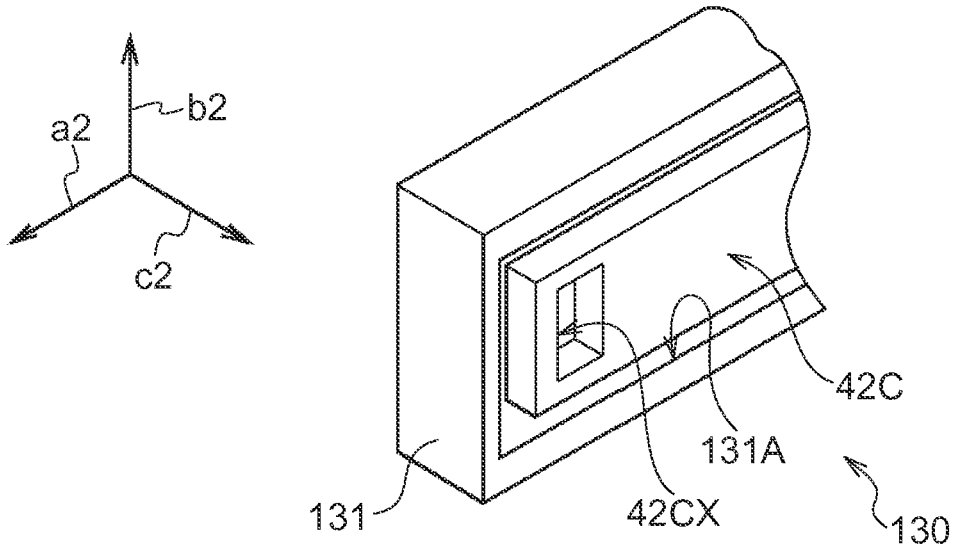
FIG. 23A is a schematic perspective view illustrating a configuration of a seal attachment portion according to another embodiment (1).
Figure 23B:
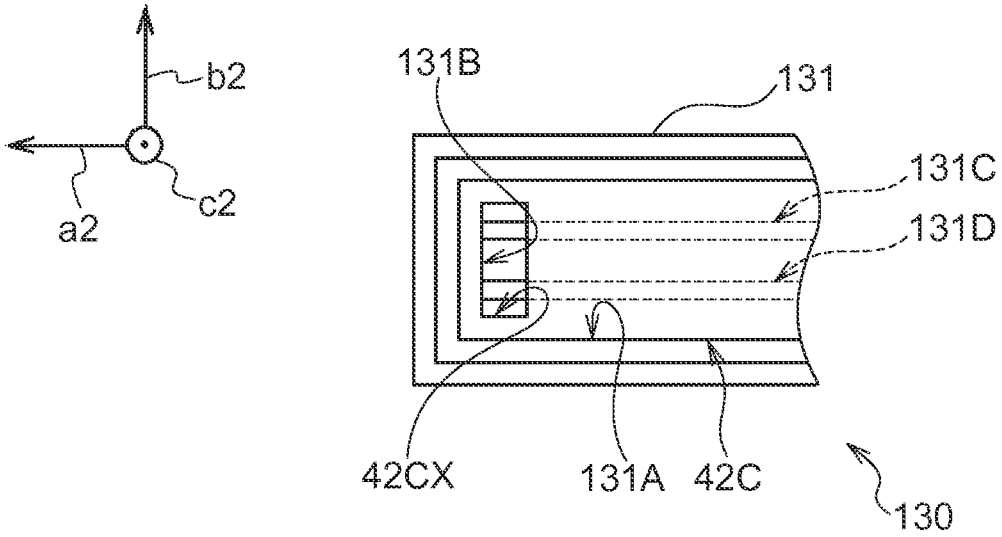
FIG. 23B is a schematic front face view illustrating a configuration of a seal attachment portion according to the other embodiment (1).

However, the present invention is not limited thereto, and as illustrated in FIG. 23A and FIG. 23B in which the same reference numerals are appended to portions corresponding to FIG. 6A and FIG. 6B, in a seal attachment portion 130, a case side attachment plate 131 may for example be provided to the outer case 40, formed on one face with a groove portion 131A of a specific thickness that corresponds to the door side attachment plate 42C.

In such cases, the case side attachment plate 131 is set with a depth from the edge of the groove portion 131A to the bottom face that is longer than the thickness of the door side attachment plate 42C.

A band insertion hole portion 131B is provided in the bottom face of the case side attachment plate 131 at a position facing the band insertion hole portion 42CX of the door side attachment plate 42C when the door 42 is closed with respect to the outer case 40 and the door side attachment plate 42C is inserted into the groove portion 131A.

Moreover, the bottom face of the case side attachment plate 131 is provided with at least two rectangular shaped support plates 131C, 131D that are parallel to the case side attachment plate 131 length direction and are provided projecting out perpendicularly so as to face a central portion of the inner face of the door side attachment plate 42C.

Figure 24:
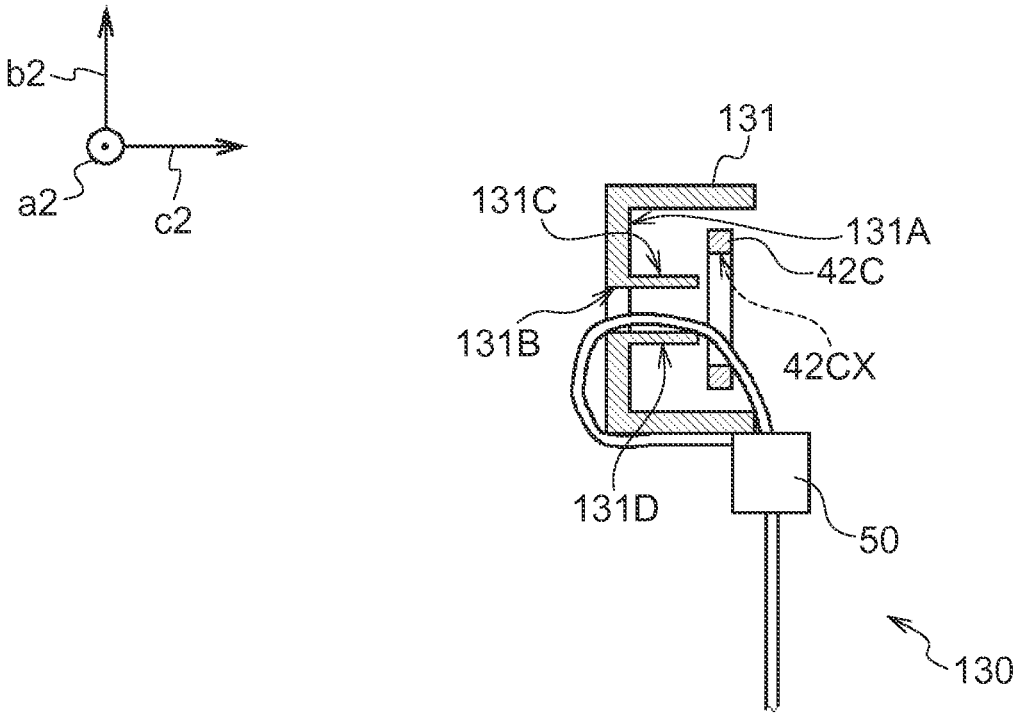
FIG. 24 is a schematic cross-section to accompany explanation of attachment of a seal to a seal attachment portion according to the other embodiment (1).

Accordingly, as illustrated in FIG. 24, when the door 42 is closed with respect to the outer case 40, the seal attachment portion 130 allows insertion of the door side attachment plate 42C into the groove portion 131A of the case side attachment plate 131, such that the inner face of the door side attachment plate 42C contacts or approaches the front side edges of the support plates 131C, 131D.

At the seal attachment portion 130, for example, the band portion 50A of the seal 50 is then passed from the rear side sequentially through the band insertion hole portion 131B of the case side attachment plate 131 and through the band insertion hole portion 42CX of the door side attachment plate 42C, and then inserted into the head portion 50B.

Accordingly, at the seal attachment portion 130, the seal 50 is attached to the seal attachment portion 130 such that the door side attachment plate 42C is tied through the band insertion hole portion 131B, 42CX to the case side attachment plate 131 by the seal 50, thereby sealing the door 42.

Due to such a configuration, the present invention is, for example, able to prevent deformation of the case side attachment plate 131 and the door side attachment plate 42C when an attempt is made to pull the seal 50 apart, or when collided with whilst in transport.

Figure 25:
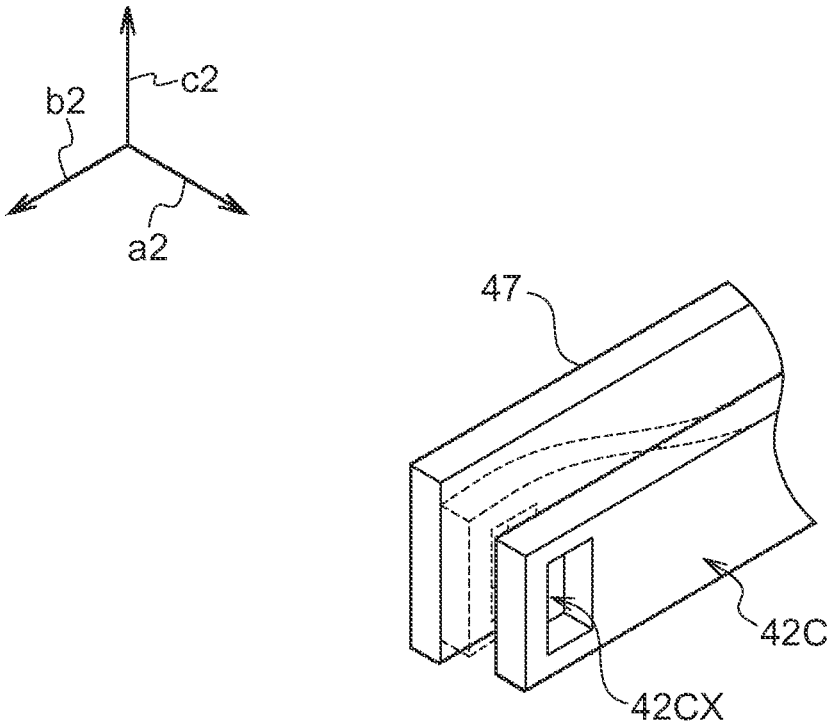
FIG. 25 is a schematic perspective view to accompany explanation of deformation of a door side attachment plate.

Namely, as illustrated in FIG. 25, in the seal attachment portion 46, there is a possibility of deformation the door side attachment plate 42C or the case side attachment plate 47 or both when an attempt is made to pull the seal 50 apart when the seal 50 is attached with the door side attachment plate 42C and the case side attachment plate 47 in a state facing each other with a gap therebetween, or when the door side attachment plate 42C and the case side attachment plate 47 are collided with whilst in transport.

However, due to such a configuration in the present invention, the support plates 131C, 131D provided perpendicular to the bottom face of the case side attachment plate 131 function as reinforcement plates and enable a more robust configuration to be achieved.

Moreover, in the present invention, when an attempt is made to pull the seal 50 apart, or when the door side attachment plate 42C and the case side attachment plate 131 collide with something in transport, the support plates 131C, 131D of the case side attachment plate 131 make contact with the door side attachment plate 42C, enabling deformation to be prevented.

In addition the present invention may be configured at the seal attachment portion 46 with 1 or plural ribs provided to a face facing towards the front side of the substantially rectangular shaped door side attachment plate 42C (a portion of the door outer face 42A) or with 1 or plural ribs provided to a face facing the front side of the substantially rectangular shaped case side attachment plate 47 or on a face facing towards the rear side.

Moreover, the present invention is configured at the seal attachment portion 46 with 1 or plural ribs provided to a face facing towards the rear side of the substantially rectangular shaped door side attachment plate 42C (a portion of the door inner face 42B) or with 1 or plural ribs provided to a face facing the front side of the substantially rectangular shaped case side attachment plate 47.

The present invention may be configured such that the 1 or plural ribs mesh together with each other when the door side attachment plate 42C and the case side attachment plate 47 face each other with the door 42 closed with respect to the outer case 40.

In the present invention, according to such a configuration, the door side attachment plate 42C and the case side attachment plate 47 mutually reinforce each other, and deformation may be prevented when an attempt is made to pull the seal 50 apart, or when the door side attachment plate 42C or the case side attachment plate 47 collide with something in transport.

(4-2) Other Embodiments 2

In the first embodiment described above explanation has been given of a case in which the seal 50 is attached to the seal attachment portion 46 of each of the banknote storage containers 20 to 23 by passing the band portion 50A in sequence through the band insertion hole portion 47A of the case side attachment plate 47 and the band insertion hole portion 42CX of the door side attachment plate 42C.

Figure 26A:
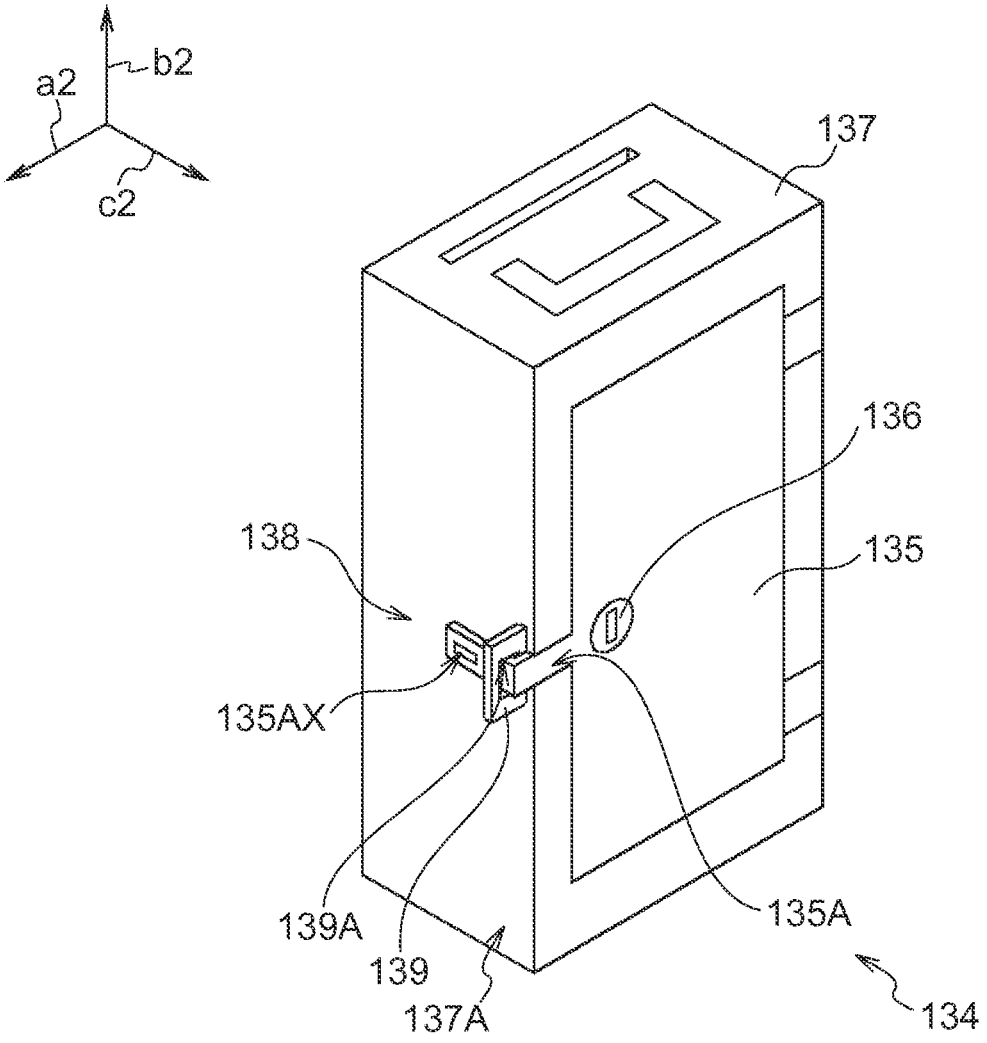
FIG. 26A is a schematic perspective view illustrating a configuration of a banknote storage container according to the other embodiment (1).
Figure 26B:
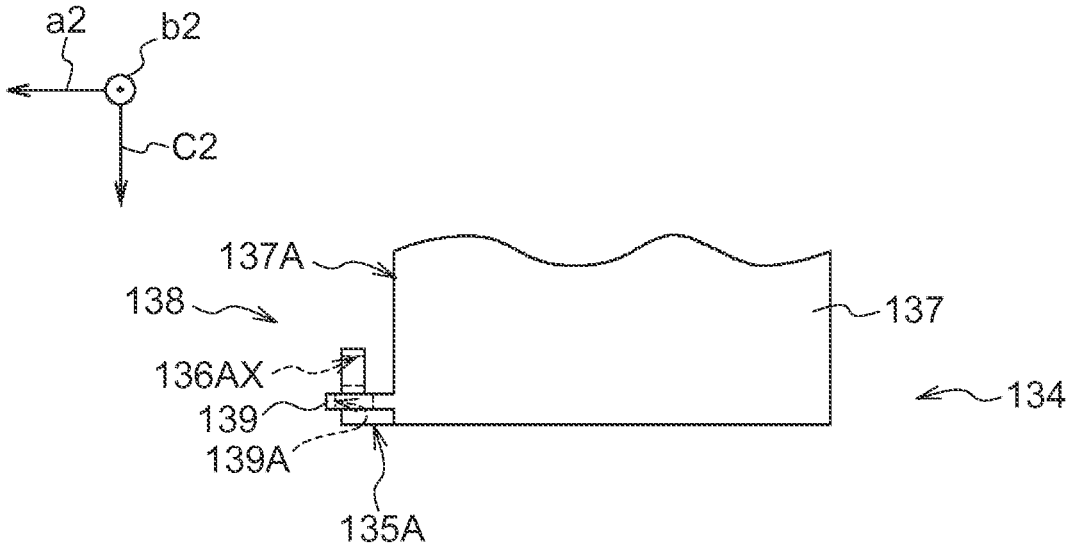
FIG. 26B is a schematic top-down view illustrating a configuration of a banknote storage container according to the other embodiment (1).

However, in the present invention there is no limitation thereto, and for example, as illustrated in FIG. 26A and FIG. 26B, configuration may be made such that a lock 136 is attached to a central portion of a left end of a door 135 in a banknote storage container 134, and a seal attachment portion 138 is provided at a central portion of a left side face of the door 135 and at a central portion of a front edge of a case left side face of an outer case 137.

Then, at the seal attachment portion 138, a substantially L-shaped door side attachment plate 135A is provided projecting from the left side face of the door 135, with a band insertion hole portion 135AX that is long in the horizontal direction provided through a leading end portion of the door side attachment plate 135A.

In the seal attachment portion 138, a flat plate shaped case side attachment plate 139 is also provided projecting out perpendicularly from the case left side face 137A of the outer case 137, with an attachment plate insertion hole portion 139A that is long in the vertical direction provided through a leading end portion of the case side attachment plate 139.

Figure 27:
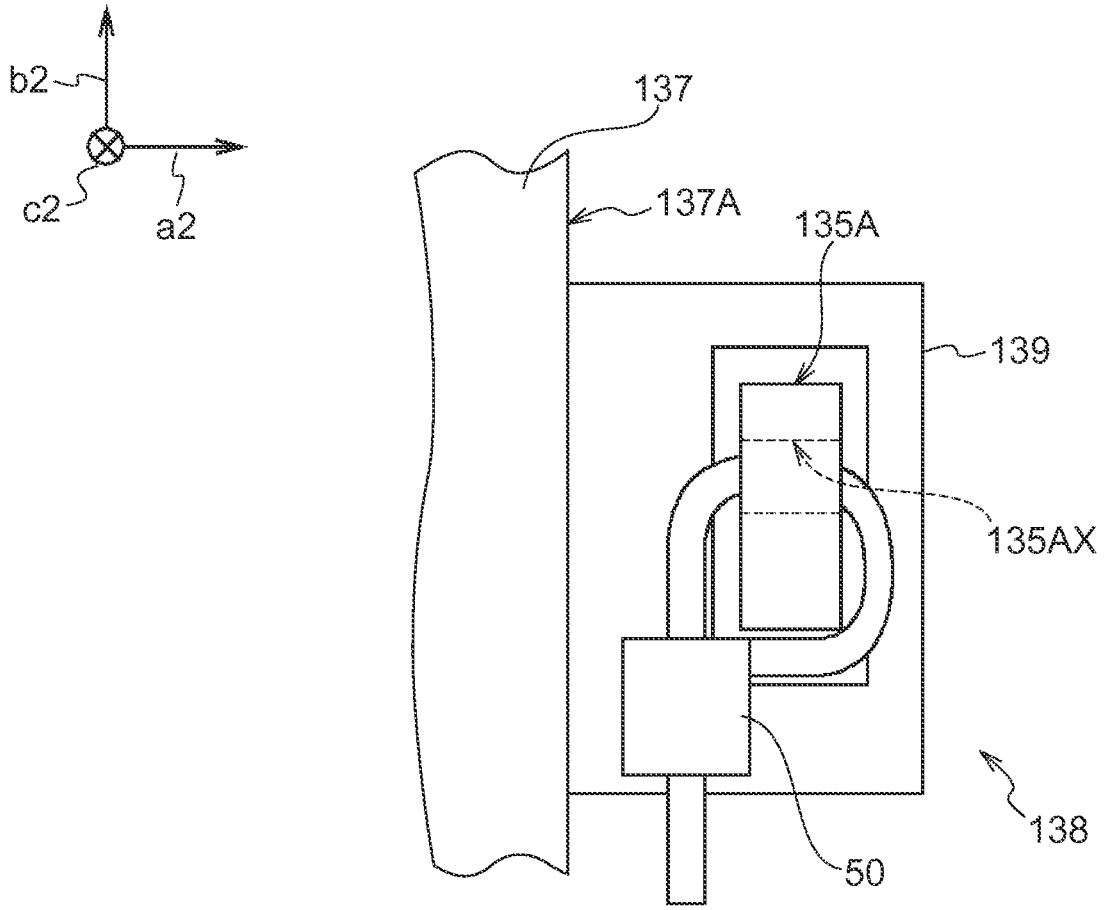
FIG. 27 is a schematic back view to accompany explanation of attachment of a seal to a seal attachment portion according to another embodiment (2).

Then, as illustrated in FIG. 27, at the seal attachment portion 138, the leading end portion of the door side attachment plate 135A is inserted into the attachment plate insertion hole portion 139A of the case side attachment plate 139 when the door 135 has been closed with respect to the outer case 137.

Thus, in the seal attachment portion 138, the seal 50 can be attached to the door side attachment plate 135A in a hanging orientation from the door side attachment plate 135A by passing the band portion 50A of the seal 50 through the band insertion hole portion 135AX positioned to the rear side of the case side attachment plate 139.

In the present invention, due to such a configuration, for example even when the locking of the door 135 by the lock 136 has been improperly released by lock picking, the seal 50 catches on the case side attachment plate 139 when opening of the door 135 is attempted, and the door side attachment plate 135A may be prevented from being pulled out of the attachment plate insertion hole portion 139A of the case side attachment plate 139.

Accordingly, in the present invention, due to such a configuration similar advantageous effects may be obtained to the advantageous effects obtained by the first embodiment described above.

Note that, in the present invention, for example an attachment plate insertion hole portion is provided to the door side attachment plate that is formed in a flat plate shape, and a band insertion hole portion is provided to a leading end portion of the case side attachment plate that is formed in a substantially L-shape.

Thus, in the present invention, configuration may be made such that in a state in which the leading end portion of the case side attachment plate has passed through the attachment plate insertion hole portion of the door side attachment plate, a seal is attached to the leading end portion of the case side attachment plate through the band insertion hole portion.

In the present invention, due to making such a configuration, similar advantageous effects may be obtained to those obtained with the configurations illustrated in FIG. 26A and FIG. 26B and FIG. 27.

Figure 28:
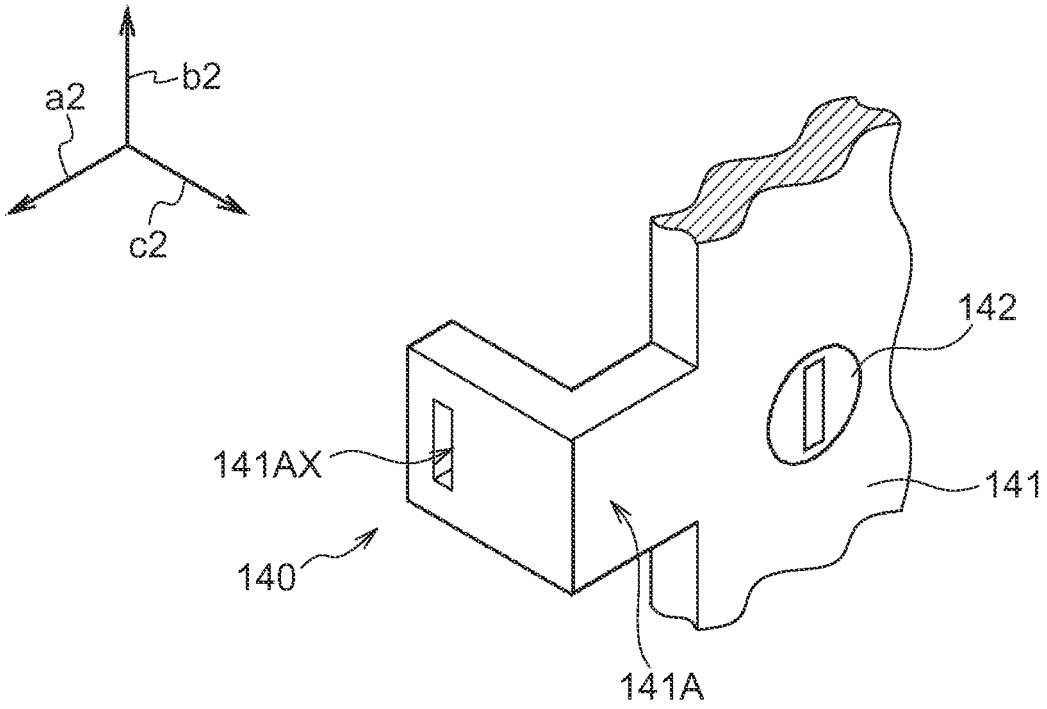
FIG. 28 is a schematic perspective view illustrating a configuration of a seal attachment portion according to the other embodiment (2).

Moreover, in the present invention, for example as illustrated in FIG. 28, in a seal attachment portion 140 a band insertion hole portion 141AX that is long in the vertical direction may be provided through a leading end portion of a substantially L-shaped door side attachment plate 141A provided projecting out from a door 141.

Then, in the present invention, a seal, not illustrated in the drawings, can be attached to the seal attachment portion 140 by passing a band portion through the band insertion hole portion 141AX of the door side attachment plate 141A in an orientation parallel to the rear direction (namely, in an orientation in which the leading end of the band portion faces towards the rear direction (or towards the front direction)).

In the present invention configured in this manner, when an attempt is made to open the door 141 when the locking of the door 141 by a lock 142 has been improperly released, the seal similarly catches on the case side attachment plate 139, enabling the door side attachment plate 141A to be prevented from being pulled out from the attachment plate insertion hole portion 139A of the case side attachment plate 139.

Thus, in the present invention configured in this manner, similar advantageous effects may also be obtained to the advantageous effects obtained in the first embodiment described above, and in addition the seal is positioned as far as possible from the unit housing right side plate 32B of the unit housing 32 when mounting or demounting the banknote storage container to the lower portion unit 14, impeding of the mounting or dismounting may be avoided.

(4-3) Other Embodiment 3

Moreover, in the first embodiment described above, explanation has been given of a case in which the door side attachment plate 42C and the case side attachment plate 47 are provided to the seal attachment portion 46 of the banknote storage containers 20 to 23 and the seal 50 is attached thereto.

However, the present invention is not limited thereto, and an attachment plate may be provided to one or other of the outer case or the door, and the seal 50 attached thereto.

Figure 29A:
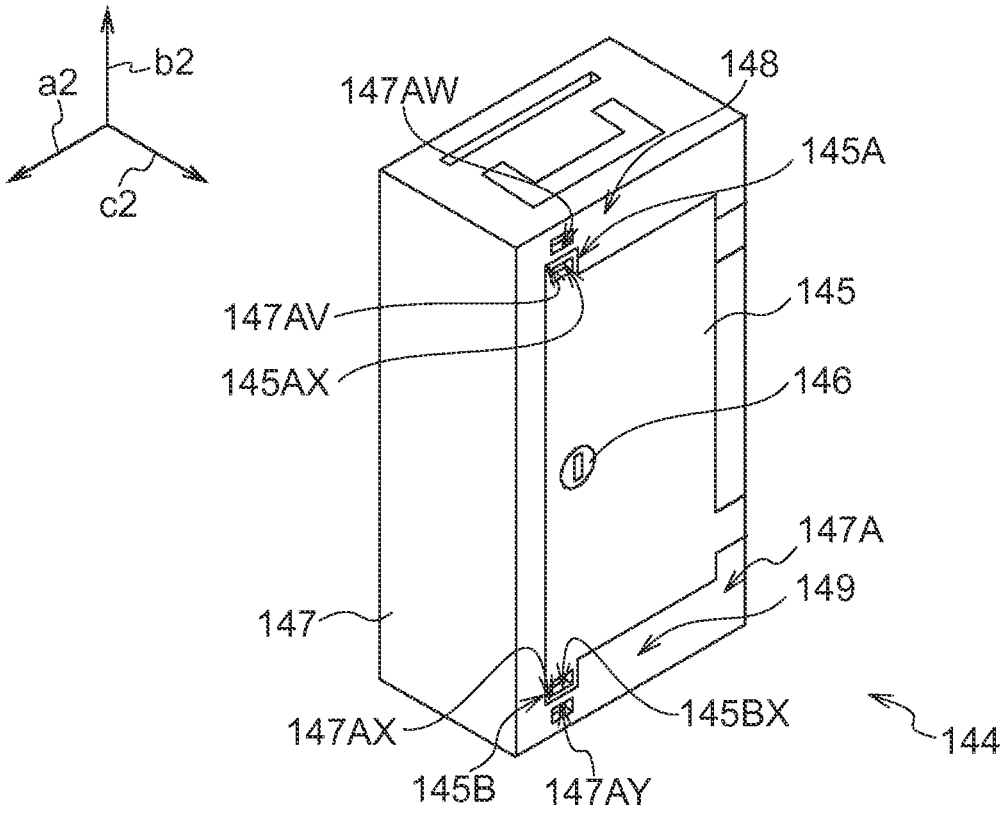
FIG. 29A is a schematic perspective view illustrating a configuration of a banknote storage container according to the other embodiment (2).
Figure 29B:
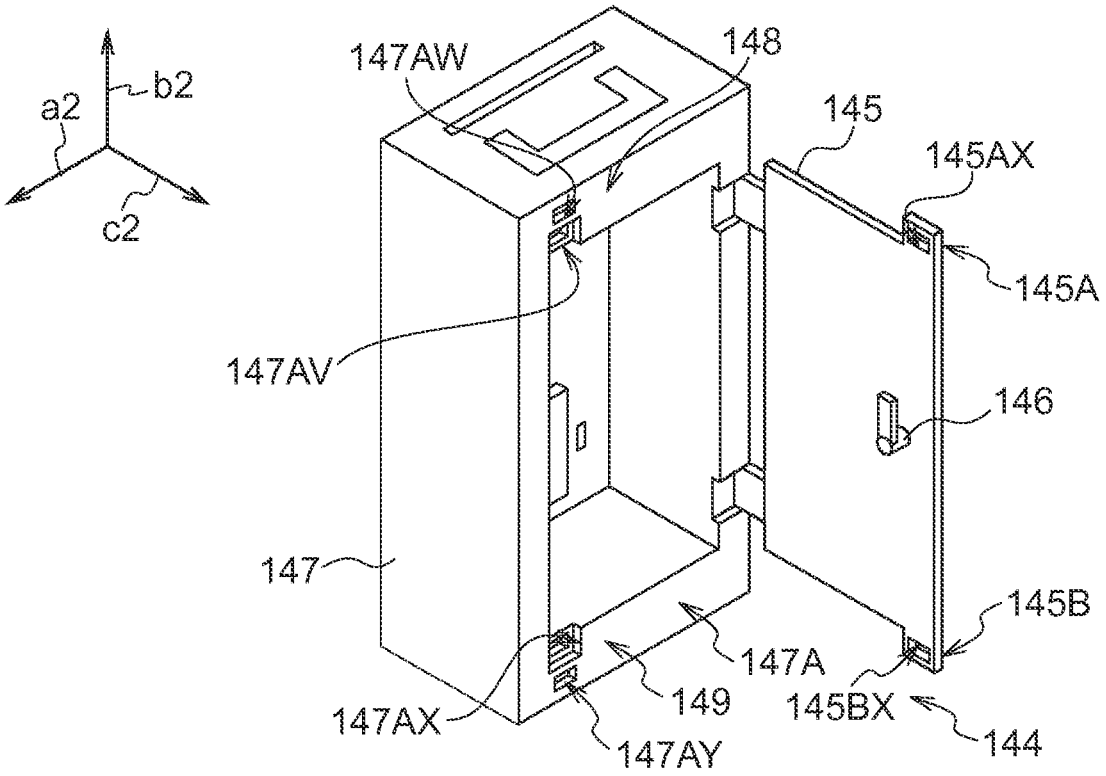
FIG. 29B is a schematic perspective view illustrating a configuration of a banknote storage container according to the other embodiment (2).

Explanation next follows regarding a configuration in a case in which out of the outer case and the door, the attachment plate is provided to the door. In such cases, for example as illustrated in FIG. 29A and FIG. 29B, the present invention, provided with a lock 146 is attached to a central portion at a left end of a door 145 of a banknote storage container 144, and a seal attachment portion 148 is provided to a left upper end portion of the door 135 and a left upper end portion of a case front face 147A of an outer case 147.

Moreover, in the present invention, the banknote storage container 144 is provided with a seal attachment portion 149 at a left lower end portion of the door 145 and at a left lower end portion of the case front face 147A of the outer case 147.

At the one seal attachment portion 148, a substantially rectangular shaped attachment plate 145A is provided at a left end of a top face of the door 145 so as to project towards the storage container up direction, with a band insertion hole portion 145AX provided through a leading end portion of the attachment plate 145A.

At the one seal attachment portion 148, a groove portion 147AV is also formed corresponding to the attachment plate 145A at a left upper end portion of the case front face 147A of the outer case 147.

Moreover at the one seal attachment portion 148, a band insertion hole portion 147AW is formed to span from a position directly above the groove portion 147AV in the case front face 147A of the outer case 147 to a position corresponding to the band insertion hole portion 145AX of the attachment plate 145A in the bottom face of the groove portion 147AV.

Moreover, at the other seal attachment portion 149, a substantially rectangular shaped attachment plate 145B is provided to a left end of a lower face of the door 145 so as to project out in the storage container down direction, and a band insertion hole portion 145BX is provided through a leading end portion of the attachment plate 145B.

In the other seal attachment portion 149, a groove portion 147AX is also formed corresponding to the attachment plate 145B in a left bottom end portion of the case front face 147A of the outer case 147.

Moreover, in the other seal attachment portion 149 a band insertion hole portion 147Y is formed to span from a position directly below the groove portion 147AX in the case front face 147A of the outer case 147 to a position corresponding to the band insertion hole portion 145BX of the attachment plate 145B in the bottom face of the groove portion 147AX.

Figure 30:
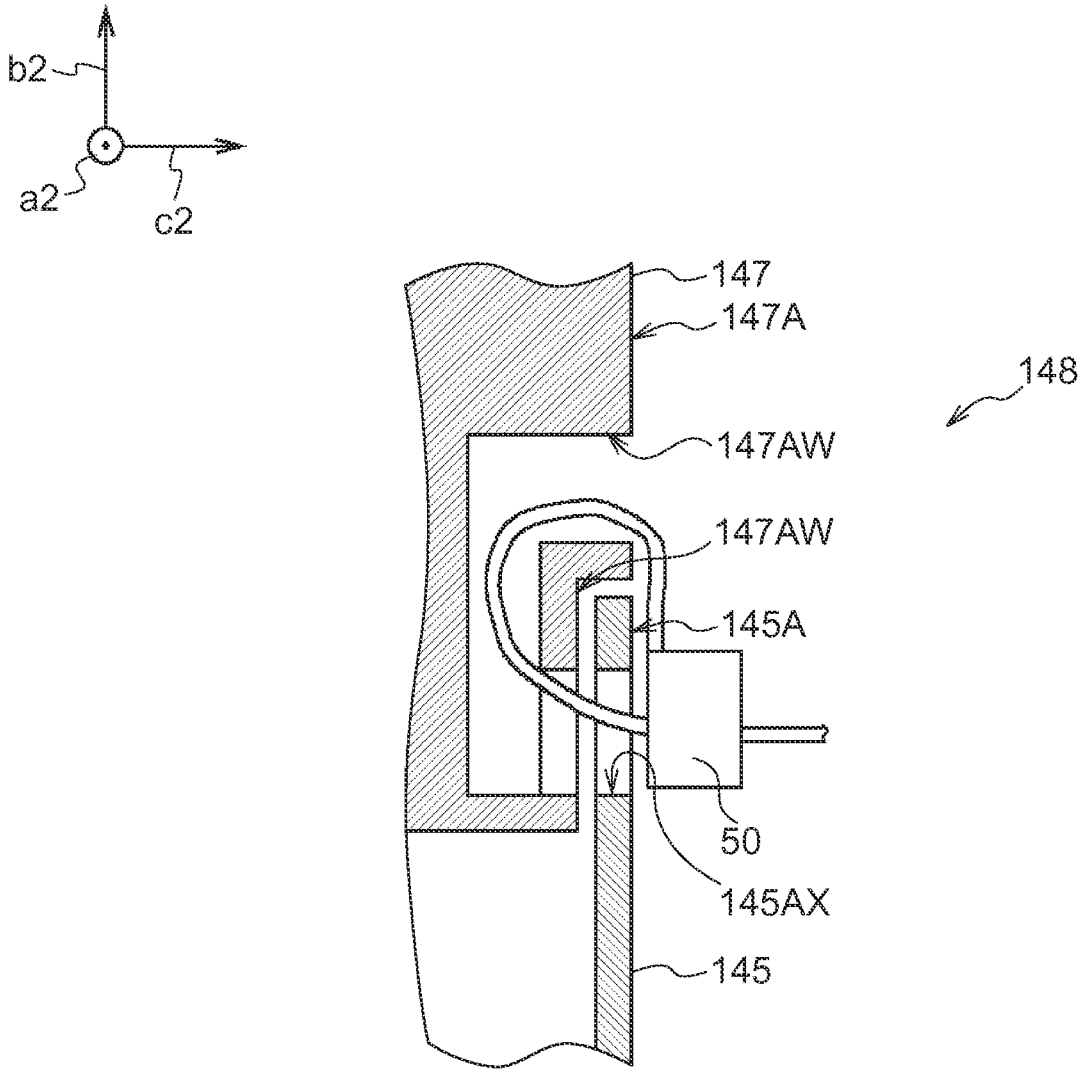
FIG. 30 is a schematic perspective view to accompany explanation of attachment of a seal to a seal attachment portion according to another embodiment (3).

Then as illustrated in FIG. 30, at the one seal attachment portion 148, the band portion 50A of the seal 50, after being passed through the band insertion hole portion 147AW from the case front face 147A and passed through the band insertion hole portion 145AX of the attachment plate 145A, is inserted into the hole of the head portion 50B.

The attachment plate 145A at the left top end portion of the door 145 is accordingly tied by the seal 50 to the left upper end portion of the case front face 147A of the outer case 147 through the band insertion hole portions 147AW, 145AX, with the seal 50 thereby attached to the one seal attachment portion 148.

Although not specifically illustrated, the seal 50 is also attached to the other seal attachment portion 149 in a similar manner as in the one seal attachment portion 148.

In the thus configured present invention, in a closed state of the door 145 with respect to the outer case 147, seals 50 are respectively attached to the one and the other seal attachment portions 148, 149, thereby enabling the door 145 to be sealed with respect to the outer case 147.

In the present invention, due to such a configuration, since left end side of the door 145 at which the lock 146 is attached is sealed at two locations at the top side and the bottom side (namely portions provided with reinforcement plates), even suppose the lock 146 was subject to lock picking and an attempt was also made to open the door 145 using a crowbar, then locking of the door 145 may be maintained by the seals 50 at two locations.

However, in the present invention, configuration may be made with not only the seal attachment portions 148, 149 provided at two locations on the outer case 147 and the door 145, and the respective seals 50 attached to the seal attachment portions 148, 149, but with seal attachment portions provided in 3 or more locations of the outer case 147 and the door 145, and with respective seals 50 attached to the seal attachment portions at the 3 or more locations.

Thus, in the present invention, the configured seal attachment portions 148, 149 may be provided at only a single location of the outer case 147 and the door 145.

Figure 31A:
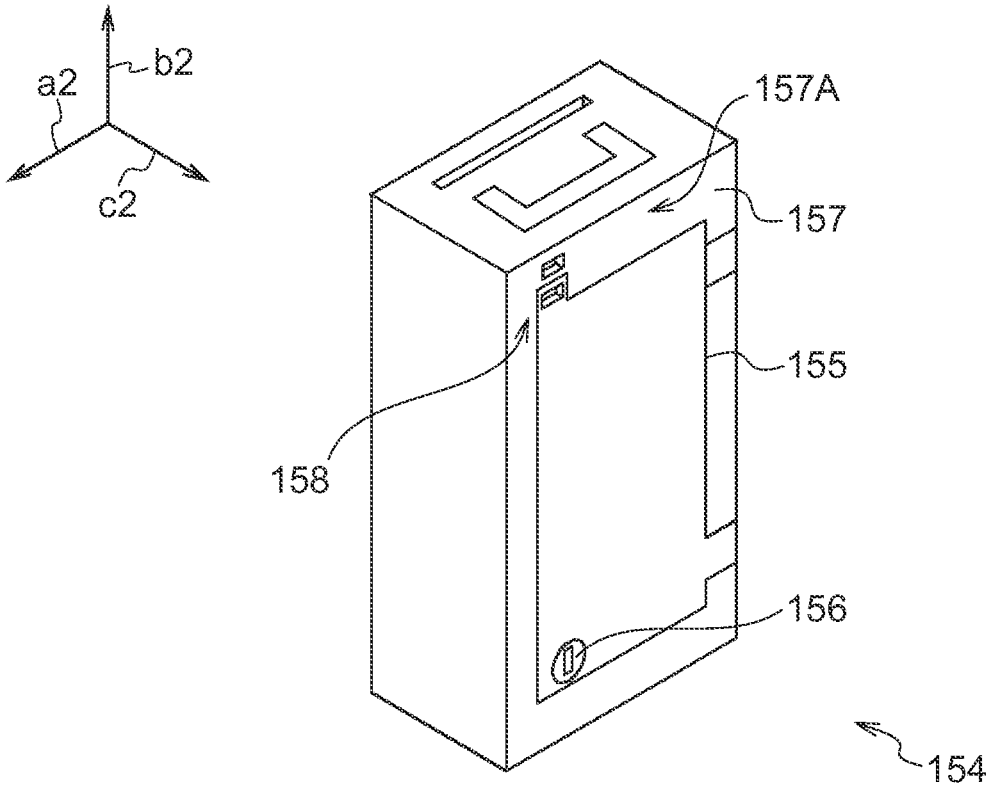
FIG. 31A is a schematic perspective view illustrating a configuration of a banknote storage container according to the other embodiment (3).
Figure 31B:
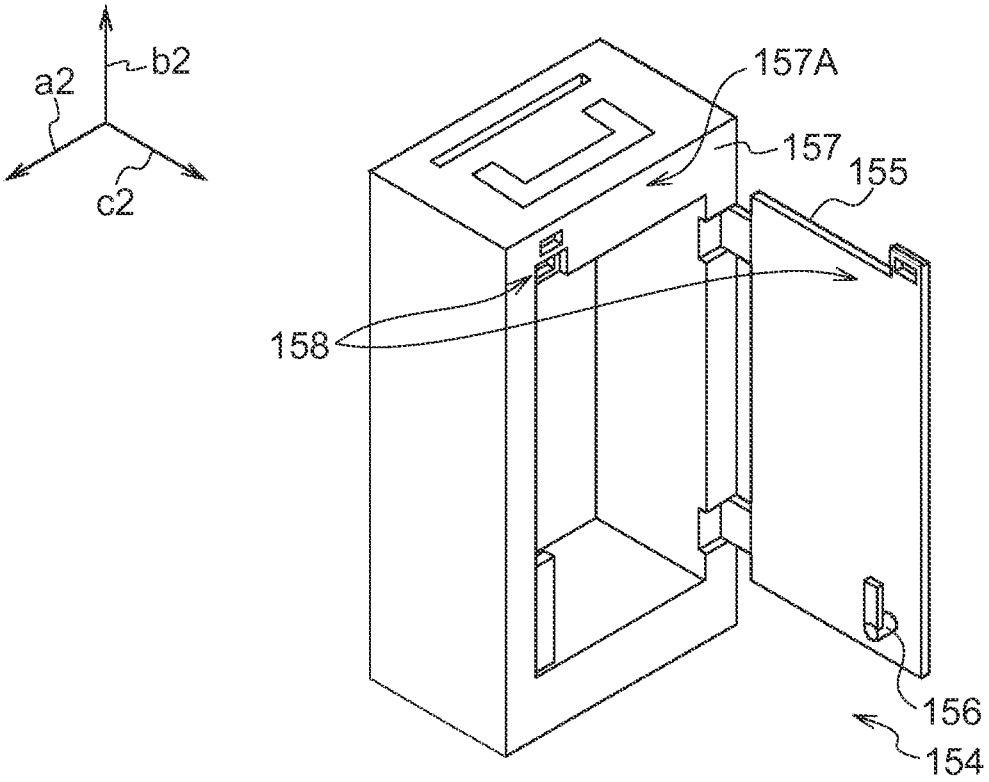
FIG. 31B is a schematic perspective view illustrating a configuration of a banknote storage container according to the other embodiment (3).

In such cases, in the present invention, for example as illustrated in FIG. 31A and FIG. 31B, a lock 156 may be attached to a left bottom end portion of a door 155 of a banknote storage container 154.

The present invention may also be configured with the banknote storage container 154 having a seal attachment portion 158 of similar configuration to the one seal attachment portion 148 described above with reference to FIG. 29A and FIG. 29B, provided to a left upper end portion of the door 155 and a left upper end portion of a case front face 157A of an outer case 157.

Then, similarly to the case described with reference to FIG. 30, a seal 50 is attached to the seal attachment portion 158, sealing the door 155 with respect to the outer case 157 by using the seal 50.

In the present invention, due to making such configuration, the seal 50 is attached through the seal attachment portion 158 to the upper side of a left end portion where the lock 156 is attached to the door 155 (namely a portion provided with a reinforcement plate) and the lower side of the left end portion is locked by the lock 156, hence locking of the door 155 by the seal 50 and the lock 156 may be maintained even if an attempt is made to open the door 155 using for example a crowbar.

Figure 32A:
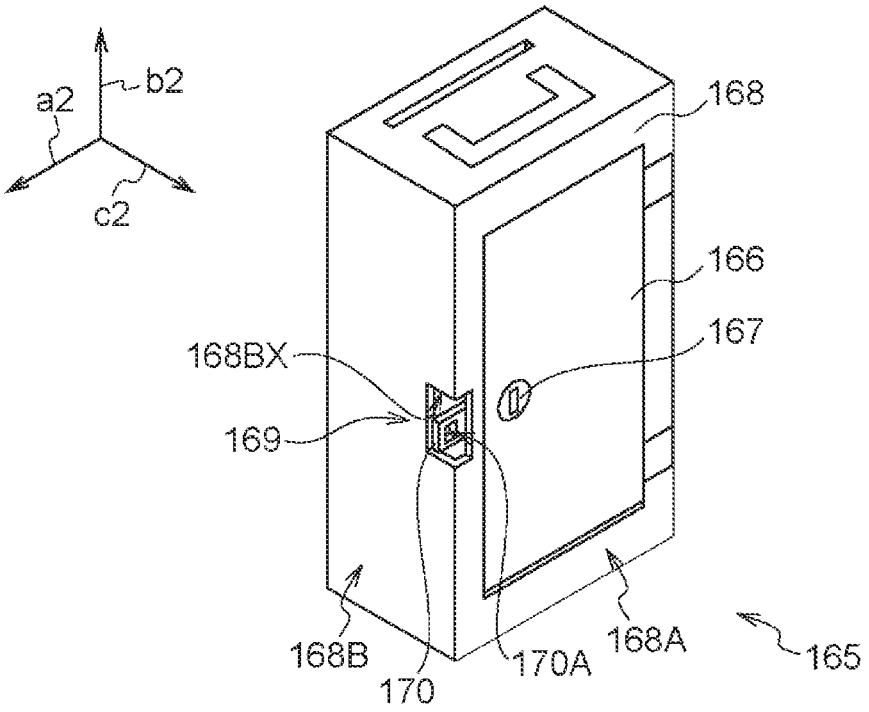
FIG. 32A is a schematic perspective view illustrating a configuration of a banknote storage container according to another embodiment (4).
Figure 32B:
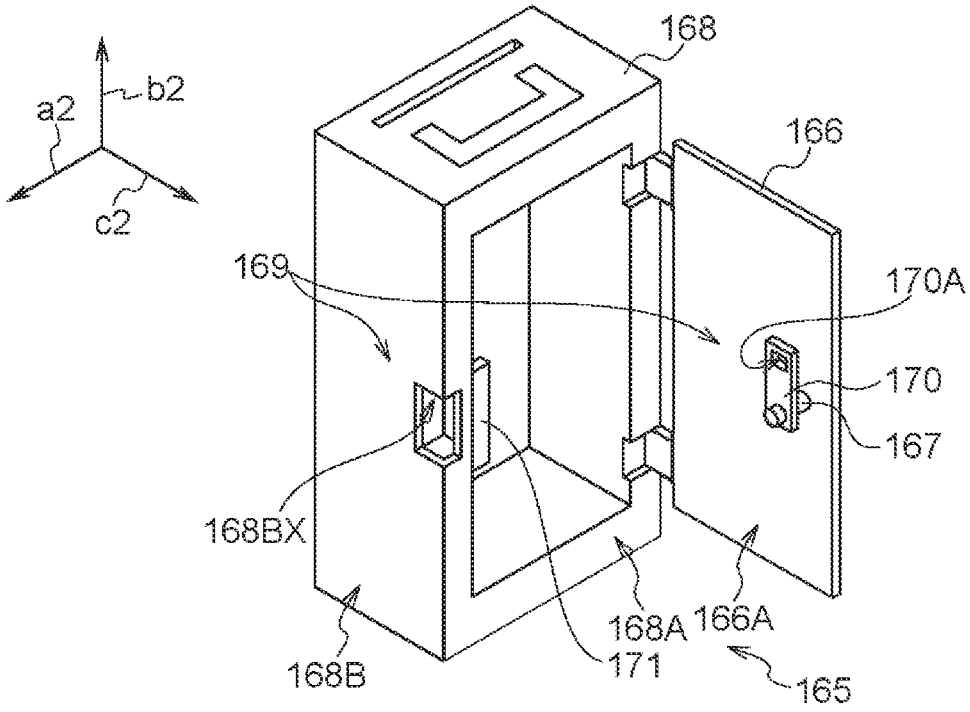
FIG. 32B is a schematic perspective view illustrating a configuration of a banknote storage container according to another embodiment (4).

In the present invention, for example as illustrated in FIG. 32A and FIG. 32B, a lock 167 may be attached to a central portion of a left end of a door 166 of a banknote storage container 165.

Moreover, in the present invention a seal attachment portion 169 may be provided to a central portion at the left end of the door 166, a central portion at the left end of the case front face 168A and a central portion of a front end of a case left side face 168B of the outer case 168 in the banknote storage container 165.

In such cases an attachment plate is provided to the door 166 at the seal attachment portion 169 employing the lock 167. Namely, in the seal attachment portion 169, a lock lever 170 that functions as an attachment plate is attached to another end portion of the lock 167 that projects out from a door inner face 166A of the door 166, and a band insertion hole portion 170A is provided to a leading end portion of the lock lever 170.

In the seal attachment portion 169 an attachment plate exposure hole portion 168BX is provided through to inside the outer case 168 parallel to the storage container right direction at a central portion of the front end of the case left side face 168B of the outer case 168.

In the seal attachment portion 169, an opening portion of the attachment plate exposure hole portion 168BX is cut out from a central portion of the left end of the case front face 168A of the outer case 168 to a left end portion of the attachment plate exposure hole portion 168BX, such that the opening portion is formed spanning from a central portion of the front end of the case left side face 168B to a central portion of the left end of the case front face 168A.

In the banknote storage container 165, due making such a configuration, when a key is inserted into the keyhole of the lock 167 and rotation operated when the door 166 is closed with respect to the outer case 168, accompanying this action the lock lever 170 is for example rotated by about 90° from a state in which the leading end portion thereof faces in the storage container up direction, such that the leading end portion of the lock lever 170 faces towards the storage container left direction.

Thus, in the banknote storage container 165, a lock plate 171 is interposed between the lock lever 170 and the door 166, and the door 166 is locked with respect to the outer case 168 in the closed state.

Figure 33A:
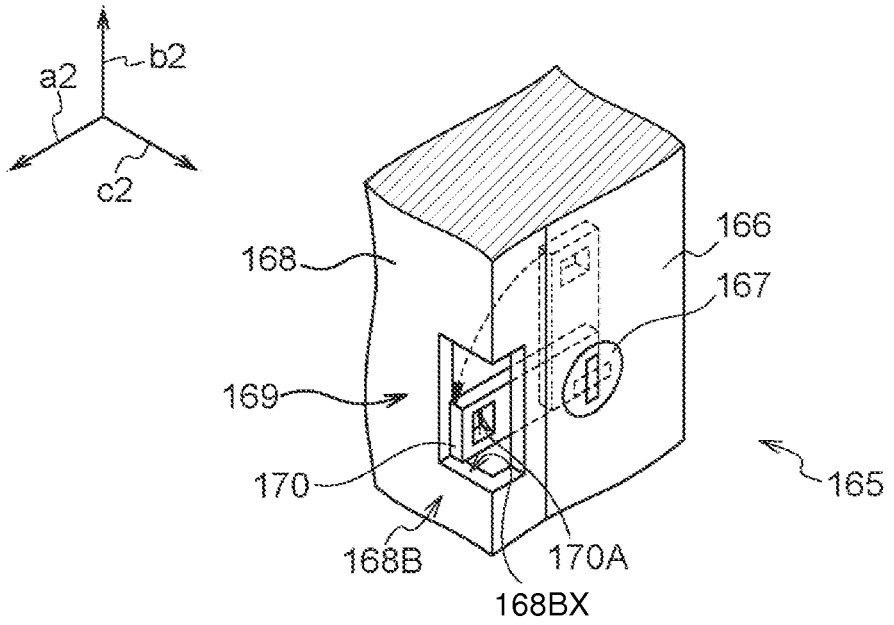
FIG. 33A is a schematic perspective view to accompany explanation of attachment of a seal to a seal attachment portion of the other embodiment (4).
Figure 33B:
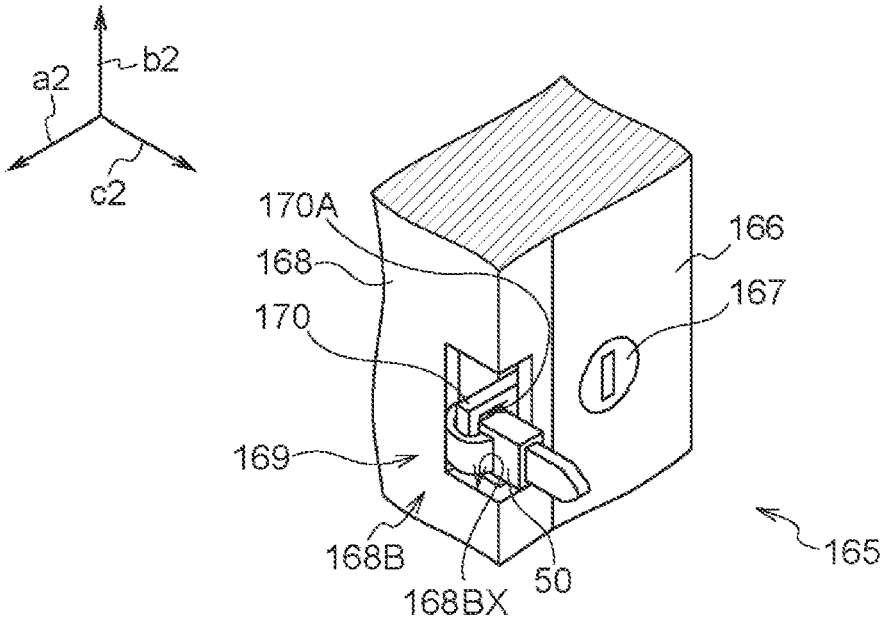
FIG. 33B is a schematic perspective view to accompany explanation of attachment of a seal to a seal attachment portion of the other embodiment (4).

Here, as illustrated in FIG. 33A and FIG. 33B, at the seal attachment portion 169, the leading end portion of the lock lever 170 facing in the storage container left direction accompanying locking of the door 166 by the lock 167 (namely the leading end portion where the band insertion hole portion 170A is provided) is exposed through the opening portion of the attachment plate exposure hole portion 168BX.

In the seal attachment portion 169, using the opening portion of the attachment plate exposure hole portion 168BX, the band portion 50A of the seal 50 is passed from the rear side of the lock lever 170 through the band insertion hole portion 170A and inserted into the hole of the head portion 50B at the front side of the lock lever 170.

In the seal attachment portion 169, the seal 50 is thereby attached to the seal attachment portion 169 such that the seal 50 is tied to the leading end portion of the lock lever 170 through the band insertion hole portion 170A.

Accordingly, in the banknote storage container 165, the seal 50 for the seal attachment portion 169 is attached for example from the opening portion of the attachment plate exposure hole portion 168BX so as to project out in the storage container front direction, thereby sealing the door 166 with respect to the outer case 168 using the seal 50.

In the present invention, according to such a configuration, for example even if an attempt were made to rotate the lock lever 170 in one rotation direction due to lock picking with the intent of improperly releasing the locking of the door 166 by the lock 167, the lock lever 170 may be rendered non-rotatable due to the seal 50 catching on the opening portion of the attachment plate exposure hole portion 168BX.

Namely, in the present invention, according to such a configuration, due to the seal 50 attached to the seal attachment portion 169, improper release of locking of the door 166 by the lock 167 such as by lock picking can be prevented.

Consequently, in the present invention, due to making such a configuration, similar advantageous effects may be obtained to the advantageous effects obtained by the first embodiment described above.

Figure 34:
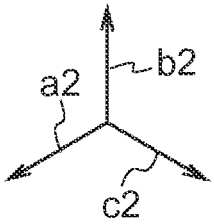
FIG. 34 is a schematic perspective view illustrating a configuration of a banknote storage container according to another embodiment (5).
Figure 34:
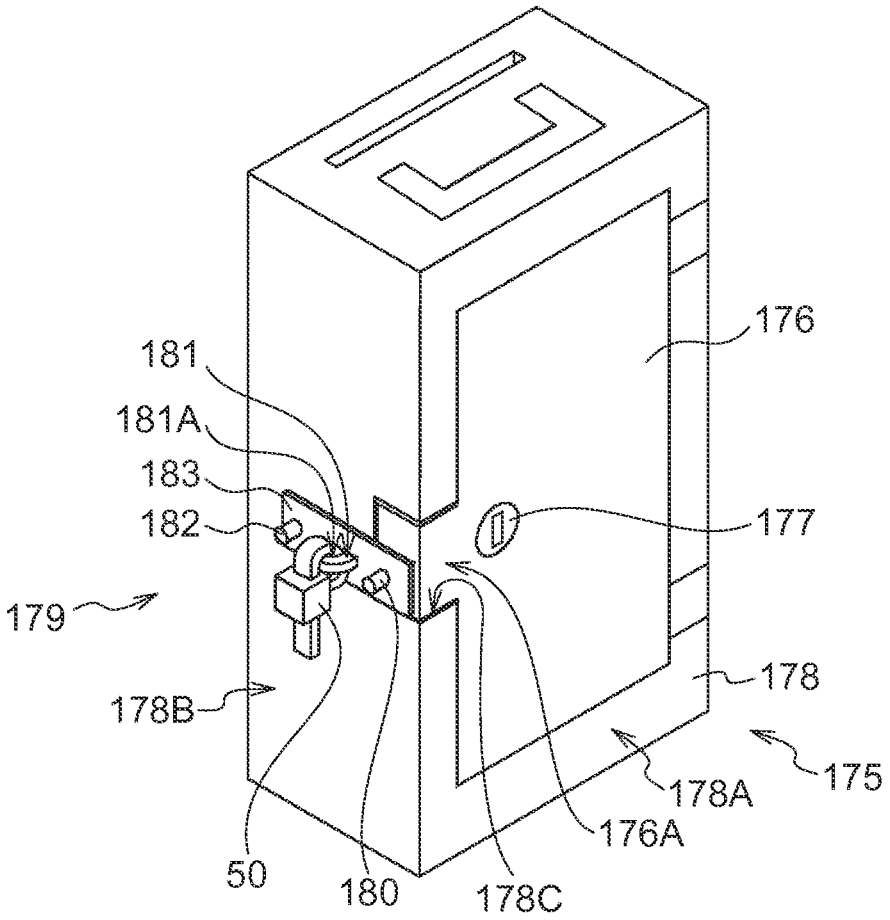
Figure 35:
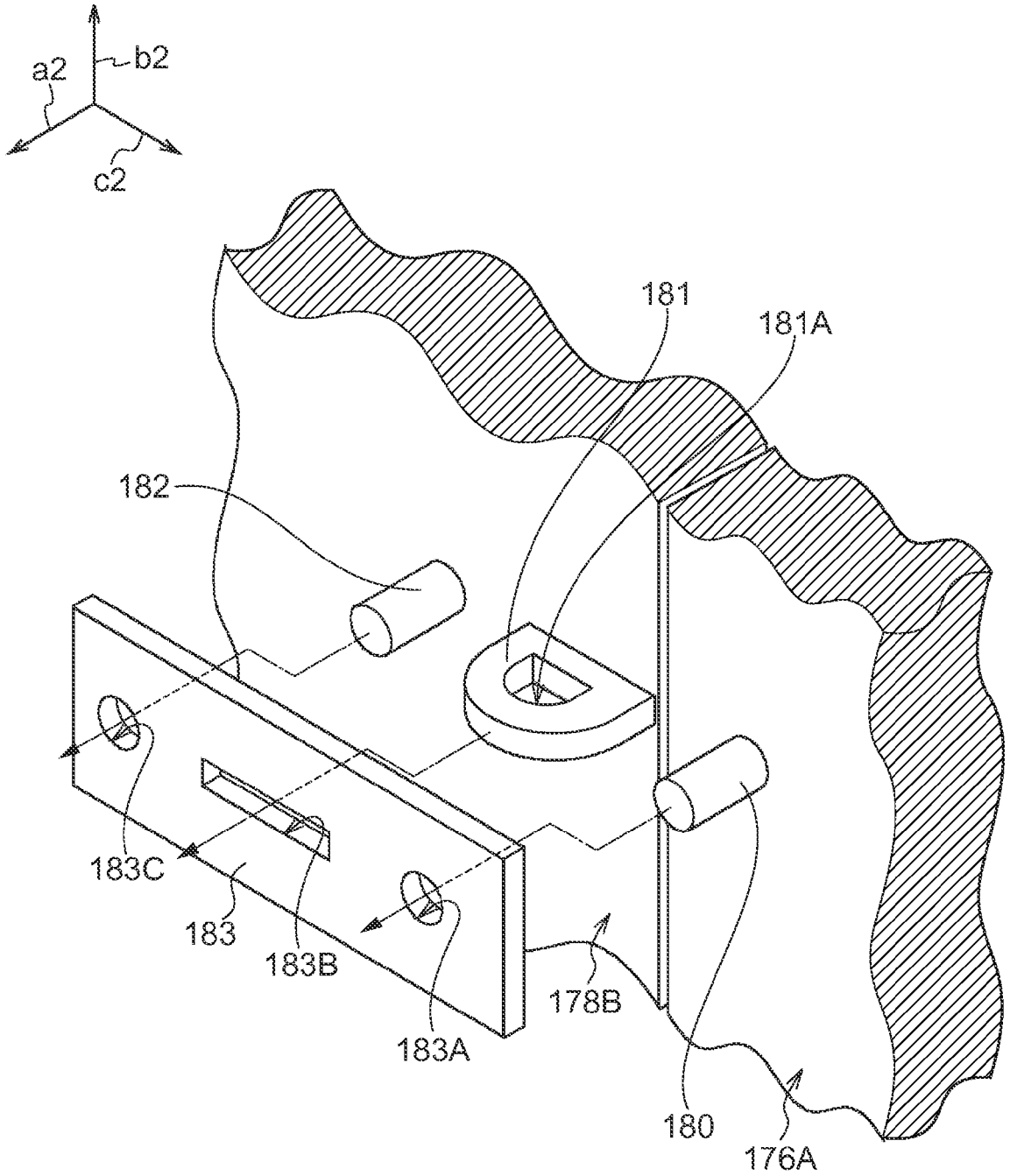
FIG. 35 is a schematic perspective view to accompany explanation of coupling together of an outer case and a door.

Explanation next follows regarding a configuration when an attachment plate is provided to the outer case out of the outer case and the door. In such cases, in the present invention for example as illustrated in FIG. 34 and FIG. 35, in a banknote storage container 175, a lock 177 may be attached to a central portion of the left side face of the door 176, and a seal attachment portion 179 provided to a central portion on a left side face of the door 176, a central portion on the left side of a case front face 178A and a central portion of a case left side face 178B.

In practice, in the seal attachment portion 179, a substantially L-plate shaped engagement plate 176A projects out in the storage container left direction at the central portion of the left side face of the door 176, and is provided with a leading end portion facing towards the storage container rear direction and with for example a circular column shaped door side coupling projection 180 projecting out orthogonally from the outside face of the leading end portion of the engagement plate 176A.

In the seal attachment portion 179, an engagement groove portion 178C is formed from a central portion of the left end of the case front face 178A of the outer case 178 to a central portion of the front end of the case left side face 178B so as to correspond to the engagement plate 176A of the door 176.

Moreover, in the seal attachment portion 179, at a central portion of the case left side face 178B of the outer case 178, at the rear side of the engagement groove portion 178C, an attachment plate 181 with a band insertion hole portion 181A and for example a circular column shaped case side coupling projection 182 are provided in sequence along the storage container rear direction and projecting out orthogonally from one face of the case left side face 178B.

Moreover, the seal attachment portion 179 also has for example a rectangular shaped coupling plate 183. In such cases, the coupling plate 183 has 3 insertion hole portions 183A to 183C provided in sequence along the length direction of the coupling plate 183 and corresponding on one face to the door side coupling projection 180, the attachment plate 181, and the case side coupling projection 182.

In the banknote storage container 175, due to such a configuration, when the door 176 is closed with respect to the outer case 178, and the engagement plate 176A is fitted into the engagement groove portion 178C, an outer face of a base end portion of the engagement plate 176A is in the same plane as the case front face 178A, and the outer face of a leading end portion of the engagement plate 176A is in the same plane as a case left side face 178B.

In this state of the seal attachment portion 179, the door side coupling projection 180, the attachment plate 181 and the case side coupling projection 182 are inserted into the corresponding respective plural insertion hole portions 183A to 183C of the coupling plate 183, and the other face of the coupling plate 183 makes contact with the outer face of the leading end portion of the engagement plate 176A and the case left side face 178B.

In the seal attachment portion 179, the outer case 178 and the door 176 are coupled together through the coupling plate 183 (namely integrated together), with the leading end of the attachment plate 181 band insertion hole portion 181A projecting out from the one face of the coupling plate 183.

Thus, in the configured seal attachment portion 179, the band portion 50A of the seal 50 is passed through the band insertion hole portion 181A of the attachment plate 181 and then inserted into the hole of the head portion 50B.

Accordingly, in the seal attachment portion 179, the seal 50 is attached to the attachment plate 181 so as to be tied through the band insertion hole portion 181A, and the door 176 is thereby sealed with respect to the outer case 178 by the seal 50.

In the present invention, according to such a configuration, for example when an attempt is made to improperly release the locking of the door 176 by the lock 177 and remove the coupling plate 183 in order to open the door 176 with respect to the outer case 178, the seal 50 functions to prevent the attachment plate 181 from being pulled out from the insertion hole portion 183B of the coupling plate 183, and therefore also functions to prevent the door side coupling projection 180 and the case side coupling projection 182 from being pulled out from the other insertion hole portions 183A and 183C, thereby enabling removal of the coupling plate 183 may be prevented.

Namely, in the present invention, according to such a configuration, even if there is an attempt to remove the coupling plate 183 from the outer case 178 and the door 176, removal of the coupling plate 183 is prevented by the seal 50 attached to the seal attachment portion 169, and locking of the door 166 may be maintained with the outer case 178 and the door 176 still integrated together.

Thus, according to the configured present invention similar advantageous effects may be obtained to the advantageous effects of the first embodiment described above.

Figure 36A:
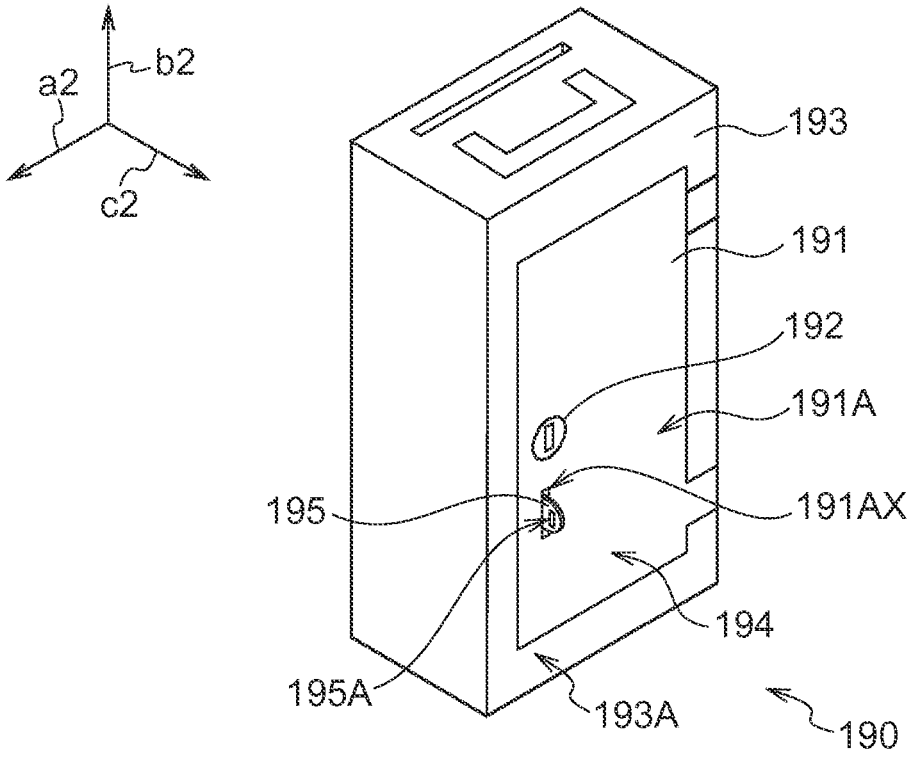
FIG. 36A is a schematic perspective view illustrating a configuration of a banknote storage container according to another embodiment (6).
Figure 36B:
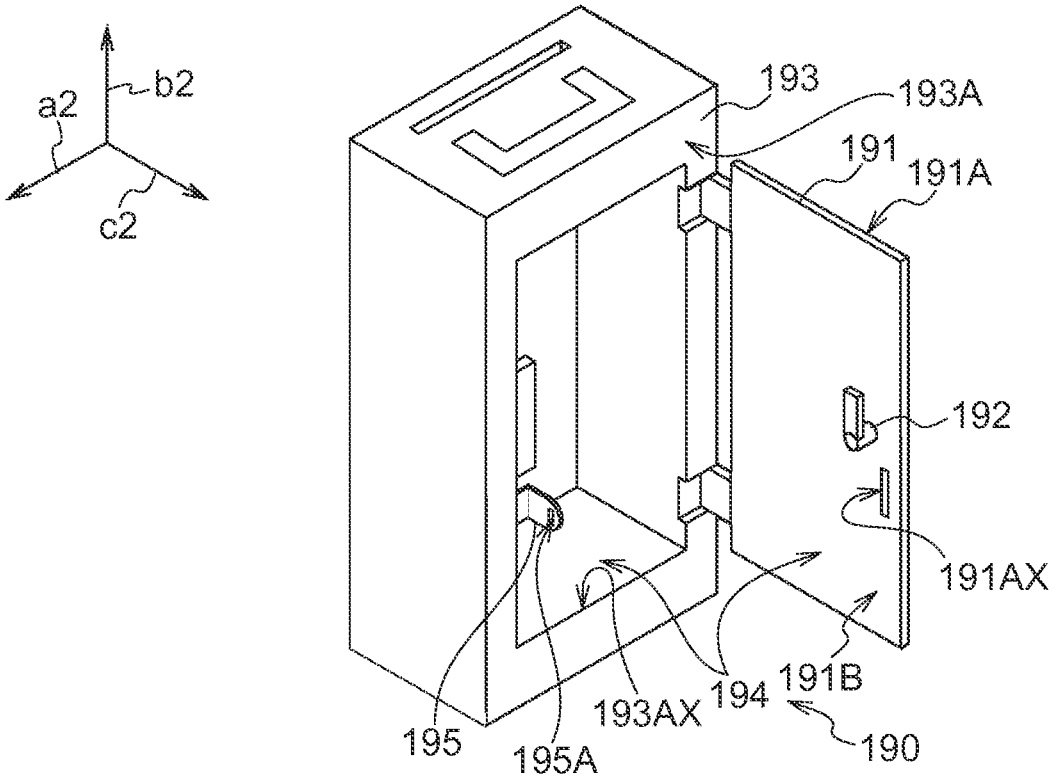
FIG. 36B is a schematic perspective view illustrating a configuration of a banknote storage container according to the other embodiment (6).

Moreover, in the present invention, for example, as illustrated in FIG. 36A and FIG. 36B, in a banknote storage container 190, a lock 192 may be attached to a left end central portion of a door 191, and a seal attachment portion 194 may be provided to the door 191 in the vicinity below the lock 192 and at a central portion towards the bottom of the left end of a case front face 193A of an outer case 193.

In such cases, in the seal attachment portion 194, a substantially L-shaped attachment plate 195 is provided to the outer case 193 towards the bottom of a central portion of the left inside wall, and the leading end portion of the attachment plate 195 is provided so as to jut out from an opening portion 193AX of the case front face 193A.

A band insertion hole portion 195A is provided in the attachment plate 195 to the portion of the leading end portion of the attachment plate 195 that juts out from the opening portion 193AX of the case front face 193A.

In the seal attachment portion 194, an attachment plate insertion hole portion 191AX is provided corresponding to the leading end portion of the attachment plate 195 towards the bottom of a central portion of the left end of a door outer face 191A of the door 191.

Due to making such a configuration, in the banknote storage container 190, when the door 191 is closed with respect to the outer case 193, the leading end portion of the attachment plate 195 passes through the attachment plate insertion hole portion 191AX from a door inner face 191B side and projects out from the door outer face 191A.

Accordingly in the seal attachment portion 194, although not specifically illustrated, at the door outer face 191A side of the door 191, the band portion 50A of the seal 50 is passed through the band insertion hole portion 195A provided in the leading end portion of the attachment plate 195, and then inserted into the hole of the head portion 50B.

Thus, in the seal attachment portion 194, the seal 50 is attached to the attachment plate 195 by tying through the band insertion hole portion 195A, such the door 191 is sealed with respect to the outer case 193 by the seal 50.

In the present invention, due to making such a configuration, for example, even if an attempt were to be made to improperly release the locking of the door 191 by the lock 192 and open the door 191, the seal 50 functions to stop the attachment plate 195 from being pulled out from the attachment plate insertion hole portion 191AX of the door 191, and opening of the door 191 may be prevented.

Namely, in the present invention, due to such a configuration, even when there is an attempt to improperly open the door 191 with respect to the outer case 193, the door 191 may be prevented from being opened by the seal 50 attached to the seal attachment portion 194, and locking can be maintained.

Thus, in the present invention, due to such a configuration, similar advantageous effects may be obtained to the advantageous effects obtained by the first embodiment described above.

Figure 37A:
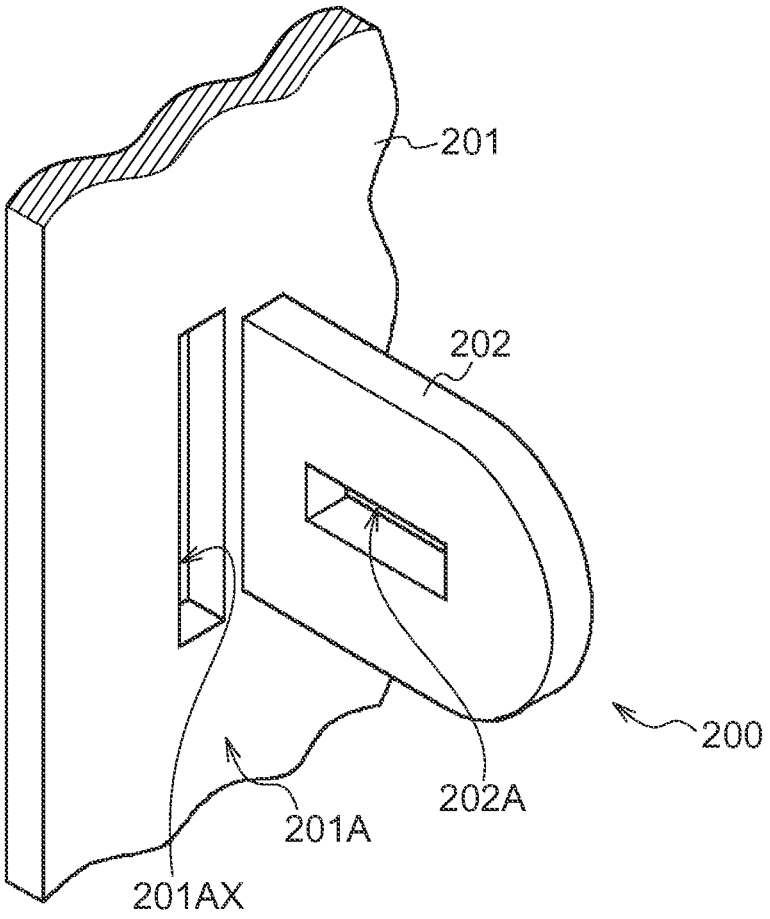
FIG. 37A is a schematic perspective view illustrating a configuration of a seal attachment portion according to the other embodiment (3).
Figure 37B:
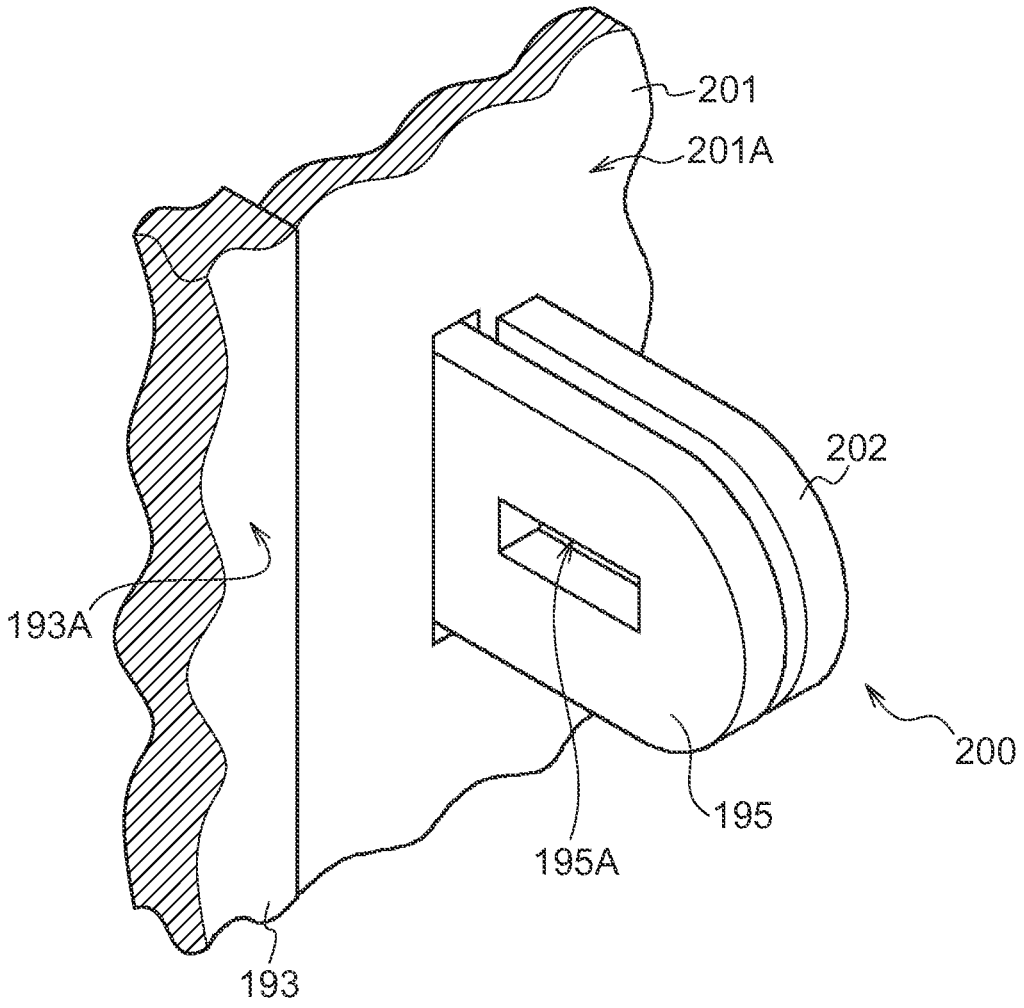
FIG. 37B is a schematic perspective view illustrating a configuration of a seal attachment portion according to the other embodiment (3).

However, in the present invention configuration may be made for example such as illustrated in FIG. 37A and FIG. 37B, in which the same reference numerals are appended to portions corresponding to FIG. 36A and FIG. 36B, with a seal attachment portion 200 provided with an attachment plate insertion hole portion 201AX provided corresponding to a leading end portion of an attachment plate (also referred to below as the case side attachment plate) 195 at a door outer face 201A of a door 201, and with an attachment plate (also referred to below as the door side attachment plate) 202 adjacent at the right (or adjacent at the left) of the attachment plate insertion hole portion 201AX.

In the present invention, there is also a band insertion hole portion 202A provided to one face of the door side attachment plate 202. Then in the present invention, the door 201 is closed with respect to the outer case 193 and the case side attachment plate 195 is passed through the attachment plate insertion hole portion 201AX of the door 201, thereby placing the case side attachment plate 195 and the door side attachment plate 202 in close proximity to each other.

Thus, in the present invention, the seal 50 is attached to the seal attachment portion 200 by passing the band portion 50A in sequence through the band insertion hole portions 195A, 202A of the case side attachment plate 195 and the door side attachment plate 202.

Namely, in the present invention, at the seal attachment portion 200, the seal 50 is attached to the seal attachment portion 200 such that the case side attachment plate 195 is tied to the door side attachment plate 202 by the seal 50 through the band insertion hole portions 202A, 195A, thereby sealing the door 201.

In the present invention, due to such a configuration, when there is an attempt to improperly open the door 201, opening of the door 201 may be prevented and locking may be maintained due to the seal 50 attached to the seal attachment portion 200. Thus similar advantageous effects can be obtained to the advantageous effects obtained by the first embodiment described above.

Note that, in the present invention, it is not necessary to provide an attachment plate so as to jut out from an opening portion with respect to the outer case, and for example, a groove portion may be formed at a central portion of the left end of the case front face of the outer case with a flat plate shaped attachment plate projecting out orthogonally from the bottom of the groove portion.

In the present invention, depending on the configuration of the outer case, a projection plate may be provided corresponding to the groove portion of the outer case (namely capable of fitting together with the groove portion) at a central portion of a left side face of the door, and an attachment plate insertion hole portion provided to the projection plate for the attachment plate to pass through.

Namely, in the present invention, the outer case may be configured for example with an attachment plate provided to a comparatively robustly formed portion where a lock plate is provided in the vicinity of the lock lever of a lock provided at a central portion of a left end of the door.

(4-4) Other Embodiment 4

Moreover, in the first embodiment described above, explanation has been given of a case in which a seal housing groove portion 55D for housing the seal 50 is provided to the outer case 55 in the auxiliary storage container 24.

However, the present invention is not limited thereto, and configuration may be made with a seal housing groove portion 55D provided in the outer case 55 of the auxiliary storage container 24, and a slide-off prevention portion provided to stop the seal 50 housed therein from sliding off from the seal housing groove portion 55D.

Figure 38:
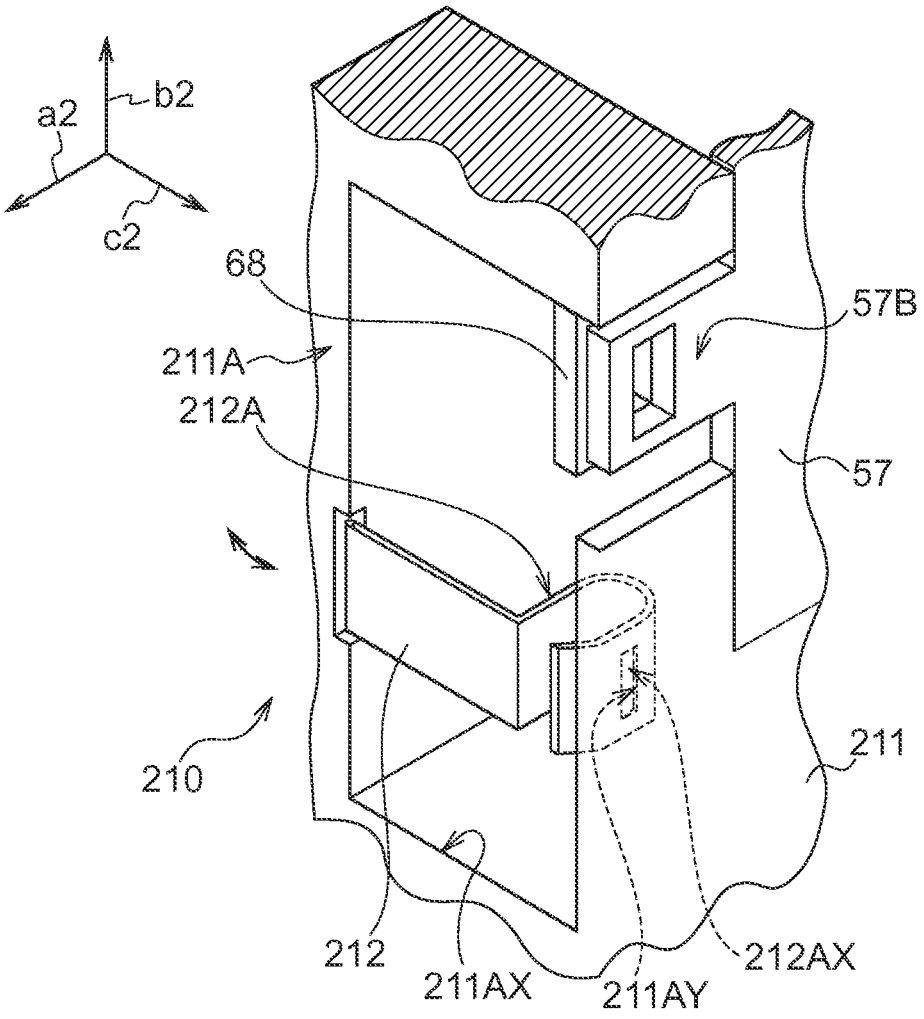
FIG. 38 is a schematic perspective view illustrating a configuration of a seal attachment portion according to the other embodiment (4).

In such a case, in the present invention, a seal attachment portion is for example configured as illustrated in FIG. 38, in which the same reference numerals are appended to portions corresponding to FIG. 10.

Thus, in a configured seal attachment portion 210, a seal housing groove portion 211AX is formed to a case left side face 211A of an outer case 211 similarly to the auxiliary storage container 24.

In the seal attachment portion 210, a long narrow plate shaped slide-off prevention lever 212 is provided as a slide-off prevention portion to an opening portion of the seal housing groove portion 211AX.

Namely, in the outer case 211, a rotate shaft is supported so as to be capable of rotating parallel to the storage container up direction at a specific position at a rear edge of the opening portion of the seal housing groove portion 211AX.

One end portion of the slide-off prevention lever 212 is then attached to the rotate shaft. The slide-off prevention lever 212 is thereby capable of rotating about the rotate shaft in a contact direction such that the other end portion makes contact with the inner wall of the front side of the seal housing groove portion 211AX, or in a separation direction, that is the opposite direction, in which the other end portion moves away from the inner wall of the front side.

There is also a resilient curved portion 212A formed at the other end portion of the slide-off prevention lever 212, so as to curve around with a substantially U-shaped edge, with the convex face of the curved portion 212A facing towards the seal housing groove portion 211AX.

Note that, in the following explanation, one end side of the slide-off prevention lever 212 at the curved portion 212A of the slide-off prevention lever 212 is referred to as the base portion, and the other end side is referred to as the leading end portion.

Moreover, in the curved portion 212A of the slide-off prevention lever 212, a specific position on the leading end portion curves around further towards the base side, and an anchor protrusion portion 212AX is provided on the convex face towards the leading end.

In the seal housing groove portion 211AX of the outer case 211, an anchor indent portion 211AY is also formed in the inner face of the front side corresponding to the anchor protrusion portion 212AX of the slide-off prevention lever 212.

Thus, in the seal attachment portion 210, when a seal, not illustrated in the drawings, is attached in the closed state of the door 57 with respect to the outer case 211, the seal is housed in the seal housing groove portion 211AX, and then the slide-off prevention lever 212 is manipulated so as to rotate the slide-off prevention lever 212 and to press the curved portion 212A into the seal housing groove portion 211AX.

Accordingly, in the seal attachment portion 210, in a state in which the surface of the one end portion of the slide-off prevention lever 212 and the leading end of the curved portion 212A are placed in the same plane as the case left side face, or a state slightly inside the seal housing groove portion 211AX, the anchor protrusion portion 212AX is anchored to the anchor indent portion 211AY of the seal housing groove portion 211AX by the resilience of the curved portion 212A.

Thus, in the seal attachment portion 210, the opening portion of the seal housing groove portion 211AX is partially closed off by the slide-off prevention lever 212, thereby enabling the seal to be prevented from sliding off from the seal housing groove portion 211AX.

Moreover, in the seal attachment portion 210, for example when legitimately removing the seal, a member of staff presses the rear side of the leading end portion of the curved portion 212A of the slide-off prevention lever 212 to easily remove the anchor protrusion portion 212AX from the anchor indent portion 211AY of the seal housing groove portion 211AX, and then in that state manipulates to rotate the slide-off prevention lever 212 in the separation direction.

Thus, in the seal attachment portion 210, a member of staff is readily able to pull the seal out from the seal housing groove portion 211AX to destroy the seal.

In the present invention, due to making such a configuration, the seal may be prevented from sliding out of the seal housing groove portion 211AX and getting in the way when mounting or demounting the auxiliary storage container to the lower portion unit 14, or when transporting the auxiliary storage container.

Figure 39:
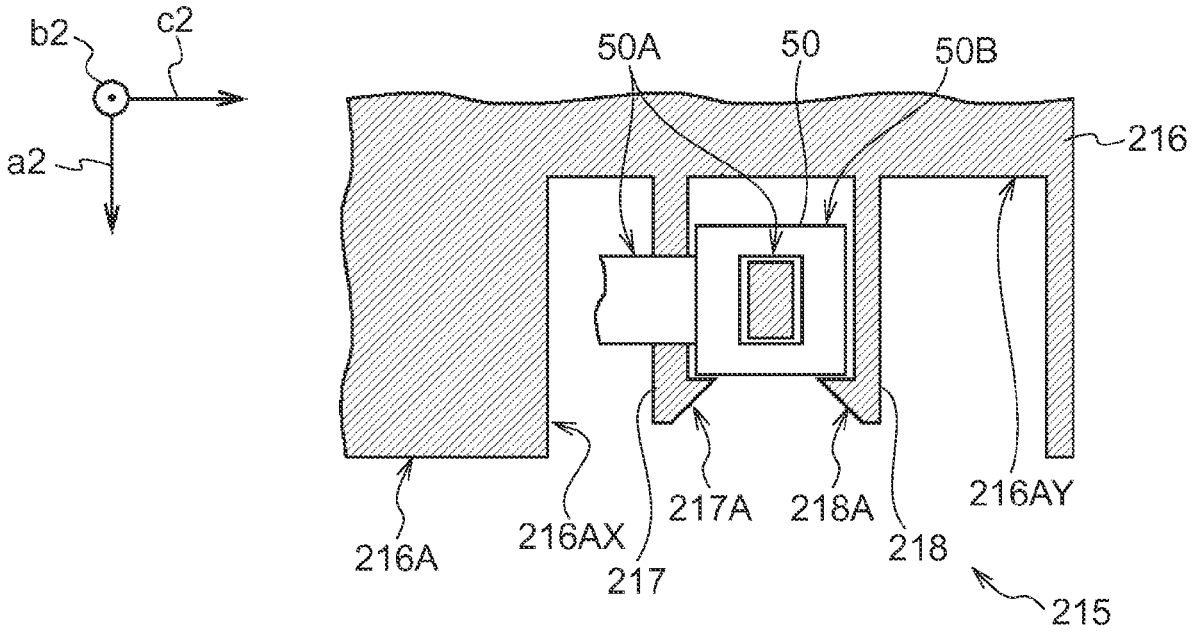
FIG. 39 is a schematic cross-section illustrating a configuration of a seal attachment portion according to the other embodiment (5).

In the present invention, a seal attachment portion may for example be configured as illustrated in FIG. 39. In a seal attachment portion 215 of such a configuration, a seal housing groove portion 216AX is formed to a case left side face 216A of an outer case 216 similarly to the auxiliary storage container 24.

In the seal attachment portion 215, a bottom face 216AY (namely the face facing towards the storage container left direction) of the seal housing groove portion 216AX is provided by way of a slide-off prevention portion with a pair of resilient slide-off prevention arms 217, 218 that project out orthogonally at a separation corresponding to the width of the head portion 50B of the seal 50.

Claw portions 217A, 218A are provided to the leading end portions of the pair of slide-off prevention arms 217, 218, projecting out to face each other so that the separation between the pair of slide-off prevention arms 217, 218 is locally narrowed.

Then in the seal attachment portion 215, in a closed state of the door with respect to the outer case 216, when the seal 50 has been attached and housed in the seal housing groove portion 216AX, the head portion 50B of the seal 50 is pressed by the claw portions 217A, 218A of the pair of slide-off prevention arms 217, 218.

Accordingly, in the seal attachment portion 215, by temporarily pushing apart the claw portions 217A, 218A of the pair of slide-off prevention arms 217, 218 with the head portion 50B of the seal 50, the head portion 50B is fitted in between the pair of slide-off prevention arms 217, 218 to the far side of the claw portions 217A, 218A.

Thus, in the configured seal attachment portion 215, the head portion 50B of the seal 50 is held so as to be enveloped at a portion to the far side of the claw portions 217A, 218A between the pair of slide-off prevention arms 217, 218, enabling the seal 50 to be prevented from sliding off from the seal housing groove portion 216AX.

Moreover, in the seal attachment portion 215, when legitimately removing the seal 50, for example a member of staff temporarily pushes apart the claw portions 217A, 218A of the pair of slide-off prevention arms 217, 218 with their fingers, and pulls the head portion 50B of the seal 50 out from between the pair of slide-off prevention arms 217, 218.

Accordingly, in the seal attachment portion 210, the seal 50 may accordingly be easily pulled out from the seal housing groove portion 216AX and destroyed by the member of staff.

In the present invention, due to such a configuration, when mounting or demounting the auxiliary storage container to the lower portion unit 14, or when transporting the auxiliary storage container, the seal may be prevented from sliding off the seal housing groove portion 216AX and getting in the way.

Figure 40:
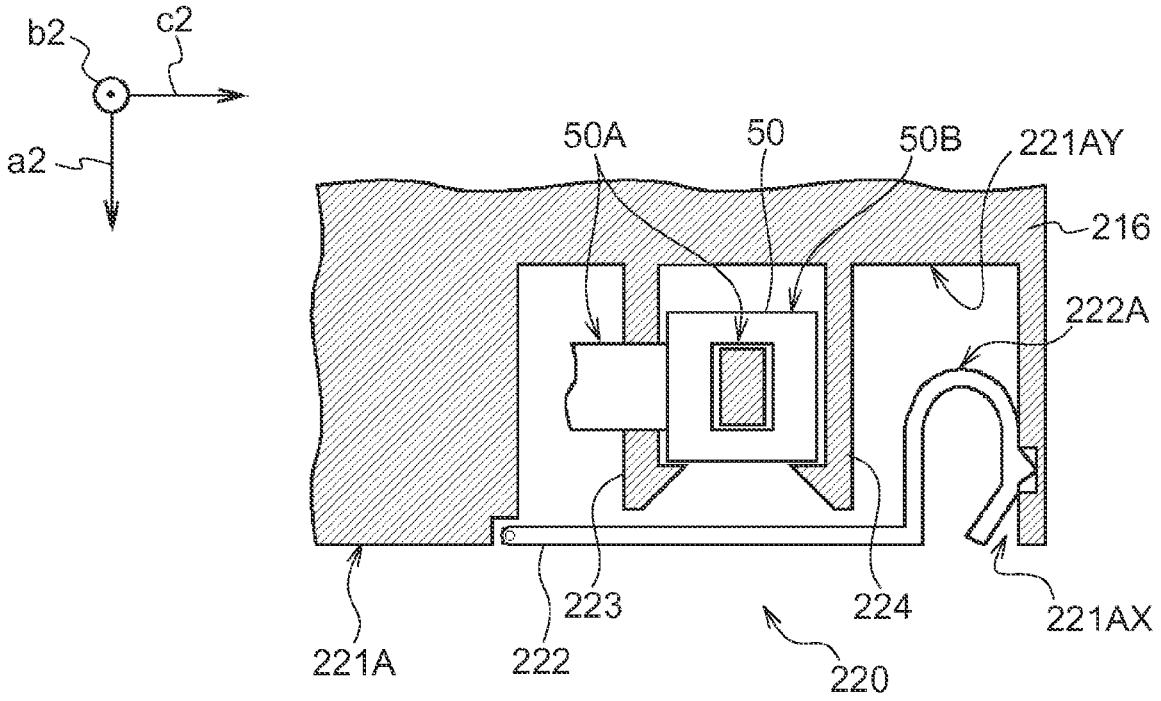
FIG. 40 is a schematic cross-section illustrating a configuration of a seal attachment portion according to the other embodiment (6).

In the present invention, the seal attachment portion may, for example as illustrated in FIG. 40, be configured by a combination of the configuration of the seal attachment portion 210 illustrated in FIG. 38 and the configuration of the seal attachment portion 215 illustrated in FIG. 39.

Namely, in a seal attachment portion 220 configured in this manner, a seal housing groove portion 221AX is formed to the case left side face 211A of the outer case 221 similarly to in the auxiliary storage container 24.

In the seal attachment portion 220 there is also a slide-off prevention lever 222 attached as a slide-off prevention portion to an opening portion of the seal housing groove portion 221AX so as to be capable as rotating, similarly to the seal attachment portion 210 illustrated in FIG. 38.

In the seal attachment portion 220, similarly to in the seal attachment portion 215 illustrated in FIG. 39, there are a pair of slide-off prevention arms 223, 224 serving as slide-off prevention portions provided projecting out orthogonally at a bottom face 22 1AY of the seal housing groove portion 221AX.

Thus, in the seal attachment portion 220, when the seal 50 is attached and housed in the seal housing groove portion 221AX in the closed state of a door with respect to an outer case 221, similarly to as described above, the head portion 50B of the seal 50 is fitted in between the pair of slide-off prevention arms 223, 224.

Then, in the seal attachment portion 220, similarly to as described above, a curved portion 222A is manipulated to rotate the slide-off prevention lever 222 in a contact direction and pressed into the seal housing groove portion 221AX.

In the present invention, due to such a configuration, when mounting or demounting the auxiliary storage container to the lower portion unit 14, or when transporting the auxiliary storage container, the seal 50 may be prevented from sliding out of the seal housing groove portion 221AX and getting in the way.

(4-5) Other Embodiment 5

In the first embodiment as described above, explanation has been given of a case in which the seal 50 is attached as a zip tie to the seal attachment portions 46, 65 to 67 of the banknote storage containers 20 to 23 and the auxiliary storage container 24.

Figure 41A:
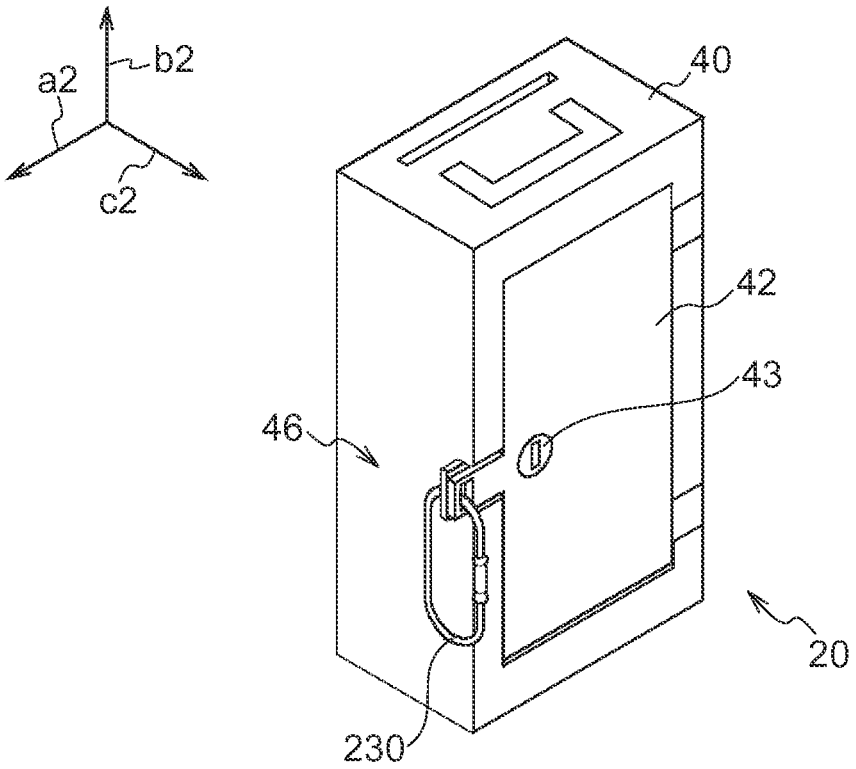
FIG. 41A is a schematic perspective view illustrating a configuration of a seal according to another embodiment.
Figure 41B:
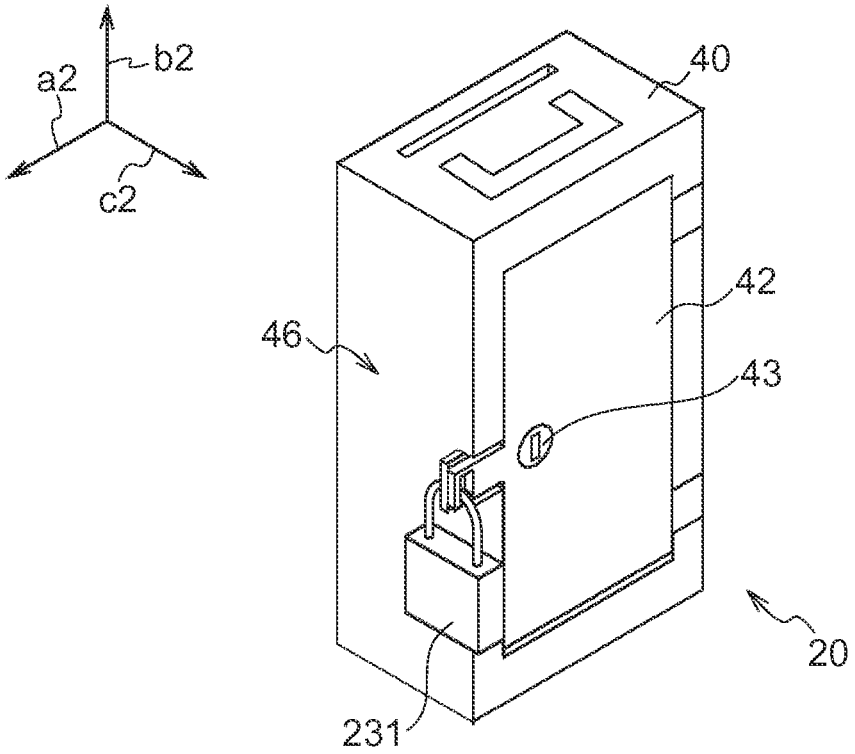
FIG. 41B is a schematic perspective view illustrating a configuration of a seal according to another embodiment.

However, the present invention is not limited thereto, and for example, as illustrated in FIG. 41A to FIG. 41B, in which the same reference numerals have been appended for portions corresponding to those of FIG. 6A, configuration may be made such that a seal 230 that is configured by a ring shaped wire with one end joined to the other end through a sleeve, or a seal 231 configured by a padlock, is attached to a seal attachment portion 46 of the banknote storage container 20.

Moreover, in the present invention, for example, the seal 231 configured by a padlock may be attached to the seal attachment portions 46, 65 to 67 together with the seal 50 configured by a zip tie or the seal 230 that is configured by a ring shaped wire with one end joined to the other end through a sleeve so as to achieve a double attachment.

Moreover, in the present invention, the seal 230 that is configured by a ring shaped wire with one end joined to the other end through a sleeve may also be attached to the seal attachment portion 127 of the banknote storage containers 112 to 115 according to the third embodiment described above.

The present invention with such a configuration is also able to respectively seal the door 42, 57 to 59, 122 with respect to the outer case 40, 55, 120 by the seal 230, 231 attached to the seal attachment portion 46, 127, 65 to 67. Similar advantageous effects may accordingly be obtained to the advantageous effects of the first and the third embodiments described above.

(4-6) Other Embodiments 6

Moreover, explanation has been given in the first embodiment of a case in which the outer cases of the banknote storage containers 20 to 23 are formed in substantially rectangular box shapes.

Figure 42:
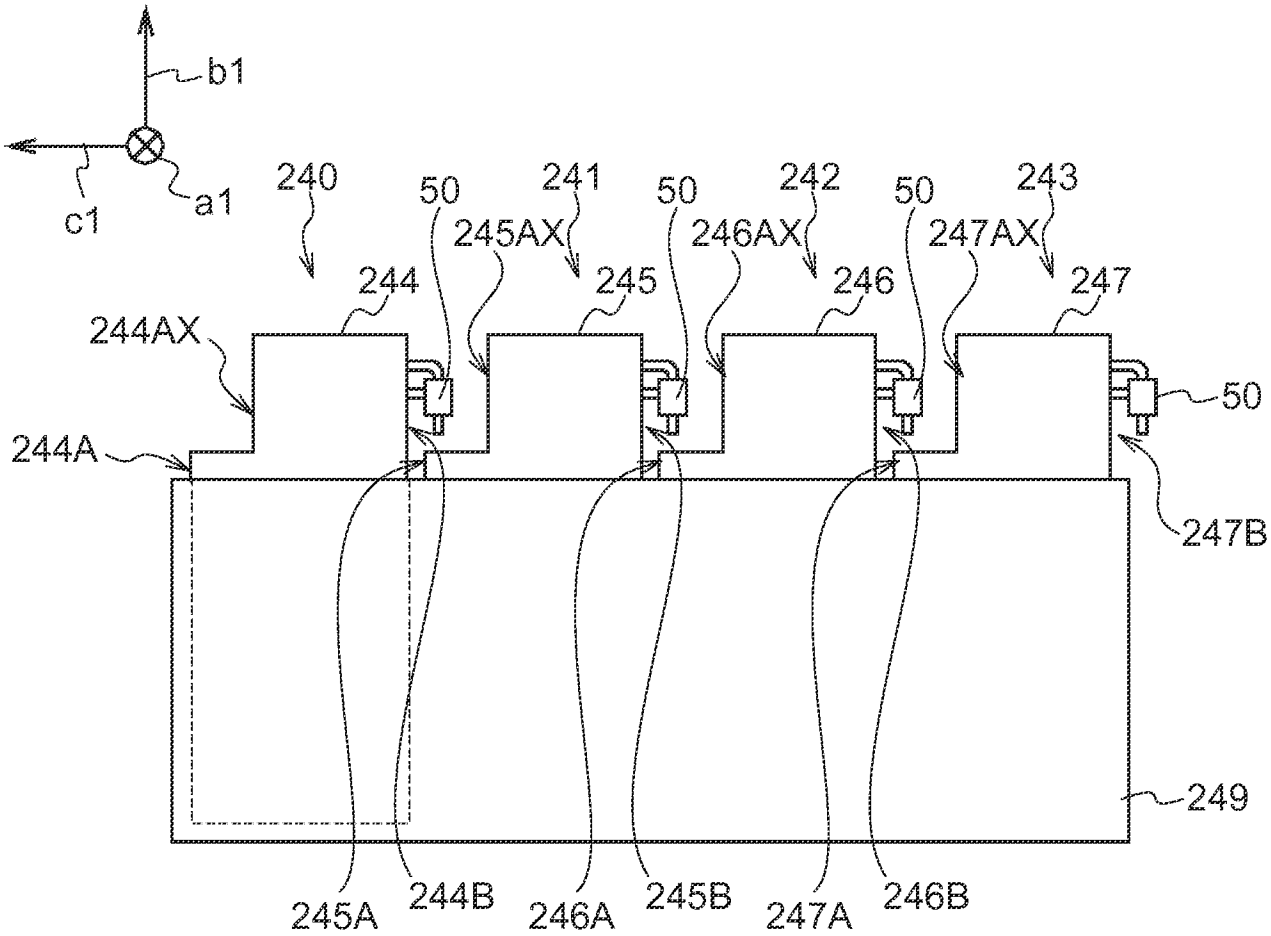
FIG. 42 is a schematic side view illustrating a configuration of an outer case of a banknote storage container according to another embodiment.

However, the present invention is not limited thereto, and for example for the banknote storage container 154 as described above with reference to FIG. 31A and FIG. 31B, in cases in which the seal attachment portion 158 is provided at a left upper end portion of a door 155 and a left upper end portion of a case front face 157A of an outer case 157, as illustrated in FIG. 42, in plural banknote storage containers 240 to 243, indent portions 244AX to 247AX may be formed to respective upper end portions of case back faces 244A to 247A of respective rectangular box shaped outer cases 244 to 247.

In the present invention, due to such a configuration, when disposing the plural banknote storage containers 240 to 243 sequentially from front to back in a row in a unit housing 249 of a lower portion unit, the seals 50 attached to the seal attachment portions of the outer cases 244 to 246 in the vicinity of the front side can be positioned in the indent portions 245AX to 247AX of the outer cases 245 to 247.

Thus, in the present invention, due to such a configuration, even though the seals 50 attached to seal attachment portions in the plural banknote storage containers 240 to 243 project out towards the front from the case front faces 244B to 247B, the plural banknote storage containers 240 to 243 may still be placed in the unit housing 249 in front-rear close proximity to each other, enabling an increase in the front-rear length of the unit housing 249 to be avoided.

(4-7) Other Embodiment 7

Moreover in the first embodiment described above, explanation has been given of a case in which a unit housing 32 is provided in which the rail placement plate 32AX is provided at a top edge of the unit housing left side plate 32A and the height of the unit housing right side plate 32B is formed lower than the height of the unit housing left side plate 32A in the lower portion unit 14.

Figure 43:
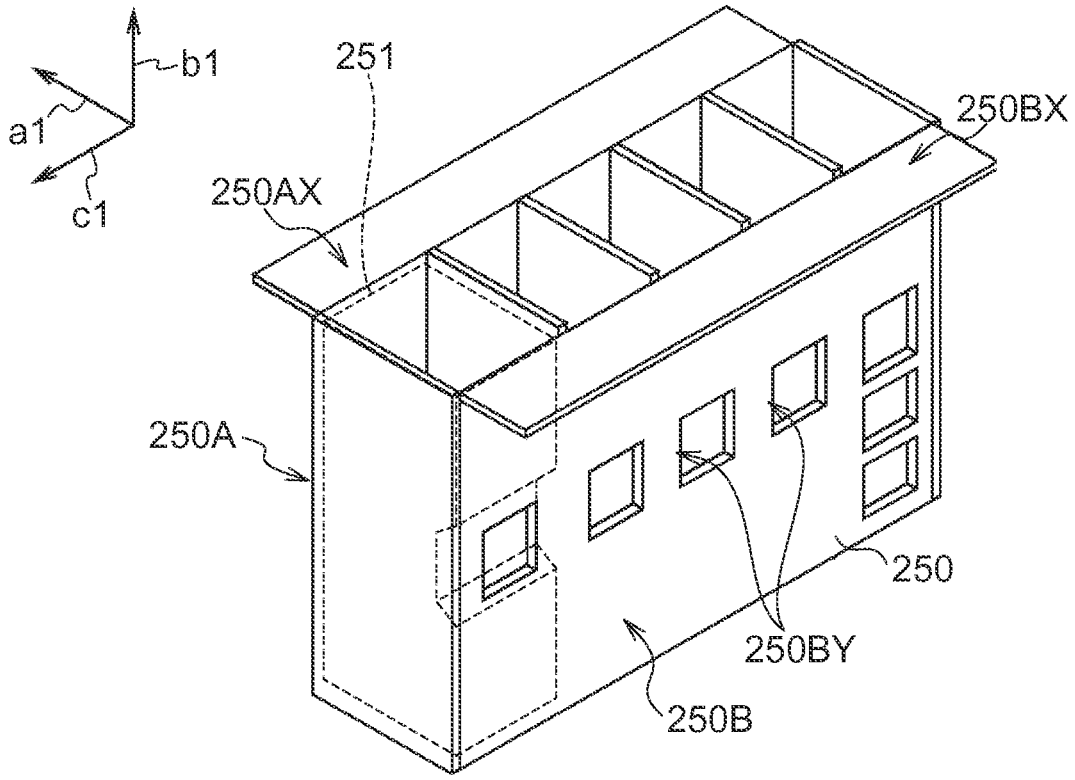
FIG. 43 is a schematic perspective view illustrating a configuration of a unit housing of a lower portion unit according to the other embodiment (1).

However, the present invention is not limited thereto, and for example as illustrated in FIG. 43, configuration may be made provided with a unit housing 250 wherein a lower portion unit is formed with a unit housing left side plate 250A and a unit housing right side plate 250B that are respectively formed at substantially the same height as the height of a banknote storage container 251, and rail placement plates 250AX, 250BX are respectively provided to upper ends of the unit housing left side plate 250A and the unit housing right side plate 250B.

Figure 44:
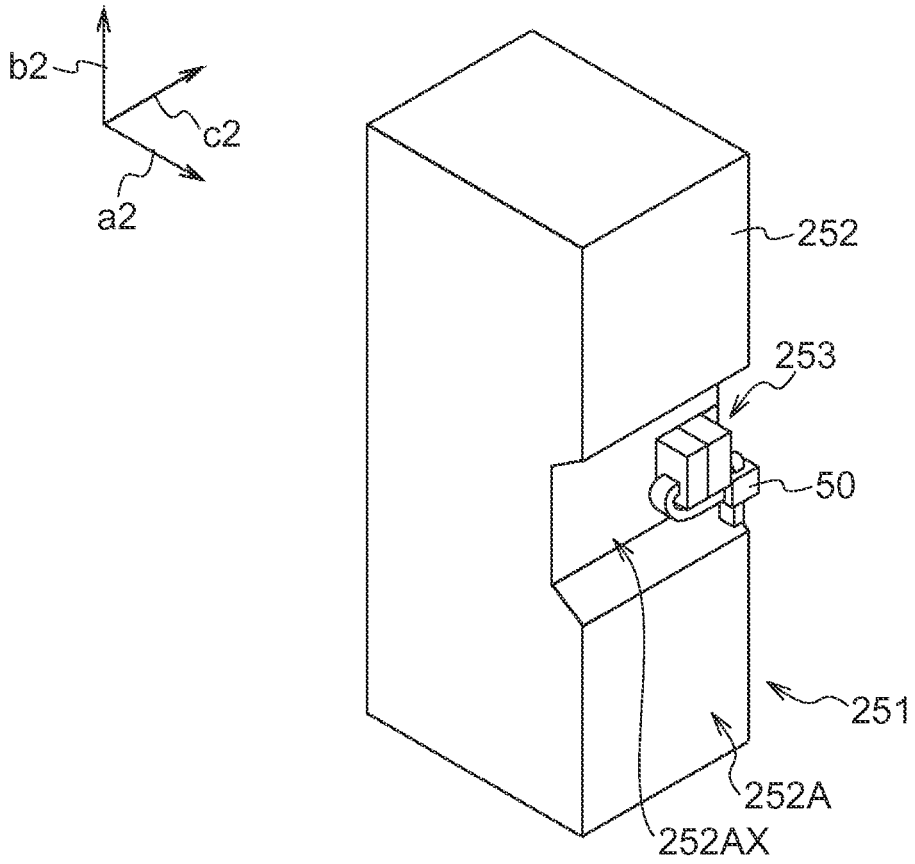
FIG. 44 is a schematic perspective view illustrating a configuration of a banknote storage container according to another embodiment (7).

In the present invention, when the thus configured unit housing 250 is provided to the lower portion unit, for example as illustrated in FIG. 44, configuration may be made with an outer case 252 of a banknote storage container 251 formed in a substantially rectangular box shaped, with an indent portion 252AX provided to a case left side face 252A. This indentation portion is then employed to attach the seal 50 to a seal attachment portion 253 without projecting out further than the case left side face 252A.

Accordingly, in the present invention, in cases in which the unit housing 250 is provided to a lower portion unit as illustrated in FIG. 43, even though the placement separation of the unit housing left side plate 250A and the unit housing right side plate 250B in the unit housing 250 is made substantially the same as the width of the banknote storage container 251 (namely the left-right length of the outer case 252), the plural banknote storage containers 251 can still be placed in sequence in a row from front to rear. Namely, the present invention may avoid an increased width direction bulkiness of the unit housing 250 of the lower portion unit.

In the present invention, in the thus configured unit housing 250 (FIG. 43), configuration may be made such that plural window portions 250BY are formed in a front-rear row on the surface of the unit housing right side plate 250B to correspond to the seal attachment portions 253 of the plural banknote storage containers 251 disposed inside the unit housing 250.

Moreover, in the present invention, configuration may be made with plural window portions 250BY formed in a top-bottom row on the surface of the unit housing right side plate 250B of the unit housing 250 so as to correspond to the plural seal attachment portions 65 to 67 of the auxiliary storage container 24.

Note that, in the present invention, configuration may be made with a long single window portion formed front-to-rear on the surface of the unit housing right side plate 250B of the unit housing 250 to enable visibility of the seal attachment portions 253 of the plural banknote storage containers 251 all at once, and a long single window portion formed up-down to enable visibility of the plural seal attachment portions 65 to 67 of the auxiliary storage container 24 all at once.

In the present invention, due to such a configuration, when pulling out the lower portion unit from the main frame, the presence or absence of damage to the seals 50 may be established through the window portions 250BY prior to taking the banknote storage containers 251 out from the unit housing 250.

(4-8) Other Embodiment 8

Furthermore, explanation has been given in the first to third embodiments described above of cases in which the processing unit lower side conveyance section 27 is open-closable attached to the rail placement plate 32AX at the upper edge of the unit housing left side plate 32A or to the rail placement plate 80AX at the upper edge of the unit housing right side plate 80A in the unit housing 32, 80 of the lower portion unit 14, 72.

Figure 45:
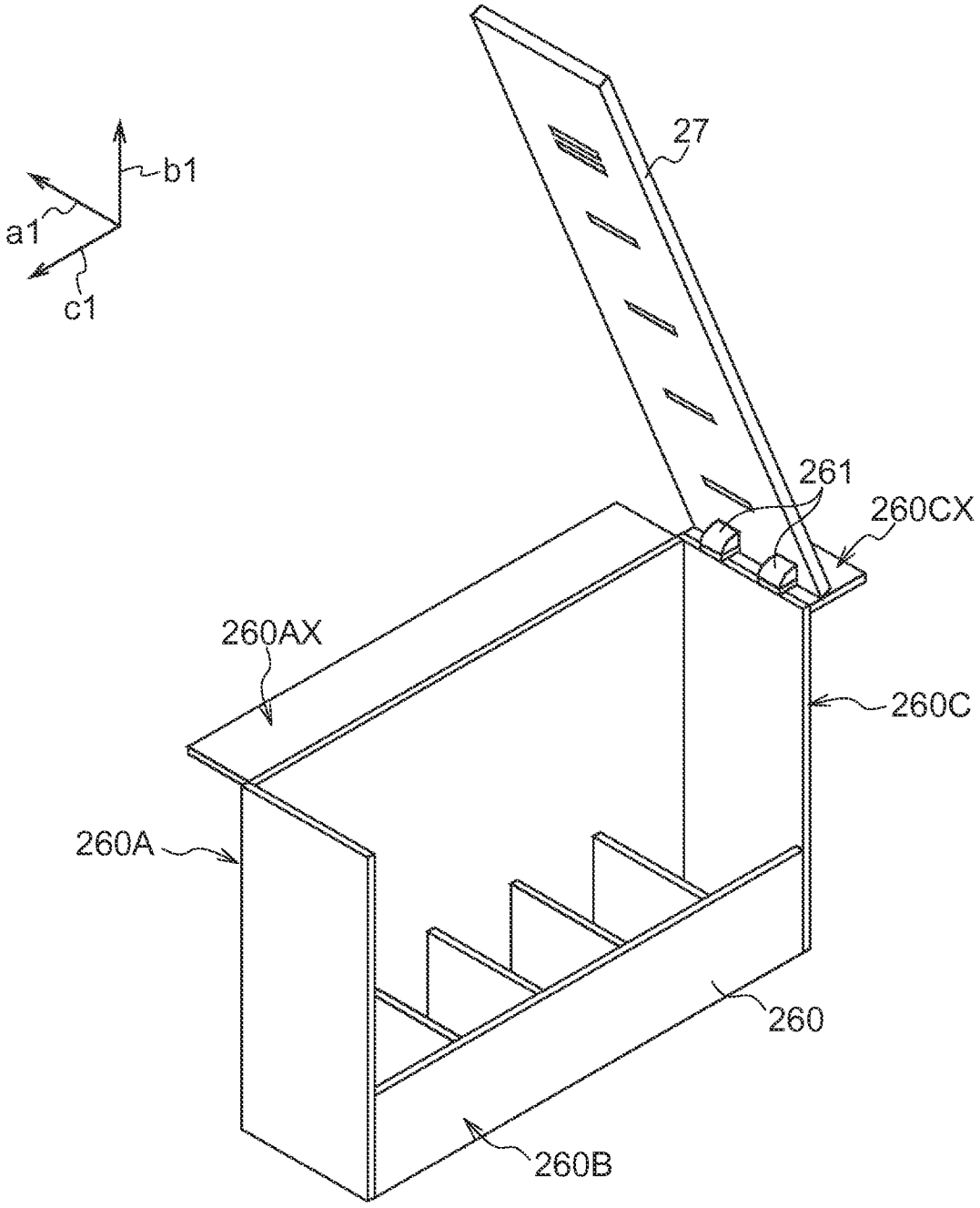
FIG. 45 is a schematic perspective view illustrating a configuration of a unit housing of a lower portion unit of the other embodiment (2).

However the present invention is not limited thereto, and for example, as illustrated in FIG. 45, in a unit housing 260 of a lower portion unit, configuration may be made with a rail placement plate 260AX provided to an upper edge of a unit housing left side plate 260A, with the height of a unit housing right side plate 260B formed lower than the height of the unit housing left side plate 260A, and with a conveying portion attachment plate 260CX further provided at an upper edge of a rear plate 260C.

The present invention may be configured such that in the unit housing 260 the processing unit lower side conveyance section 27 is open-closable attached to the conveying portion attachment plate 260CX through 2 left and right hinge portions 261 (namely about hinge axes that are parallel to the teller machine left direction).

Figure 46:
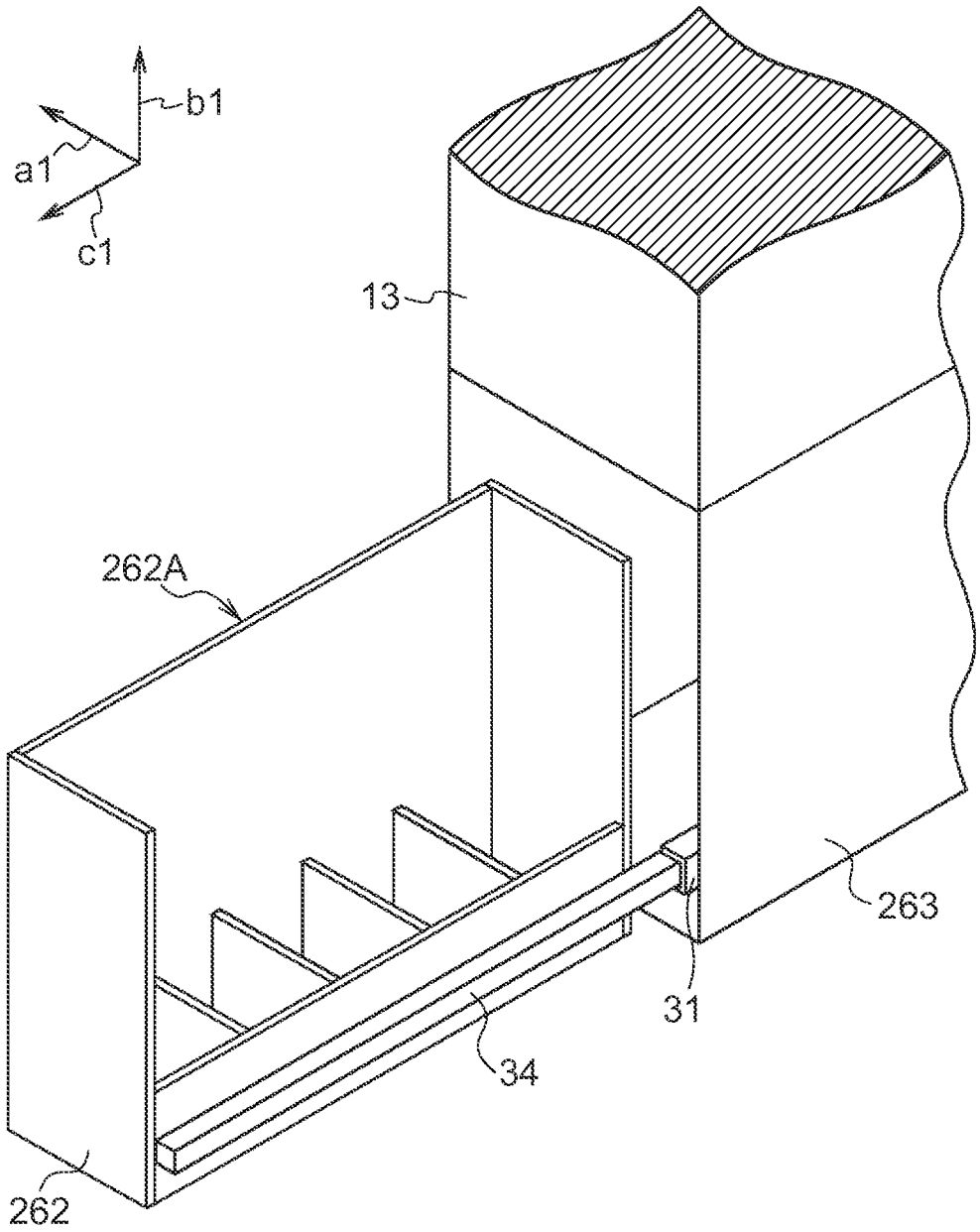
FIG. 46 is a schematic perspective view illustrating a configuration of a lower portion unit according to another embodiment.

Moreover, in the present invention, for example as illustrated in FIG. 46, in which the same reference numerals are appended as to corresponding portions in FIG. 5, a unit housing 262 of the lower portion unit is configured without provision of a rail placement plate at the upper edge of a unit housing left side plate 262A.

In the present invention, configuration may be made with the processing unit lower side conveyance section 27 fixed to an upper edge portion of a main frame 263, and with only the unit housing 262 pulled out as the lower portion unit from the main frame 263 or housed therein.

(4-9) Other Embodiment 9

Moreover, explanation has been given in the first to the third embodiment described above of a case in which a paper sheet storage container of the present invention is applied to the banknote storage containers 20 to 23, 73 to 76, 112 to 115 and the auxiliary storage container 24 provided to the automatic teller machine 1, 70, 110 described above with reference to FIG. 1 to FIG. 47.

Figure 47:
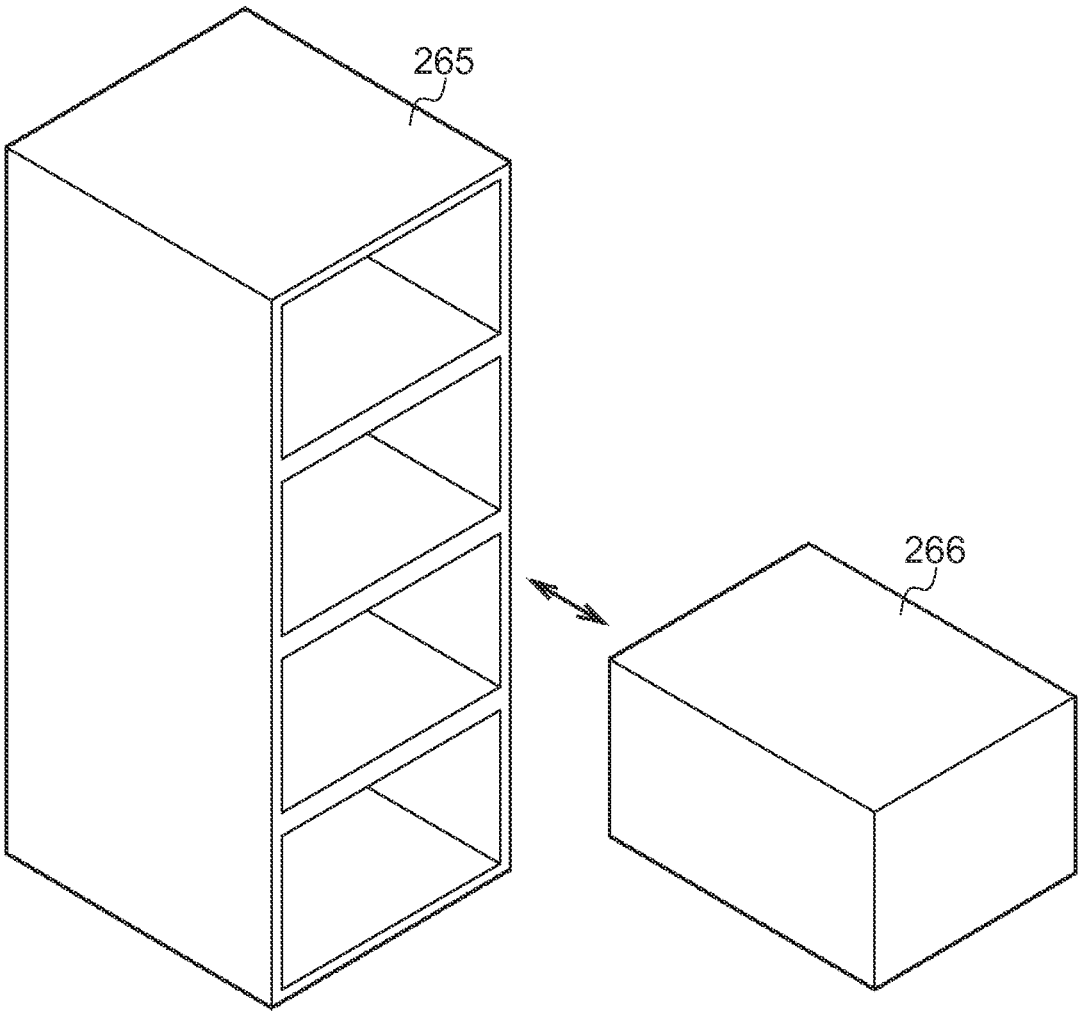
FIG. 47 is a schematic perspective view illustrating a configuration of a storage container placement casing of another embodiment.
Figure 48:
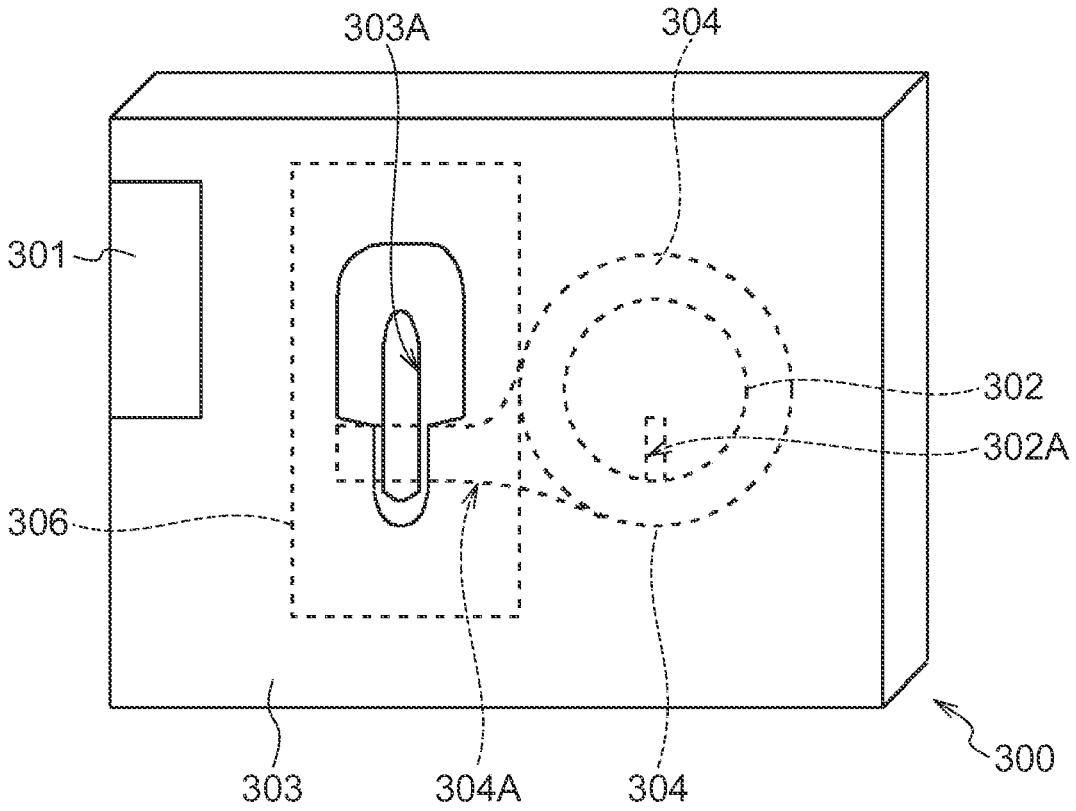
FIG. 48 is a schematic perspective view illustrating a configuration of a lock section provided to a conventional banknote storage container (1).
Figure 49:
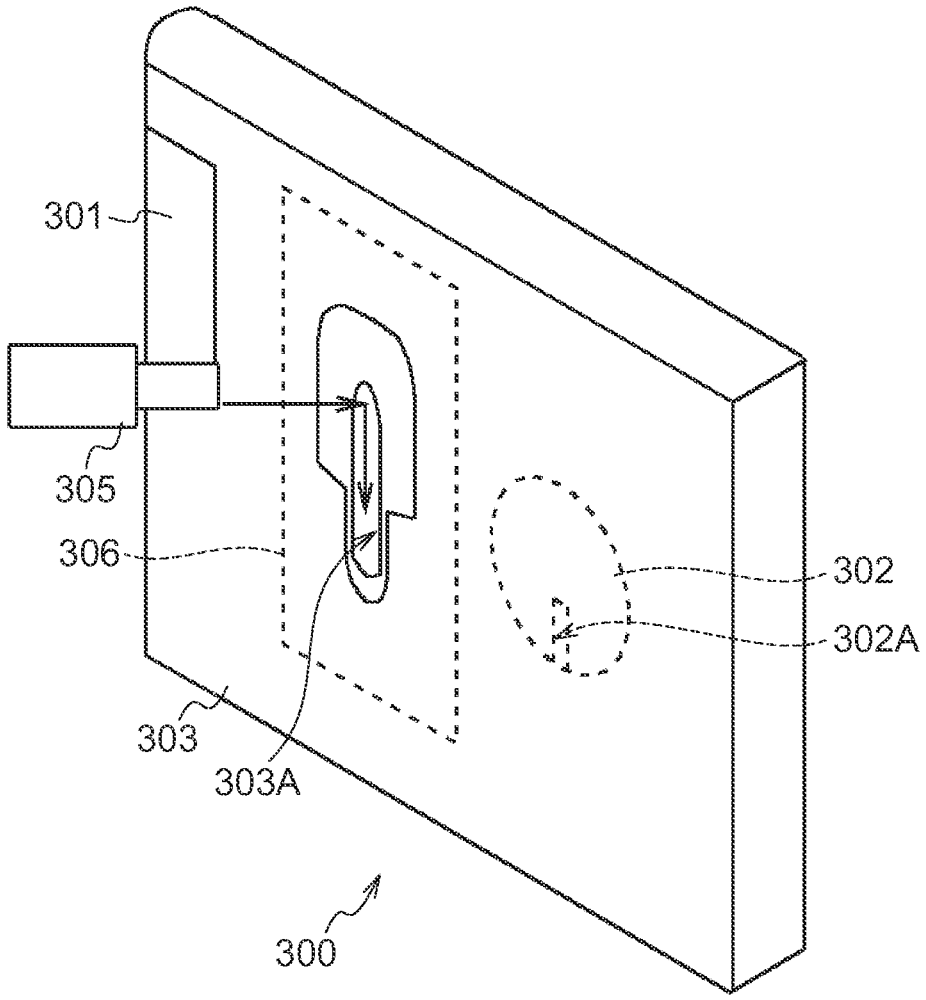
FIG. 49 is a schematic perspective view illustrating a configuration of a lock section provided to a conventional banknote storage container (2).

However, the present invention is not limited thereto, and application may be made, for example as illustrated in FIG. 47, of the paper sheet storage container with banknote storage containers and an auxiliary storage container disposed in a vertical storage container placement casing 265 that is provided to an automatic teller machine or a cash dispenser (CD) so as to be removable therefrom.

In the present invention, the paper sheet storage container is widely applicable to paper sheet storage containers of various other configurations that have an outer case, a door and a lock, such as banknote storage containers for storing rectangular shaped banknotes that are to be conveyed with a conveying orientation with one short side oriented in the conveying direction, wherein the banknotes are taken in and stored in the conveying orientation, or paper sheet storage containers for storing paper sheets such as travel tickets and other tickets, copier paper, sheet documents and securities.

In the present invention, when the paper sheet storage container according to the present invention is applied to any of the various configurations of paper sheet storage containers having an outer case, a door and a key, similar advantageous effects can be obtained to the advantageous effects obtained in the first to the third embodiments described above.

(4-10) Other Embodiment 10

In the first to the third embodiments described above, explanation has been given of cases in which the paper sheet handing apparatus of the present invention is applied to the automatic teller machines 1, 70, 110 described above with reference to FIG. 1 to FIG. 47.

However, the present invention is not limited thereto, and application may be made to an automatic teller machine that includes a banknote insertion/removal section, a differentiating section, a temporary holding section, and plural banknote storage containers and an auxiliary storage container (a reject container, a left behind container, and a supplementation/retrieval container), and that conveys rectangular shaped banknotes that are positioned with one long side on the left hand side and with the other long side positioned on the right hand side (namely with a banknote short direction substantially parallel to the teller machine left direction), and conveyed with a conveying orientation with one short side facing in the conveying direction, and that handles the banknotes oriented with the banknote short direction corresponding to the conveying direction substantially parallel to the teller machine left direction.

The paper sheet handing apparatus of the present invention may also be applied to a cash dispenser or change machine that handles rectangular shaped banknotes such that they are conveyed with either one long side or one short side oriented in the conveying direction.

The paper sheet handing apparatus of the present invention may also be widely applied to paper sheet handing apparatuses of various other configurations that handle various types of paper sheets such as banknotes, vouchers and tickets, such as a ticket dispenser for selling train tickets, theater tickets and the like, an exit-fare machine, an automatic vending machine, an amusement machine such as a pachinko or slot machine, a photocopier, a document handling machine and the like.

(4-11) Other Embodiment 11

Moreover, in the first to the third embodiments described above explanation of an outer case has been given with reference to FIG. 1 to FIG. 47 of cases in which application is made to the substantially rectangular box shaped outer cases 40, 55, 90, 121, 137, 147, 157, 168, 178, 193, 211, 216, 221, 224 to 252 that are configured from metal plates and are long in the up-down direction.

However, the present invention is not limited thereto, and application may be widely made to outer cases of various other shapes and configurations, such as outer cases that are rectangular box shaped and long in the left-right or front-rear directions, outer cases that are substantially circular cylinder shaped, outer cases that do not have a handle, outer cases with a door attached to an upper face thereof, and outer cases integrally molded from a resin material in a substantially rectangular box shape.

(4-12) Other Embodiment 12

Furthermore, as a door open-closable attached to the outer case, explanation has been given in the first to the third embodiment described above with reference to FIG. 1 to FIG. 47 of application to the doors 42, 57 to 59, 92, 122, 135, 141, 145, 157, 166, 176, 191 that are formed from substantially rectangular shaped, or substantially square shaped metal plates.

However, the present invention is not limited thereto, and application may be widely made to doors of various other shapes or configurations, such as bat shaped doors that close to cover an outer case, doors that are openable and closeable by sliding with respect to the outer case, and doors formed in substantially square plate shapes from a resin material.

(4-13) Other Embodiments 13

Moreover, as a lock for locking the door in the closed state with respect to the outer case, explanation has been given in the first to the third embodiments described above with reference to FIG. 1 to FIG. 47 of application to the locks 43, 60 to 62, 93, 123, 136, 142, 146, 154, 167, 177, 192 such as cylinder locks corresponding to a key such as a dimple key.

However the present invention is not limited thereto, and application may be widely made to locks of various other configurations and shapes, such as dial locks and ten-key locks.

(4-14) Other Embodiment 14

Moreover, as a seal attachment portion for attaching with a seal to seal the door that is closed with respect to the outer case, to indicate that the door is closed with respect to the outer case, and to lock the door in the closed state with respect to the outer case, explanation has been given in the first to the third embodiment described above with reference to FIG. 1 to FIG. 47, of application to the seal attachment portions 46, 65 to 67, 107, 127, 130, 138, 140, 148, 149, 158, 169, 179, 194, 200, 210, 215, 220, 253.

However, the present invention is not limited thereto, and application may be widely made to seal attachment portions of various other configurations as long as a seal for sealing a door that is closed with respect to an outer case can be attached to indicate that the door is closed with respect to the outer case, and to lock the closed state of the door with respect to the outer case.

(4-15) Other Embodiment 15

Moreover, as a seal that seals a door that is closed with respect to an outer case, explanation has been given in the first to third embodiments described above with reference to FIG. 1 to FIG. 47 of application to the zip tie seal 50 made from a resin.

However, the present invention is not limited thereto, and application may be widely made to seals of various other configurations, such as zip ties made of metal, zip ties with unique identification information to foil counterfeiting even if a new zip tie is attached when one zip tie has once been improperly removed from the seal attachment portion, or as described in the other embodiment 5 above, the seal 230 that is configured by a ring shaped wire with one end joined to the other end through a sleeve, or the seal 231 that is configured by a padlock.

(4-16) Other Embodiment 16

Moreover, as a latch that is attached to the lock to lock the closed state of the door with respect to the outer case, explanation has been given in the first embodiment to the third embodiment described above with reference to FIG. 1 to FIG. 47 of application to the lock levers 44, 101 to 103, 124, 170 that are made from long narrow metal plates that rotate coupled to rotation operation of a lock.

However, the present invention is not limited thereto, and application may be widely made to latches of various other configurations, such as a deadbolt that displaces by sliding coupled to rotation operation of a key.

(4-17) Other Embodiment 17

Moreover, as an attachment plate provided to the outer case or the door or both and provided with a hole portion for attachment of a seal, explanation has been given in the first to the third embodiment described above with reference to FIG. 1 to FIG. 47, of application to the door side attachment plates 42C, 57B, 135A, 141A, 202, and the case side attachment plates 47, 68, 131, 139, 195, and the attachment plates 145A, 145B, 181, 195 that are formed in rectangular shapes or substantially L-shapes.

However, the present invention is not limited thereto, and application may be widely made to attachment plates of various other configurations such as attachment plates formed so as to be provided with ribs on one face of a flat plate.

(4-18) Other Embodiment 18

Moreover, as a seal housing groove portion that houses a seal attached to a seal attachment portion, explanation has been given in the first to the third embodiments described above with reference to FIG. 1 to FIG. 47 of application to the substantially L-shaped seal housing groove portions 55D, 211AX, 216AX, 221AX.

However, the present invention is not limited thereto, and application may be widely made to seal housing groove portions of various other shapes.

(4-19) Other Embodiment 19

Moreover, as a slide-off prevention portion that prevents the seal housed in the seal housing groove portion from sliding off from the seal housing groove portion, explanation has been given in the first to the third embodiments described above with reference to FIG. 1 to FIG. 47 of application to the slide-off prevention levers 212, 222 and the slide-off prevention arms 217, 218, 223, 224.

However, the present invention is not limited thereto, and application may be widely made to slide-off prevention portions of various other configurations such as a lid portion that closes off the seal housing groove portion.

(4-20) Other Embodiment 20

Moreover, as a storage container mounting portion detachably mounted with a banknote storage container stored with paper sheets for handling in an outer case, explanation has been given in the first to the third embodiments described above with reference to FIG. 1 to FIG. 47 of application to the unit housings 32, 80, 249, 250, 260, 262.

However, the present invention is not limited thereto, and application may be widely made to storage container mounting portions of various other configurations, such as a unit housing in which plural banknote storage containers are placed in sequence with doors facing forwards (or to the left, or to the right), or vertical storage container placement cases with plural shelves.

(4-21) Other Embodiment 21

Moreover, as the paper sheet for handling stored in the outer case of the paper sheet storage container explanation has been given in the first to the third embodiments described above with reference to FIG. 1 to FIG. 47 of application to banknotes.

However, the present invention is not limited thereto, and application may be widely made to various other types of paper sheets such as travel tickets, other tickets, copier paper, sheet documents and securities.

Industrial Applicability

The present invention may be employed in paper sheet storage containers that store paper sheets such as banknotes, travel tickets, other tickets, copier paper, sheet documents and securities, and employed in paper sheet handing apparatuses that handle paper sheets such as banknotes, travel tickets, other tickets, copier paper, sheet documents and securities stored in paper sheet storage containers.

The invention claimed is:

1. A paper sheet storage container, comprising:

an outer case;

a door, attached to the outer case, that is open-closable;

a lock that locks the door in a closed state with respect to the outer case; and a seal attachment portion for attaching with a seal so as to keep the door in the closed state with respect to the outer case, the seal attachment portion including, an attachment plate that is provided to at least one of the outer case or the door, and is provided with a hole portion for attaching thereto the seal that seals the door closed with respect to the outer case, and a seal housing groove portion formed in the outer case that houses at least a portion of the seal attached to the attachment plate.

2. The paper sheet storage container of claim 1, further comprising:

a latch, attached to the lock, that locks the closed state of the door with respect to the outer case, wherein the seal attachment portion is in the vicinity of the latch.

3. The paper sheet storage container of claim 1, wherein the seal attachment portion further comprises a slide-off prevention portion disposed in the seal housing groove portion that prevents the seal housed in the seal housing groove portion from sliding out therefrom.

4. A paper sheet handling apparatus, comprising:

a storage container mounting portion detachably mounted with a banknote storage container that is stored with paper sheets for handling within an outer case, the paper sheet storage container including:

the outer case;

a door, attached to the outer case, that is open-closable;

a lock that locks the door in a closed state with respect to the outer case; and a seal attachment portion for attaching a seal so as to keep the door in the closed state with respect to the outer case, the seal attachment portion including, an attachment plate that is provided to at least one of the outer case or the door, and is provided with a hole portion for attaching thereto the seal that seals the door closed with respect to the outer case, and a seal housing groove portion formed in the outer case that houses at least a portion of the seal attached to the attachment plate.

* * * * *